US005620822A

United States Patent [19]

Kato et al.

[11] Patent Number: 5,620,822

[45] Date of Patent: Apr. 15, 1997

[54] METHOD FOR PREPARATION OF PRINTING PLATE BY ELECTROPHOTOGRAPHIC PROCESS

[75] Inventors: Eiichi Kato; Yusuke Nakazawa; Sadao Osawa, all of Shizuoka, Japan

[73] Assignee: Fuji Photo Film Co., Ltd., Kanagawa, Japan

[21] Appl. No.: 262,029

[22] Filed: Jun. 17, 1994

[30] Foreign Application Priority Data

Jun. 17, 1993 [JP] Japan ..... 5-169846
Aug. 26, 1993 [JP] Japan ..... 5-232181

[51] Int. Cl.[6] ..... G03G 13/22

[52] U.S. Cl. ..... 430/49; 430/126

[58] Field of Search ..... 430/49, 47, 126

[56] References Cited

U.S. PATENT DOCUMENTS

| | | | |
|---|---|---|---|
| 4,292,120 | 9/1981 | Nacci | 430/39 |
| 4,970,119 | 11/1990 | Koshizuka et al. | 428/195 |
| 5,176,974 | 1/1993 | Till et al. | 430/42 |
| 5,229,236 | 7/1993 | Kato et al. | 430/49 |
| 5,229,241 | 7/1993 | Kato et al. | 430/49 |
| 5,292,613 | 3/1994 | Sato et al. | 430/257 |
| 5,340,679 | 8/1994 | Badesha et al. | 430/271 |
| 5,391,445 | 2/1995 | Kato et al. | 430/49 |
| 5,395,721 | 3/1995 | Kato et al. | 430/49 |
| 5,501,929 | 3/1996 | Kato et al. | 430/49 |

*Primary Examiner*—Roland Martin
*Attorney, Agent, or Firm*—Sughrue, Mion, Zinn, Macpeak & Seas

[57] ABSTRACT

A method for preparation of a printing plate by an electrophotographic process comprising forming a peelable transfer layer mainly containing a resin (A) capable of being removed upon a chemical reaction treatment on the surface of an electrophotographic light-sensitive element, forming a toner image on the transfer layer by an electrophotographic process, heat-transferring the toner image together with the transfer layer onto a receiving material a surface of which is capable of providing a hydrophilic surface suitable for lithographic printing at the time of printing, and removing the transfer layer on the receiving material upon the chemical reaction treatment, wherein prior to or simultaneously with the formation of transfer layer a compound (S) which contains a fluorine atom and/or silicon atom is applied to the surface of electrophotographic light-sensitive element to improve releasability of the surface of electrophotographic light-sensitive element.

The method continuously provides printing plates excellent in image qualities in a stable manner and is suitable for a scanning exposure system using a laser beam.

An apparatus suitable for performing the present method is also disclosed.

17 Claims, 6 Drawing Sheets

METHOD FOR PREPARATION OF PRINTING PLATE BY ELECTROPHOTOGRAPHIC PROCESS

FIELD OF THE INVENTION

The present invention relates to a method for preparation of a printing palate by an electrophotographic process and an apparatus for use therein, and more particularly to a method for preparation of a printing plate by an electrophotographic process comprising transfer of a toner image formed by an electrophotographic process together with a transfer layer and removal of the transfer layer wherein the transfer layer is easily transferred and removed and good image qualities are maintained during a plate-making process thereby providing prints of good image qualities.

BACKGROUND OF THE INVENTION

Lithographic offset printing plates currently employed include PS plates which are produced by using a positively working photosensitive composition mainly comprising a diazo compound and a phenolic resin or a negatively working photosensitive composition mainly comprising an acrylic monomer or a prepolymer thereof. Since all of these conventional PS plates have low sensitivity, it is necessary to conduct contact exposure from a film on which an image has already been recorded for plate-making.

On the other hand, owing to the recent technical advancements of image processing by a computer, storage of a large amount of data and data communication, input of information, revision, edition, layout, and pagination are consistently computerized, and electronic editorial system enabling instantaneous output on a remote terminal plotter through a high speed communication network or a communications satellite has been practically used. The need of the electronic editorial system has been increasing especially in the field of printing newspaper requiring immediacy. Also in the field where an original is preserved as a film from which a printing plate may be reproduced in case of necessity, it is expected that digitalized data will be stored in very large volume recording media such as optical discs.

However, few direct type printing plate precursors directly preparing printing plates based on the output from a terminal plotter have been put to practical use. For the time being, even in the field where an electronic editorial system actually works, the output is once visualized on a silver halide photographic film, which is then subjected to contact exposure to a PS plate to produce a printing plate. One reason for this is difficulty in developing a direct type printing plate precursor having high sensitivity to a light source of the plotter, e.g., an He—Ne laser or a semiconductor laser, sufficient for enabling plate-making within a practically allowable period of time.

Light-sensitive materials having high photosensitivity which may possibly provide a direct type printing plate include electrophotographic light-sensitive materials. An attempt has been made in a system using an electrophotographic lithographic printing plate precursor in which a toner image is electrophotographically formed on an electrophotographic light-sensitive material containing photoconductive zinc oxide and then, non-image areas are subjected to oil-desensitization with an oil-desensitizing solution to obtain a lithographic printing plate, to apply a light-sensitive material having high sensitivity to semiconductor laser beam to the electrophotographic light-sensitive material.

For example, the use of specific spectral sensitizing dye is proposed as described, for example, in JP-B-2-28143 (the term "JP-B" as used herein means an "examined Japanese patent publication"), JP-A-63-124054 (the term "JP-A" as used herein means an "unexamined published Japanese patent application"), JP-A-63-241561, and JP-A-63-264763. Further, improvements in a binder resin for a photoconductive layer are proposed in order to increase photosensitivity and to reduce background stains in non-image areas (i.e., to improve water retentivity of non-image areas) as described, for example, in JP-A-63-220148, JP-A-1-116643, and JP-A-2-69759.

Since these plate-making techniques are based on oil-desensitization of zinc oxide for making it hydrophilic, and a specific oil-desensitizing solution and specific dampening water are used, there are various restrictions in that color inks usable are limited, in that printing durability is markedly reduced when neutral paper is employed as printing paper, and in that a printing machine in which a plate of this kind and a PS plate are exchangeably used must be thoroughly cleaned.

It is also known to electrophotographically make a lithographic printing plate by removing a photoconductive layer of non-image areas after the toner image formation. Printing plate precursors suitable for use in such a system are described, for example, in JP-B-37-17162, JP-B-38-6961, JP-B-38-7758, JP-B-41-2426, JP-B-46-39405, JP-A-50-19509, JP-A-50-19510, JP-A-52-2437, JP-A-54-145538, JP-A-54-134632, JP-A-55-105254, JP-A-55-153948, JP-A-55-161250, JP-A-57-147656, and JP-A-57-161863.

In order to use an electrophotographic light-sensitive material as a printing plate, binder resins which can be dissolved or swollen with an alkaline solvent and thereby removed are often used in the photoconductive layer so that the photoconductive layer in non-image areas can be etched with an alkaline etchant to expose the underlying hydrophilic surface. The resins soluble or swellable in the alkaline solvent are usually less compatible with organic photoconductive compounds than polycarbonate resins widely employed as binder resins for electrophotographic light-sensitive materials. Accordingly, an amount of the organic photoconductive compound to be incorporated into a photoconductive layer is limited. When a content of the organic photoconductive compound in a photoconductive layer is low, a transfer rate of carrier in the photoconductive layer is reduced even if a sufficient amount of carrier for offsetting the surface potential is generated in the photoconductive layer and, as a result, a rate of surface potential decay, i.e., a rate of response is reduced. This means prolongation of the time after exposure required for the surface potential to decay to a sufficient level for causing no fog and for starting toner development. As an exposure illuminance increases in order to shorten the exposure time for the purpose of minimizing the processing time, the above-described response time becomes longer. Therefore, the slow response is a great hindrance to achievement of reduction in total processing time.

Scanning exposure with a light source of high illuminance, e.g., a laser light source, arouses another problem. Specifically, if the response is slow, since the rate of surface potential decay differs between the area where scanning has started and the area where scanning ends, the resulting image suffers from fog in the latter area, although free from fog in the former area. This is disadvantageous for plate-making.

Binder resins which have conventionally been used in electrophotographic lithographic printing plate precursors include styrene-maleic anhydride copolymers, vinyl acetate-crotonic acid copolymers, vinyl acetatemaleic anhydride copolymers, and phenolic resins as described, for example, in JP-B-41-2426, JP-B-37-17162, JP-B-38-6961, JP-A-52-2437, JP-A-54-19803, JP-A-54-134632, JP-A-55-105254, JP-A-50-19509, and JP-A-50-19510.

It has been pointed out, however, that these known binder resins have various disadvantages when they are used in electrophotographic lithographic printing plate precursors utilizing an organic photoconductive compound. For example, when a styrene-maleic anhydride copolymer resin is used as a binder resin, the film formed is rigid and may cause cracks in case of bending the plate. Also, the layer is so poor in adhesion to a substrate that the plate fails to withstand mass printing. A film formed by using a phenolic resin as a binder resin is brittle and has poor printing durability. A film of a vinyl acetate-crotonic acid copolymer or a vinyl acetate-maleic anhydride copolymer also exhibits poor printing durability. In addition, satisfactory electrophotographic characteristics, especially charge retention in dark and photosensitivity cannot be secured with any of these resins.

Copolymers comprising an acrylic ester or methacrylic ester and a carboxylic acid-containing monomer are described in order to solve the above-described problems in JP-A-57-161863 and JP-A-58-76843. These binder resins make it feasible to use an electrophotographic light-sensitive material as a printing plate precursor. Nevertheless, the recently posed problem arising from the slow response described above, i.e., insufficient photosensitivity, still remains unsolved.

Further, in JP-B-1-209458 copolymers comprising an acrylic ester or methacrylic ester containing an aromatic ring and an acid group-containing monomer, e.g., a carboxylic acid-containing monomer are described, for achieving improved printing durability and photosensitivity. However, while the performance properties described above may be improved, these copolymers are disadvantageous in that the resulting photoconductive layer of non-image areas (areas other than toner image-bearing areas) is not easily and rapidly removable so that strict control of conditions for removal is required.

More specifically, the problem in that the conditions for achieving complete removal of only non-image areas without-causing dissolution of even minute toner image areas thereby to produce a printing plate having a reproduced image with high fidelity and causing no background stains are restricted is still unsolved.

In addition, in the above-described system in which the whole photoconductive layer of the non-image areas is dissolved out in an alkaline processing solution, the dissolved material is accumulated in the alkaline processing solution. Therefore, when the processing solution is used for successive treatment of a large number of plate precursors, problems, for example, precipitation of agglomerates and reduction of the dissolving power may occur.

SUMMARY OF THE INVENTION

The present invention is to solve the above-described various problems associated with conventional plate-making techniques.

An object of the present invention is to provide a method for preparation of a printing plate by an electrophotographic process which can provide printing plates excellent in image qualities of plate-making and printing and continuously produce such printing plates in a stable manner for a long period of time, even when printing plate precursors are placed one over another before removing the transfer layer.

Another object of the present invention is to provide a method for preparation of a printing plate by an electrophotographic process which is suitable for an image formation system including scanning exposure using, for example, a laser beam.

A further object of the present invention is to provide a method for preparation of a printing plate by an electrophotographic process in which an electrophotographic light-sensitive element is repeatedly usable and which method is effective for reducing a running cost.

A still further object of the present invention is to provide a method for preparation of a printing plate by an electrophotographic process in which heat-transfer of a transfer layer onto a receiving material can easily be performed and the transferred layer can easily be removed.

A still further object of the present invention is to provide a method for preparation of a printing plate by an electrophotographic process in which a transfer layer bearing toner images formed is easily transferred onto a receiving material under transfer conditions of enlarged latitude and irrespective of the kind of receiving material to be used.

A still further object of the present invention is to provide an apparatus for preparation of a printing plate by an electrophotographic process which is suitable for use in the above described method for preparation of a printing plate.

Other objects of the present invention will become apparent from the following description.

It has been found that the above described objects of the present invention are accomplished by a method for preparation of a printing plate by an electrophotographic process comprising forming a peelable transfer layer mainly containing a resin (A) capable of being removed upon a chemical reaction treatment on the surface of an electrophotographic light-sensitive element, forming a toner image on the transfer layer by an electrophotographic process, heat-transferring the toner image together with the transfer layer onto a receiving material a surface of which is capable of providing a hydrophilic surface suitable for lithographic printing at the time of printing, and removing the transfer layer on the receiving material upon the chemical reaction treatment, wherein prior to or simultaneously with the formation of transfer layer a compound (S) which contains a fluorine atom and/or silicon atom is applied to the surface of electrophotographic light-sensitive element to improve releasability of the surface of electrophotographic light-sensitive element.

It has also be found that they are accomplished by an apparatus for plate-making by an electrophotographic process, comprising:

(a) an electrophotographic light-sensitive element, (b) a means for applying a compound (S) which contains a fluorine atom and/or silicon atom to the surface of electrophotographic light-sensitive element, (c) a means for forming a peelable transfer layer mainly containing a resin (A) capable of being removed upon a chemical reaction treatment on the surface of electrophotographic light-sensitive element, (d) a means for forming a toner image by an electrophotographic process on the peelable transfer layer, and (e) a means for heat-transferring the toner image together with the transfer layer onto a receiving material a surface of which is capable of providing a hydrophilic surface suitable for lithographic printing at the time of printing, wherein the electrophotographic light-sensitive element is repeatedly usable.

BRIEF DESCRIPTION OF THE ACCOMPANYING DRAWINGS

EXPLANATION OF THE SYMBOLS

Figure 1:
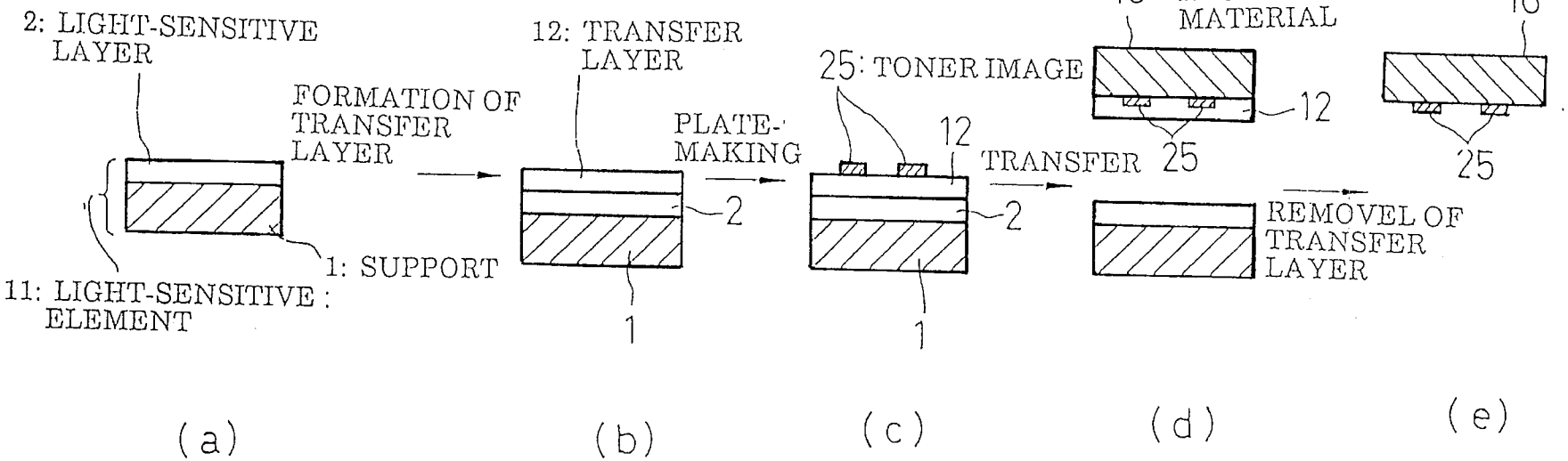
FIG. 1 is a schematic view for explanation of the method according to the present invention.

1 Support of light-sensitive element
2 Light-sensitive layer
9 Applying unit for compound (S)
10 Release paper
11 Light-sensitive element
12 Transfer layer
**12*a*** Resin for forming transfer layer
**12*b*** Dispersion of resin grains
13 Hot-melt coater
**13*a*** Stand-by position of hot-melt coater
14 Liquid developing unit set
14L Liquid developing unit
14T Electrodeposition unit
15 Suction/exhaust unit
**15*a*** Suction part
**15*b*** Exhaust part
16 Receiving material
17 Heat transfer means
**17*a*** Pre-heating means
**17*b*** Heating roller
**17*c*** Cooling roller
18 Corona charger
19 Exposure device
25 Toner image
117 Heat transfer means
**117*b*** Heating roller
**117*c*** Cooling roller
120 Transfer roll
121 Metering roll
122 Compound (S)

DETAILED DESCRIPTION OF THE INVENTION

The method for preparation of a printing plate by an electrophotographic process according to the present invention will be diagrammatically described with reference to FIG. 1 of the drawings.

As shown in FIG. 1, the method for preparing a printing plate comprises forming a peelable transfer layer 12 capable of being removed upon a chemical reaction treatment in the presence of a compound (S) on an electrophotographic light-sensitive element 11 having at least a support 1 and a light-sensitive layer 2, forming a toner image 25 on the transfer layer 12, transferring the toner image 25 together with transfer layer 12 onto a receiving material 16 which is a support for an offset printing plate by heat transfer to prepare a printing plate precursor, and then removing the transfer layer 12 transferred onto the receiving material 16 upon a chemical reaction treatment and leaving the toner image 3 on the receiving material 16 to prepare a printing plate.

In case of conventional printing plates, hydrophilic non-image areas are formed by modification of the surface of a light-sensitive element itself, for example, by rendering a light-sensitive layer hydrophilic, or by dissolving out of a light-sensitive layer to expose the underlying hydrophilic surface of a support. On the contrary, according to the present invention, the printing plate is prepared by a method constructed from an entirely different point of view in that a transfer layer together with a toner image thereon is transferred to another support having a hydrophilic surface and then the transferred layer is removed by a chemical reaction treatment.

The method for preparation of a printing plate according to the present invention is characterized in that the compound (S) containing a fluorine atom and/or silicon atom is applied to the surface of electrophotographic light-sensitive element prior to or simultaneously with the formation of transfer layer. By the action of compound (S) applied, the transfer layer becomes peelable and is easily released from the surface of electrophotographic light-sensitive element to be transferred on a receiving material.

Further, the transfer layer according to the present invention has many advantages in that no deterioration of electrophotographic characteristics (such as chargeability, dark charge retention rate, and photosensitivity) occur until a toner image is formed by an electrophotographic process, thereby forming a good duplicated image, in that it has sufficient thermoplasticity for easy transfer to a receiving material irrespective of the kind of receiving material in a heat transfer process, and in that it is easily removed by a chemical reaction treatment to prepare a printing plate.

According to the present invention, a means for applying the compound (S) and a means for forming the transfer layer can be provided individually in a plate-making apparatus, or only one means effecting both functions can be provided.

Now, the compound (S) containing a fluorine atom and/or silicon atom which can be used for releasing the transfer layer from the light-sensitive element according to the present invention will be described in detail below.

The compound (S) containing a moiety having a fluorine and/or silicon atom is not particularly limited in its structure as far as it can improve releasability of the surface of electrophotographic light-sensitive element, and includes a low molecular weight compound, an oligomer, and a polymer. The compound (S) which is soluble at least 0.01 g in one liter of an electrically insulating organic solvent having an electric resistance of not less than $10^8$ Ω.cm and a dielectric constant of not more than 3.5 is preferred.

When the compound (S) is an oligomer or a polymer, the moiety having a fluorine and/or silicon atom includes that incorporated into the main chain of the oligomer or polymer and that contained as a substituent in the side chain thereof.

Of the oligomers and polymers, those containing repeating units containing the moiety having a fluorine and/or silicon atom as a block are preferred since they adsorb on the surface of electrophotographic light-sensitive element to impart good releasability.

The fluorine atom-containing moieties include monovalent or divalent organic residues, for example, $—C_hF_{2h+1}$ (wherein h represents an integer of from 1 to 22), $—(CF_2)_jCF_2H$ (wherein j represents an integer of from 1 to 17), $—CFH_2$,

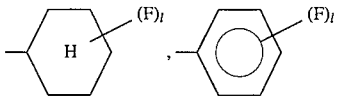

(wherein l represents an integer of from 1 to 5), $—CF_2—$, —CFH—,

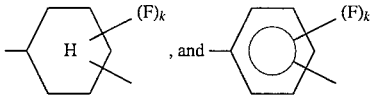

(wherein k represents an integer of from 1 to 4).

The silicon atom-containing moieties include monovalent or divalent organic residues, for example,

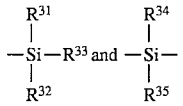

wherein $R^{31}$, $R^{32}$, $R^{33}$, $R^{34}$, and $R^{35}$, which may be the same or different, each represents a hydrocarbon group which may be substituted, $—OR^{36}$ (wherein $R^{36}$ represents a hydrocarbon group which may be substituted),

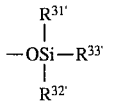

(wherein $R^{31'}$, $R^{32'}$ and $R^{33'}$, which may be the same or different, each represents a hydrocarbon group which may be substituted or $—OR^{36}$), $—COOR^{36}$,

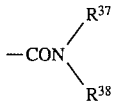

(wherein $R^{37}$ and $R^{38}$, which may be the same or different, each represents a hydrocarbon group which may be substituted) or $—SR^{36}$.

The hydrocarbon group represented by $R^{31}$, $R^{32}$, $R^{33}$, $R^{34}$, $R^{35}$, $R^{36}$, $R^{37}$, $R^{38}$, $R^{31'}$, $R^{32'}$ or $R^{33'}$ include specifically an alkyl group having from 1 to 18 carbon atoms (e.g., methyl, ethyl, propyl, butyl, pentyl, hexyl, heptyl, octyl, nonyl, decyl, dodecyl, tridecyl, tetradecyl, hexadecyl, or octadecyl), an aralkyl group having from 7 to 14 carbon atoms (e.g., benzyl, phenethyl, 3-phenylpropyl, α-methylphenethyl, naphthylmethyl, or 2-naphthylethyl), an alicyclic group having from 5 to 8 carbon atoms (e.g., cyclopentyl, cyclohexyl, cycloheptyl, cyclooctyl, adamantly, or cyclohexenyl), an aliphatic unsaturated group having from 2 to 18 carbon atoms (e.g., ethenyl, propenyl, butenyl, pentenyl, hexenyl, octenyl, propynyl, or butynyl), or an aromatic group having from 6 to 12 carbon atoms (e.g., phenyl, or naphthyl).

These hydrocarbon groups may have one or more substituents which are mono-valent organic moieties containing up to 20 atoms in total. Specific examples of the substituent include an alkyl group, an aryl group a hydroxy group, a carboxy group, a cyano group, a halogen atom (e.g., fluorine, chlorine, bromine, or iodine), a thiol group, a formyl group, a nitro group, a phosphono group, —OR', —COOR', —OCOR', —COR',

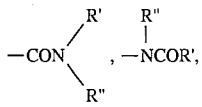

—NHCONHR', —NHCOOR', $—SO_2R'$ or —SR', wherein R' represents a hydrocarbon group as defined for $R^{31}$ or a heterocyclic group (e.g., thienyl, pyranyl, morpholines, pyridyl, piperidino, or imidazolyl), and R" represents a hydrogen atom or a hydrocarbon group as defined for $R^{31}$.

The fluorine atom and/or silicon atom-containing organic residue may be composed of a combination thereof. In such a case, they may be combined either directly or via a linking group. The linking groups include divalent organic residues, for example, divalent aliphatic groups, divalent aromatic groups, and combinations thereof, which may or may not contain a bonding group, e.g. , —O—, —S—,

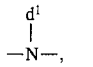

—SO—, $—SO_2—$, —COO—, —OCO—, —CONHCO—, —NHCONH—,

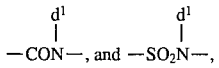

wherein $d^1$ has the same meaning as $R^{31}$ above.

Examples of the divalent aliphatic groups are shown below.

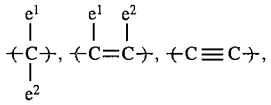

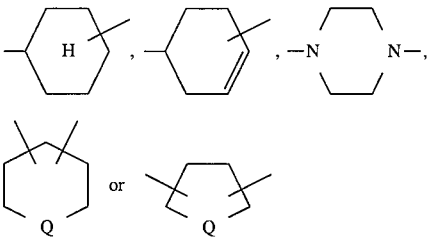

wherein $e^1$ and $e^2$, which may be the same or different, each represents a hydrogen atom, a halogen atom (e.g., chlorine or bromine) or an alkyl group having from 1 to 12 carbon atoms (e.g., methyl, ethyl, propyl, chloromethyl, bromomethyl, butyl, hexyl, octyl, nonyl or decyl); and Q represents —O—, —S—, or

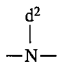

wherein $d^2$ represents an alkyl group having from 1 to 4 carbon atoms, $—CH_2Cl$, or $—CH_2Br$.

Examples of the divalent aromatic groups include a benzene ring, a naphthalene ring, and a 5- or 6-membered heterocyclic ring having at least one hetero atom selected from an oxygen atom, a sulfur atom and a nitrogen atom. The aromatic groups may have a substituent, for example, a halogen atom (e.g., fluorine, chlorine or bromine), an alkyl group having from 1 to 8 carbon atoms (e.g., methyl, ethyl, propyl, butyl, hexyl or octyl) or an alkoxy group having from 1 to 6 carbon atoms (e.g., methoxy, ethoxy, propoxy or butoxy). Examples of the heterocyclic ring include a furan ring, a thiophene ring, a pyridine ring, a piperazine ring, a tetrahydrofuran ring, a pyrrole ring, a tetrahydropyran ring, and a 1,3-oxazoline ring.

Specific examples of the compound (S) containing a fluorine and/or silicon atom which can be used in the present invention include fluorine and/or silicon-containing organic compounds described, for example, in Tokiyuki Yoshida, et al. (ed.), *Shin-ban Kaimenkasseizai Handbook*, Kogaku Tosho (1987), Takao Karikome, *Saishin Kaimenkasseizai Oyo Gijutsu*, C.M.C. (1990), Kunio Ito (ed.), *Silicone Handbook*, Nikkan Kogyo Shinbunsha (1990), Takao Karikome, *Tokushukino Kaimenkasseizai*, C.M.C. (1986), and A. M. Schwartz, et al., *Surface Active Agents and Detergents*, Vol. II.

Further, the compound (S) according to the present invention can be synthesized by utilizing synthesis methods as described, for example, in Nobuo Ishikawa, *Fussokagobutsu no Gosei to Kino*, C.M.C. (1987), Jiro Hirano et al. (ed.), *Ganfussoyukikagobutsu-Sono Gosei to Oyo*, Gijutsu Joho Kokai (1991), and Mitsuo Ishikawa, *Yukikeiso Senryaku Shiryo*, Chapter 3, Science Forum (1991).

Specific examples of repeating units having the fluorine atom and/or silicon atom-containing moiety used in the oligomer or polymer as described above are set forth below, but the present invention should not be construed as being limited thereto. In formulae (F-1) to (F-32) below, Rf represents any one of the following groups of from (1) to (11); and b represents a hydrogen atom, a methyl group or a trifluoromethyl group.

$-C_nF_{2n+1}$ (1)

$-CH_2C_nF_{2n+1}$ (2)

$-CH_2CH_2C_nF_{2n+1}$ (3)

$-CH_2(CF_2)_mCFHCF_3$ (4)

$-CH_2CH_2(CF_2)_mCFHCF_3$ (5)

$-CH_2CH_2(CF_2)_mCFHCF_2H$ (6)

$-CH_2(CF_2)_mCFHCF_2H$ (7)

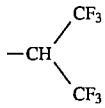
(8)

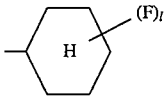
(9)

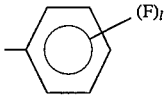
(10)

-continued

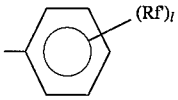
(11)

wherein Rf' represents any one of the above-described groups of from (1) to (8); n represents an integer of from 1 to 18; m represents an integer of from 1 to 18; and l represents an integer of from 1 to 5.

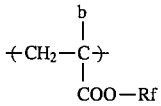
(F-1)

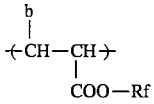
(F-2)

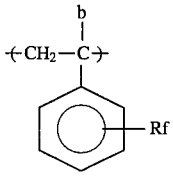
(F-3)

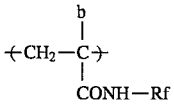
(F-4)

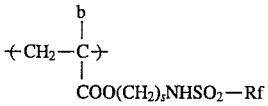
(F-5)

(s: an interger of from 1 to 12)

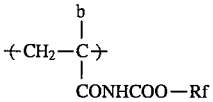
(F-6)

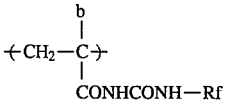
(F-7)

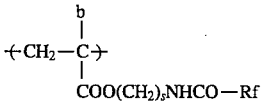
(F-8)

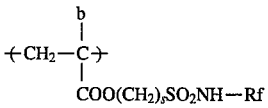
(F-9)

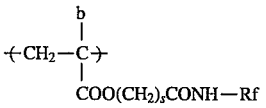
(F-10)

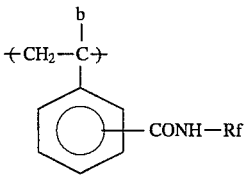
(F-11)

-continued (F-12)

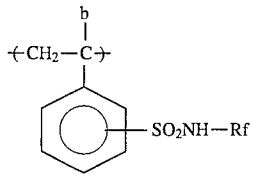

(F-13)

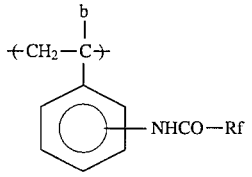

(F-14)

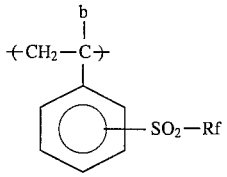

(F-15)

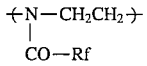

(F-16)

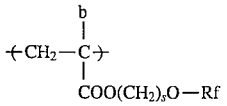

(F-17)

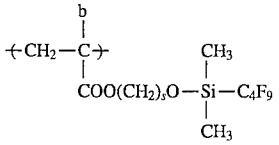

(F-18)

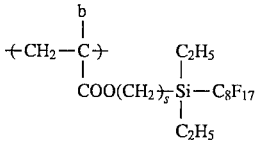

(F-19)

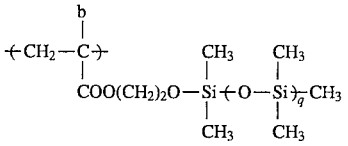

q: an integer of from 1 to 20

(F-20)

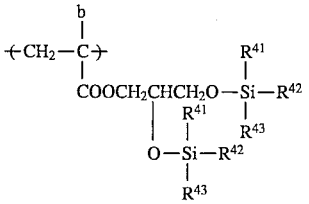

$R^{41}$, $R^{42}$, $R^{43}$: an alkyl group having from 1 to 12 carbon atoms (F-21)

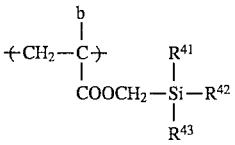

-continued (F-22)

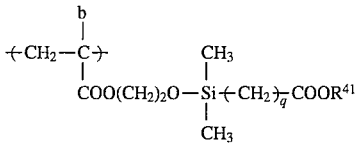

(F-23)

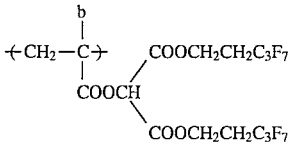

(F-24)

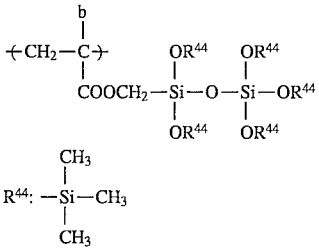

(F-25)

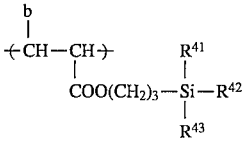

(F-26)

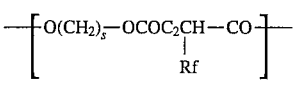

(F-27)

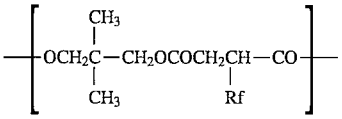

(F-28)

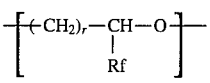

r: an integer of from 3 to 6

(F-29)

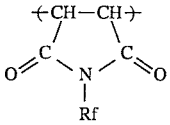

(F-30)

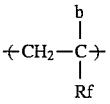

(F-31)

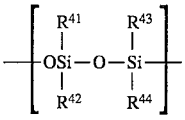

(F-32)

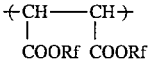

Of the olygomers or polymers of compounds (S), so-called block copolymers are preferred as described above. Specifically, the compound (S) may be any type of copolymer as far as it contains the fluorine atom and/or silicon atom-containing polymer components as a block. The term "to be contained as a block" means that the compound (S) has a polymer segment comprising at least 70% by weight of the fluorine atom and/or silicon atom-containing polymer component based on the weight of the polymer segment. The content of the polymer components present in the polymer segment constituting a block is preferably 90% by weight, more preferably 100% by weight. The forms of blocks include an A-B type block, an A-B-A type block, a B-A-B type block, a grafted type block, and a starlike type block as schematically illustrated below.

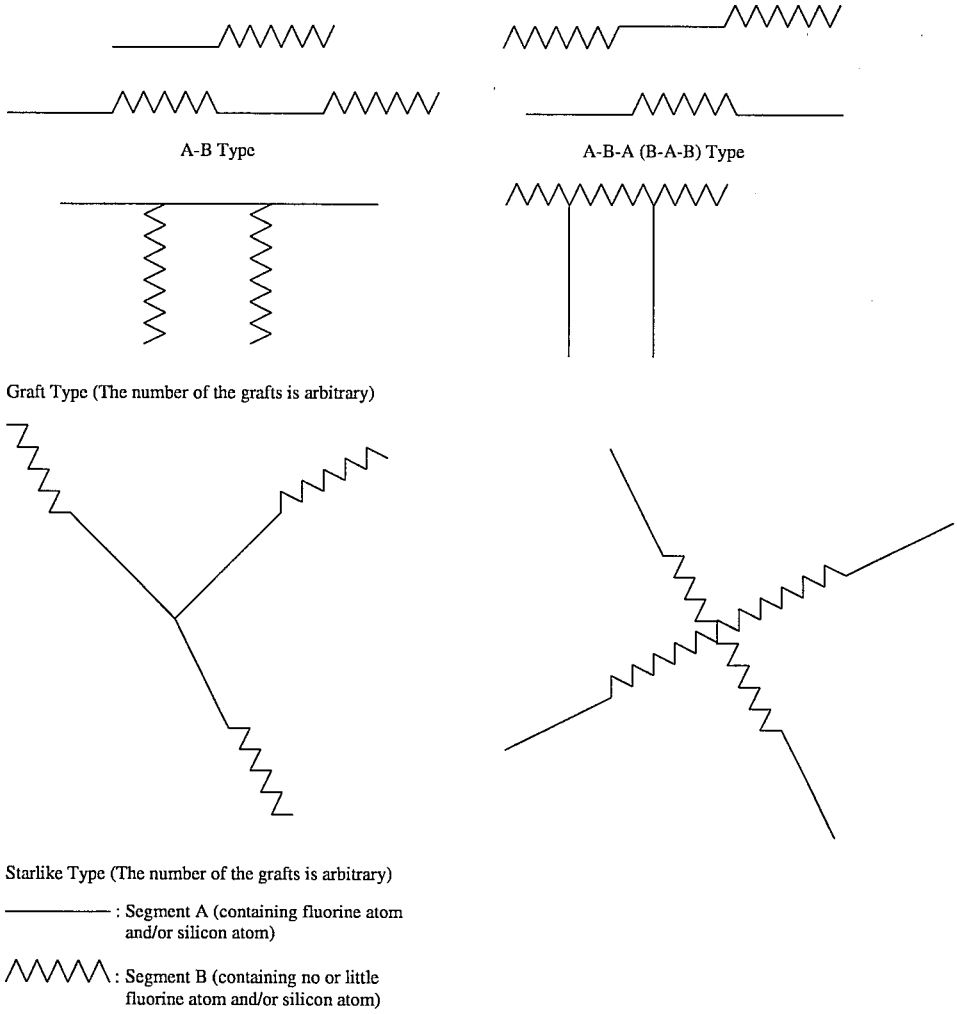

These various types of block copolymers of the compound (S) can be synthesized in accordance with conventionally known polymerization methods. Useful methods are described, e.g., in W. J. Burlant and A. S. Hoffman, *Block and Graft Polymers*, Reuhold (1986), R. J. Cevesa, *Block and Graft Copolymers*, Butterworths (1962), D. C. Allport and W. H. James, *Block Copolymers*, Applied Sci. (1972), A. Noshay and J. E. McGrath, *Block Copolymers*, Academic Press (1977), G. Huvtreg, D. J. Wilson, and G. Riess, *NATO ASIser. SerE.*, Vol. 1985, p. 149, and V. Perces, *Applied Polymer Sci.*, Vol. 285, p. 95 (1985).

For example, ion polymerization reactions using an organometallic compound (e.g., an alkyl lithium, lithium diisopropylamide, an alkali metal alcoholate, an alkylmagnesium halide, or an alkylaluminum halide) as a polymerization initiator are described, for example, in T. E. Hogeu-Esch and J. Smid, *Recent Advances in Anion Polymerization*, Elsevier (New York) (1987), Yoshio Okamoto, *Kobunshi*, Vol. 38, p. 912 (1989), Mitsuo Sawamoto, *Kobunshi*, Vol. 38, p. 1018 (1989), Tadashi Narita, *Kobunshi*, Vol. 37, p. 252 (1988), B. C. Anderson, et al., *Macromolecules*, Vol. 14, p. 1601 (1981), and S. Aoshima and T. Higashimura, *Macromolecules*, Vol. 22, p. 1009 (1989).

Ion polymerization reactions using a hydrogen iodide/iodine system are described, for example, in T. Higashimura, et al., *Macromol. Chem., Macromol. Symp.*, Vol. 13/14, p. 457 (1988), and Toshinobu Higashimura and Mitsuo Sawamoto, *Kobunshi Ronbunshu*, Vol. 46, p. 189 (1989).

Group transfer polymerization reactions are described, for example, in D. Y. Sogah, et al., *Macromolecules*, Vol. 20, p. 1473 (1987), O. W. Webster and D. Y. Sogah, *Kobunshi*, Vol. 36, p. 808 (1987), M. T. Reetg, et al., *Angew. Chem. Int. Ed. Engl.*, Vol. 25, p. 9108 (1986), and JP-A-63-97609.

Living polymerization reactions using a metalloporphyrin complex are described, for example, in T. Yasuda, T. Aida, and S. Inoue, *Macromolecules*, Vol. 17, p. 2217 (1984), M. Kuroki, T. Aida, and S. Inoue, *J. Am. Chem. Soc.*, Vol. 109, p. 4737 (1987), M. Kuroki, et al., *Macromolecules*, Vol. 21, p. 3115 (1988), and M. Kuroki and I. Inoue, *Yuki Gosei Kagaku*, Vol. 47, p. 1017 (1989).

Ring-opening polymerization reactions of cyclic compounds are described, for example, in S. Kobayashi and T. Saegusa, *Ring Opening Polymerization*, Applied Science Publishers Ltd. (1984), W. Seeliger, et al., *Angew. Chem. Int. Ed. Engl.*, Vol. 5, p. 875 (1966), S. Kobayashi, et al., *Poly.*

*Bull.*, Vol. 13, p. 447 (1985), and Y. Chujo, et al., *Macromolecules*, Vol. 22, p. 1074 (1989).

Photo living polymerization reactions using a dithiocarbamate compound or a xanthate compound, as an initiator are described, for example, in Takayuki Otsu, *Kobunshi*, Vol. 37, p. 248 (1988), Shun-ichi Himori and Koichi Otsu, *Polymer Rep. Jap.*, Vol. 37, p. 3508 (1988), JP-A-64-111, JP-A-64-26619, and M. Niwa, *Macromolecules*, Vol. 189, p. 2187 (1988).

Radical polymerization reactions using a polymer containing an azo group or a peroxide group as an initiator to synthesize block copolymers are described, for example, in Akira Ueda, et al., *Kobunshi Ronbunshu*, Vol. 33, p. 931 (1976), Akira Ueda, *Osaka Shiritsu Kogyo Kenkyusho Hokoku*, Vol. 84 (1989), O. Nuyken, et al., *Macromol. Chem., Rapid. Commun.*, Vol. 9, p. 671 (1988), and Ryohei Oda, *Kagaku to Kogyo*, Vol. 61, p. 43 (1987).

Syntheses of graft type block copolymers are described in the above-cited literature references and, in addition, Fumio Ide, *Graft Jugo to Sono Oyo*, Kobunshi Kankokai (1977), and Kobunshi Gakkai (ed.), *Polymer Alloy*, Tokyo Kagaku Dojin (1981). For example, known grafting techniques including a method of grafting of a polymer chain by a polymerization initiator, an actinic ray (e.g., radiant ray, electron beam), or a mechanochemical reaction; a method of grafting with chemical bonding between functional groups of polymer chains (reaction between polymers); and a method of grafting comprising a polymerization reaction of a macromonomer may be employed.

The methods of grafting using a polymer are described, for example, in T. Shiota, et al., *J. Appl. Polym. Sci.*, Vol. 13, p. 2447 (1969), W. H. Buck, *Rubber Chemistry and Technology*, Vol. 50, p. 109 (1976), Tsuyoshi Endo and Tsutomu Uezawa, *Nippon Secchaku Kyokaishi*, Vol. 24, p. 323 (1988), and Tsuyoshi Endo, ibid., Vol. 25, p. 409 (1989).

The methods of grafting using a macromonomer are described, for example, in P. Dreyfuss and R. P. Quirk, *Encycl. Polym. Sci. Eng.*, Vol. 7, p. 551 (1987), P. F. Rempp and E. Franta, *Adv. Polym. Sci.*, Vol. 58, p. 1 (1984), V. Percec, *Appl. Poly. Sci.*, Vol. 285, p. 95 (1984), R. Asami and M. Takari, *Macromol. Chem. Suppl.*, Vol. 12, p. 163 (1985), P. Rempp, et al., *Macromol. Chem. Suppl.*, Vol. 8, p. 3 (1985), Katsusuke Kawakami, *Kagaku Kogyo*, Vol. 38, p. 56 (1987), Yuya Yamashita, *Kobunshi*, Vol. 31, p. 988 (1982), Shiro Kobayashi, *Kobunshi*, Vol. 30, p. 625 (1981), Toshinobu Higashimura, *Nippon Secchaku Kyokaishi*, Vol. 18, p. 536 (1982), Koichi Itoh, *Kobunshi Kako*, Vol. 35, p. 262 (1986), Takashiro Azuma and Takashi Tsuda, *Kino Zairyo*, Vol. 1987, No. 10, p. 5, Yuya Yamashita (ed.), *Macromonomer no Kagaku to Kogyo*, I.P.C. (1989), Tsuyoshi Endo (ed.), *Atarashii Kinosei Kobunshi no Bunshi Sekkei*, Ch. 4, C.M.C. (1991), and Y. Yamashita, et al., *Polym. Bull.*, Vol. 5, p. 361 (1981).

Syntheses of starlike block copolymers are described, for example, in M. T. Reetz, *Angew. Chem. Int. Ed. Engl.*, Vol. 27, p. 1373 (1988), M. Sgwarc, *Carbanions, Living Polymers and Electron Transfer Processes*, Wiley (New York) (1968), B. Gordon, et al., *Polym. Bull.*, Vol. 11, p. 349 (1984), R. B. Bates, et al., *J. Org. Chem.*, Vol. 44, p. 3800 (1979), Y. Sogah, *A.C.S. Polym. Rapr.*, Vol. 1988, No. 2, p. 3, J. W. Mays, *Polym. Bull.*, Vol. 23, p. 247 (1990), I. M. Khan et al., *Macromolecules*, Vol. 21, p. 2684 (1988), A. Morikawa, *Macromolecules*, Vol. 24, p. 3469 (1991), Akira Ueda and Toru Nagai, *Kobunshi*, Vol. 39, p. 202 (1990), and T. Otsu, *Polymer Bull.*, Vol. 11, p. 135 (1984).

While reference can be made to known techniques described in the literatures cited above, the method for synthesizing the block copolymers of the compound (S) according to the present invention should not be limited to these methods.

Now, the transfer layer which can be used in the present invention will be described in greater detail below.

The transfer layer of the present invention is a layer having a function of being transferred from the releasing surface of electrophotographic light-sensitive element to a receiving material which provides a support for a printing plate and of being removed upon a chemical reaction treatment to prepare a printing plate.

The transfer layer of the present invention is radiation-transmittive. Specifically, it is a layer capable of transmitting a radiation having a wavelength which constitutes at least one part of the spectrally sensitive region of electrophotographic light-sensitive element. The layer may be colored.

The transfer layer is preferred to be transferred under conditions of temperature of not more than 180° C. and/or pressure of not more than 30 Kgf/cm$^2$, more preferably under conditions of temperature of not more than 160° C. and/or pressure of not more than 20 Kgf/cm$^2$. When the transfer conditions exceed the above-described limit, a large-sized apparatus may be necessary in order to maintain the heat capacity and pressure sufficient for release of the transfer layer from the surface of electrophotographic light-sensitive element and transfer to a receiving material, and a transfer speed becomes very slow. The lower limit of transfer conditions is preferably not less than room temperature and/or pressure of not less than 0.1 Kgf/cm$^2$.

The the resin (A) constituting the transfer layer of the present invention is a resin which is thermoplastic and capable of being removed upon a chemical reaction treatment.

With respect to thermal property of the resin (A), a glass transition point thereof is preferably not more than 140° C., more preferably not more than 100° C., or a softening point thereof is preferably not more than 180° C., more preferably not more than 150° C.

The term "resin capable of being removed upon a chemical reaction treatment" means and includes a resin which is dissolved and/or swollen upon a chemical reaction treatment to remove and a resin which is rendered hydrophilic upon a chemical reaction treatment and as a result, dissolved and/or swollen to remove.

One representative example of the resin (A) capable of being removed upon a chemical reaction treatment used in the transfer layer according to the present invention is a resin which can be removed with an alkaline processing solution. Particularly useful resins of the resins capable of being removed with an alkaline processing solution include polymers comprising a polymer component containing at least one polar group selected from a —$CO_2H$ group, a —CHO group, —$SO_3H$ group, a —$SO_2H$ group, a —P(=O)(OH)$R^1$ group (wherein $R^1$ represents a —OH group, a hydrocarbon group or a —$OR^2$ group (wherein $R^2$ represents a hydrocarbon group)), a phenolic hydroxy group, a cyclic acid anhydride-containing group, a —CONHCO$R^3$ group (wherein $R^3$ represents a hydrocarbon group) and a —CONH$SO_2R^3$ group. The polymer component containing the polar group is referred to as polymer component (a) hereinafter, sometimes.

The —P(=O)(OH)$R^1$ group denotes a group having the following formula:

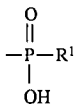

The hydrocarbon group represented by $R^1$, $R^2$ or $R^3$ preferably includes an aliphatic group having from 1 to 12 carbon atoms which may be substituted (e.g., methyl, ethyl, propyl, butyl, hexyl, octyl, decyl, dodecyl, 2-chloroethyl, 2-methoxyethyl, 3-ethoxypropyl, allyl, crotonyl, butenyl, cyclohexyl, benzyl, phenethyl, 3-phenylpropyl, methylbenzyl, chlorobenzyl, fluorobenzyl, and methoxybenzyl) and an aryl group which may be substituted (e.g., phenyl, tolyl, ethylphenyl, propylmethylphenyl, dichlorophenyl, methoxyphenyl, cyanophenyl, acetamidophenyl, acetylphenyl and butoxyphenyl).

The cyclic acid anhydride-containing group is a group containing at least one cyclic acid anhydride. The cyclic acid anhydride to be contained includes an aliphatic dicarboxylic acid anhydride and an aromatic dicarboxylic acid anhydride.

Specific examples of the aliphatic dicarboxylic acid anhydrides include succinic anhydride ring, glutaconic anhydride ring, maleic anhydride ring, cyclopentane-1,2-dicarboxylic acid anhydride ring, cyclohexane-1,2-dicarboxylic acid anhydride ring, cyclohexene-1,2-dicarboxylic acid anhydride ring, and 2,3-bicyclo[2,2,2]octanedicarboxylic acid anhydride. These rings may be substituted with, for example, a halogen atom (e.g., chlorine and bromine) and an alkyl group (e.g., methyl, ethyl, butyl, and hexyl).

Specific examples of the aromatic dicarboxylic acid anhydrides include phthalic anhydride ring, naphthalenedicarboxylic acid anhydride ring, pyridinedialenedicarboxylic acid anhydride ring and thiophenedicarboxylic acid anhydride ring. These rings may be substituted with, for example, a halogen atom (e.g., chlorine and bromine), an alkyl group (e.g., methyl, ethyl, propyl, and butyl), a hydroxyl group, a cyano group, a nitro group, and an alkoxycarbonyl group (e.g., a methoxy group and an ethoxy group as an alkoxy group).

The polymer component (a) containing the above-described specific polar group present in the resin (A) should not be particularly limited. For instance, the above-described polymer component containing the specific polar group used in the resin (A) may be any of vinyl compounds each having the polar group. Such vinyl compounds are described, for example, in *Kobunshi Data Handbook* (*Kiso-hen*), edited by Kobunshi Gakkai, Baifukan (1986). Specific examples of the vinyl compound are acrylic acid, α- and/or β-substituted acrylic acid (e.g., α-acetoxy compound, α-acetoxymethyl compound, α-(2-amino)methyl compound, α-chloro compound, α-bromo compound, α-fluoro compound, α-tributylsilyl compound, α-cyano compound, β-chloro compound, β-bromo compound, α-chloro-β-methoxy compound, and α,β-dichloro compound), methacrylic acid, itaconic acid, itaconic acid half esters, itaconic acid half amides, crotonic acid, 2-alkenylcarboxylic acids (e.g., 2-pentenoic acid, 2-methyl-2-hexenoic acid, 2-octenoic acid, 4-methyl-2-hexenoic acid, and 4-ethyl-2-octenoic acid), maleic acid, maleic acid half esters, maleic acid half amides, vinylbenzenecarboxylic acid, vinylbenzenesulfonic acid, vinylsulfonic acid, vinylphosphonic acid, half ester derivatives of the vinyl group or allyl group of di-carboxylic acids, and ester derivatives or amide derivatives of these carboxylic acids or sulfonic acids having the above-described polar group in the substituent thereof.

Specific examples of the polymer components (a) containing the specific polar group are set forth below, but the present invention should not be construed as being limited thereto In the following formulae, $R^4$ represents —H or —$CH_3$; $R^5$ represents —H, —$CH_3$ or —$CH_2COOCH_3$; $R^6$ represents an alkyl group having from 1 to 4 carbon atoms; $R^7$ represents an alkyl group having from 1 to 6 carbon atoms, a benzyl group or a phenyl group; e represents an integer of 1 or 2; f represents an integer of from 1 to 3; g represents an integer of from 2 to 11; h represents an integer of from 1 to 11; and i represents an integer of from 2 to 4; and j represents an integer of from 2 to 10.

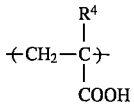
(a-1)

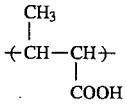
(a-2)

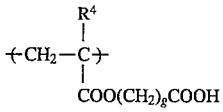
(a-3)

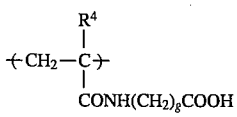
(a-4)

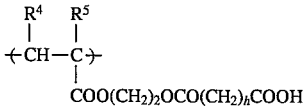
(a-5)

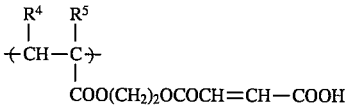
(a-6)

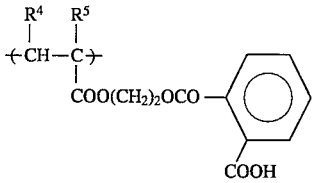
(a-7)

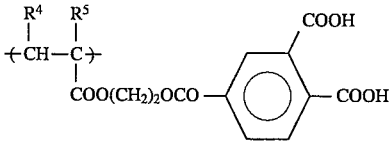
(a-8)

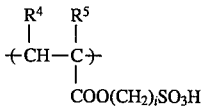
(a-9)

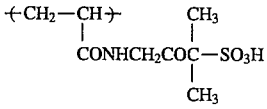
(a-10)

-continued
(a-11)
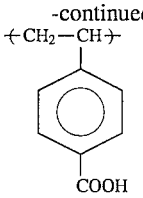
(a-12)
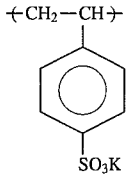
(a-13)
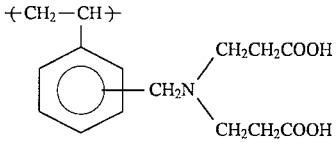
(a-14)
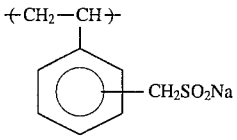
(a-15)
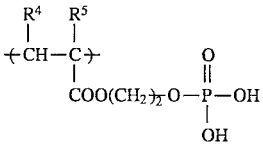
(a-16)
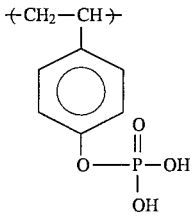
(a-17)
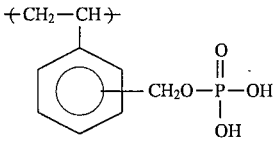
(a-18)
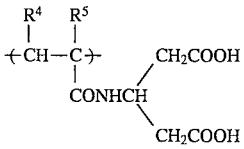
(a-19)
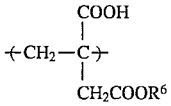
(a-20)
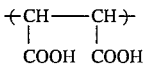
(a-21)
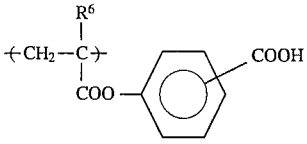
-continued
(a-22)
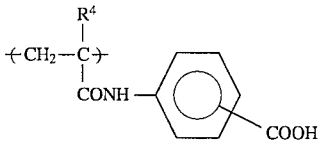
(a-23)
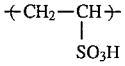
(a-24)
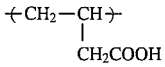
(a-25)
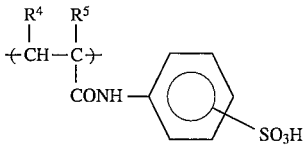
(a-26)
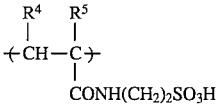
(a-27)
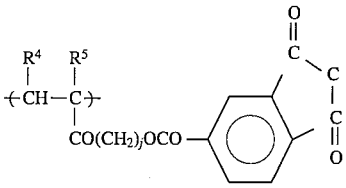
(a-28)
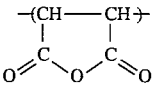
(a-29)
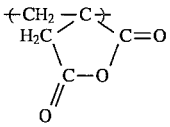
(a-30)
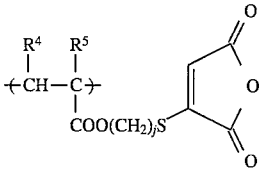
(a-31)
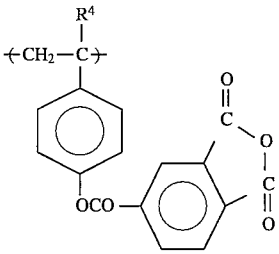
(a-32)
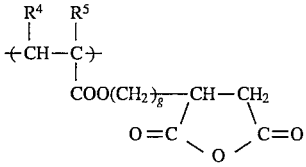

-continued
(a-33)
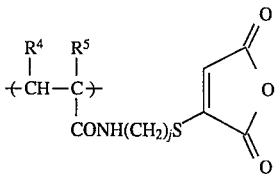
(a-34)
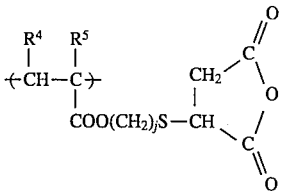
(a-35)
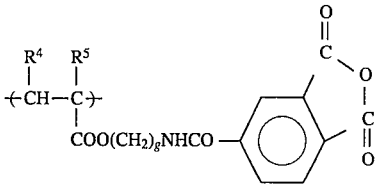
(a-36)
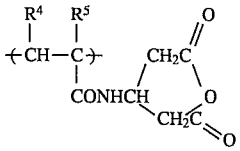
(a-37)
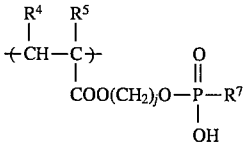
(a-38)
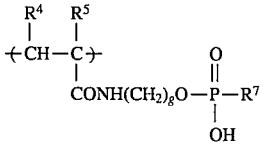
(a-39)
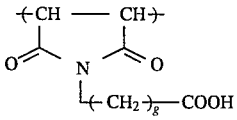
(a-40)
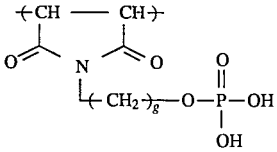
(a-41)
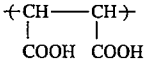
(a-42)
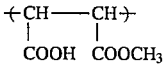
(a-43)
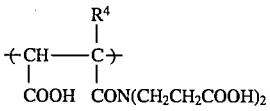
-continued
(a-44)
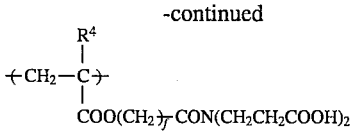
(a-45)
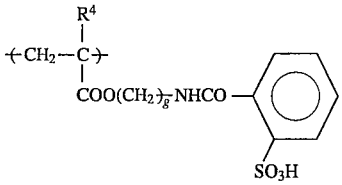
(a-46)
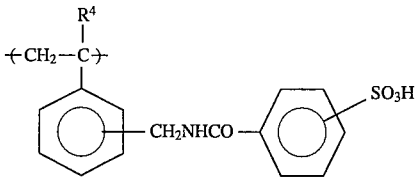
(a-47)
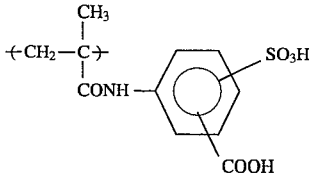
(a-48)
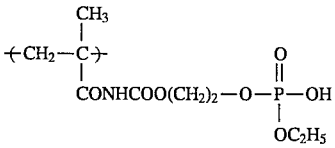
(a-49)
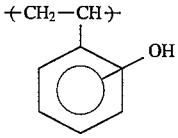
(a-50)
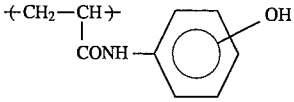
(a-51)
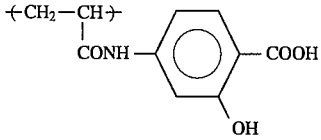
(a-52)
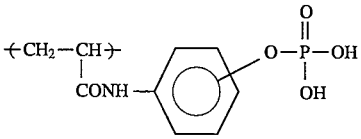
(a-53)
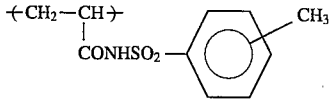
(a-54)
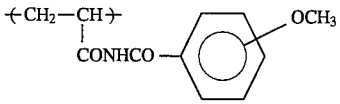
(a-55)
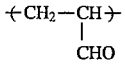

-continued

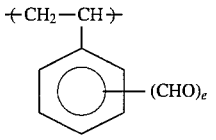

(a-56)

Another representative example of the resin (A) capable of being removed upon the chemical reaction treatment used in the transfer layer according to the present invention is a resin which has a hydrophilic group protected by a protective group and is capable of forming the hydrophilic group upon a chemical reaction.

The chemical reaction for converting the protected hydrophilic group to a hydrophilic group includes a reaction for rendering hydrophilic with a processing solution utilizing a conventionally known reaction, for example, hydrolysis, hydrogenolysis, oxygenation, β-release, and nucleophilic substitution, and a reaction for rendering hydrophilic by a decomposition reaction induced by exposure of actinic radiation.

Particularly useful resins of the resins capable of being rendered hydrophilic upon the chemical reaction treatment includes polymers comprising, a polymer component containing at least one functional group capable of forming at least one hydrophilic group selected from a $—CO_2H$ group, a —CHO group, a $-SO_3H$ group, a $—SO_2H$ group, a $—PO_3H_2$ group and a —OH group upon a chemical reaction.

The polymer component containing the functional group capable of forming a hydrophilic group is referred to as polymer component (b) hereinafter, sometimes.

Now, the functional group capable of forming at least one hydrophilic group upon the chemical reaction which can be used in the present invention will be described in greater detail below.

The number of hydrophilic groups formed from one functional group capable of forming a hydrophilic group upon the chemical reaction may be one, two or more.

Now, a functional group capable of forming at least one carboxyl group upon the chemical reaction will be described below.

According to one preferred embodiment of the present invention, a carboxy group-forming functional group is represented by the following general formula (F-I):

$$—COO—L^1 \qquad \text{(F-I)}$$

wherein $L^1$ represents

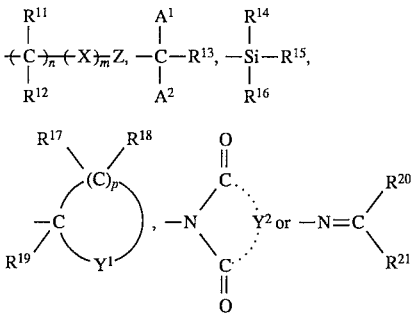

wherein $R^{11}$ and $R^{12}$ which may be the same or different, each represent a hydrogen atom or a hydrocarbon group; X represents an aromatic group; Z represents a hydrogen atom, a halogen atom, a trihalomethyl group, an alkyl group, a cyano group, a nitro group $—SO_2—Z^1$ (wherein $Z^1$ represents a hydrocarbon group), $—COO—Z^2$ (wherein $Z^2$ represents a hydrocarbon group), $—O—Z^3$ (wherein $Z^3$ represents a hydrocarbon group), or $—CO—Z^4$ (wherein $Z^4$ represents a hydrocarbon group); n and m each represent 0, 1 or 2, provided that when both n and m are 0, Z is not a hydrogen atom; $A^1$ and $A^2$, which may be the same or different, each represent an electron attracting group having a positive Hammett's σ value; $R^{13}$ represents a hydrogen atom or a hydrocarbon group; $R^{14}$, $R^{15}$, $R^{16}$, $R^{20}$ and $R^{21}$, which may be the same or different, each represent a hydrocarbon group or $—O—Z^5$ (wherein $Z^5$ represents a hydrocarbon group); $Y^1$ represents an oxygen atom or a sulfur atom; $R^{17}$, $R^{18}$, and $R^{19}$, which may be the same or different, each represent a hydrogen atom, a hydrocarbon group or $—O—Z^7$ (wherein $Z^7$ represents a hydrocarbon group); p represents an integer of 3 or 4; $Y^2$ represents an organic residue for forming a cyclic imido group.

In more detail, $R^{11}$ and $R^{12}$, which may be the same or different, each preferably represents a hydrogen atom or a straight chain or branched chain alkyl group having from 1 to 12 carbon atoms which may be substituted (e.g., methyl, ethyl, propyl, chloromethyl, dichloromethyl, trichloromethyl, trifluoromethyl, butyl, hexyl, octyl, decyl, hydroxyethyl, or 3-chloropropyl). X preferably represents a phenyl or naphthyl group which may be substituted (e.g., phenyl, methylphenyl, chlorophenyl, dimethylphenyl, chloromethylphenyl, or napthyl). Z preferably represents a hydrogen atom, a halogen atom (e.g., chlorine or fluorine), a trihalomethyl group (e.g., trichloromethyl or trifluoromethyl), a straight chain or branched chain alkyl group having from 1 to 12 carbon atoms which may be substituted (e.g., methyl, chloromethyl, dichloromethyl, ethyl, propyl, butyl, hexyl, tetrafluoroethyl, octyl, cyanoethyl, or chloroethyl), a cyano group, a nitro group, $—SO_2—Z^1$ (wherein $Z^1$ represents a hydrocarbon group, preferably an aliphatic group (for example an alkyl group having from 1 to 12 carbon atoms which may be substituted (e.g., methyl, ethyl, propyl, butyl, chloroethyl, pentyl, or octyl) or an aralkyl group having from 7 to 12 carbon atoms which may be substituted (e.g., benzyl, phenethyl, chlorobenzyl, methoxybenzyl, chlorophenethyl, or methylphenethyl)), or an aromatic group (for example, a phenyl or naphthyl group which may be substituted (e.g., phenyl, chlorophenyl, dichlorophenyl, methylphenyl, methoxyphenyl, acetylphenyl, acetamidophenyl, methoxycarbonylphenyl, or naphthyl)), $—COO—Z^2$ (wherein $Z^2$ has the same meaning as $Z^1$ above), $—O—Z^3$ (wherein $Z^3$ has the same meaning as $Z^1$ above), or $—CO—Z^4$ (wherein $Z^4$ has the same meaning as $Z^1$ above). n and m each represent 0, 1 or 2, provided that when both n and m are 0, Z is not a hydrogen atom.

$R^{14}$, $R^{15}$, and $R^{16}$, and $R^{20}$ and $R^{21}$, which may be the same or different, each preferably represent an aliphatic group having 1 to 18 carbon atoms which may be substituted (wherein the aliphatic group includes an alkyl group, an alkenyl group, an aralkyl group, and an alicyclic group, and the substituent therefor includes a halogen atom, a cyano group, a hydroxy group, and $—O—Z^6$ (wherein $Z^6$ represents an alkyl group, an aralkyl group, an alicyclic group, or an aryl group)), an aromatic group having from 6 to 18 carbon atoms which may be substituted (e.g., phenyl, tolyl, chlorophenyl, methoxyphenyl, acetamidophenyl, or naphthyl), or $—O—Z^5$ (wherein $Z^5$ represents a hydrocarbon group, preferably an alkyl group having from 1 to 12 carbon atoms which may be substituted, an alkenyl group having from 2 to 12 carbon atoms which may be substituted, an aralkyl group having from 7 to 12 carbon atoms which may be substituted, an alicyclic group having from 5 to 18 carbon atoms which may be substituted, or an aryl group having from 6 to 18 carbon atoms which may be substituted).

$A^1$ and $A^2$ may be the same or a different, at least one of $A^1$ and $A^2$ represents an electron attracting group, with the sum of their Hammett's $\sigma_p$ values being 0.45 or more. Examples of the electron attracting group for $A^1$ or $A^2$ include an acyl group, an aroyl group, a formyl group, an alkoxycarbonyl group, a phenoxycarbonyl group, an alkylsulfonyl group, an aroylsulfonyl group, a nitro group, a cyano group, a halogen atom, a halogenated alkyl group, and a carbamoyl group.

A Hammett's $\sigma_p$ value is generally used as an index for estimating the degree of electron attracting or donating property of a substituent. The greater the positive value, the higher the electron attracting property. Hammett's $\sigma$ values of various substituents are described, e.g., in Naoki Inamoto, *Hammett Soku-Kozo to Han-nosei*, Maruzen (1984).

It seems that an additivity rule applies to the Hammett's $\sigma_p$ values in this system so that both of $A^1$ and $A^2$ need not be electron attracting groups. Therefore, where one of them is an electron attracting group, the other may be any group selected without particular limitation as far as the sum of their $\sigma_p$ values is 0.45 or more.

$R^{13}$ preferably represents a hydrogen atom or a hydrocarbon group having from 1 to 8 carbon atoms which may be substituted, e.g., methyl, ethyl, propyl, butyl, pentyl, hexyl, octyl, allyl, benzyl, phenethyl, 2-hydroxyethyl, 2-methoxyethyl, 2-ethoxyethyl, 3-methoxypropyl, or 2-chloroethyl.

$Y^1$ represents an oxygen atom or a sulfur atom. $R^{17}$, $R^{18}$, and $R^{19}$, which may be the same or different, each preferably represents a hydrogen atom, a straight chain or branched chain alkyl group having from 1 to 18 carbon atoms which may be substituted (e.g., methyl, ethyl, propyl, butyl, hexyl, octyl, decyl, dodecyl, octadecyl, chloroethyl, methoxyethyl, or methoxypropyl), an alicyclic group which may be substituted (e.g., cyclopentyl or cyclohexyl), an aralkyl group having from 7 to 12 carbon atoms which may be substituted (e.g., benzyl, phenethyl, chlorobenzyl, or methoxybenzyl), an aromatic group which may be substituted (e.g., phenyl, naphthyl, chlorophenyl, tolyl, methoxyphenyl, methoxycarbonylphenyl, or dichlorophenyl), or —O—$Z^7$ (wherein $Z^7$ represents a hydrocarbon group and specifically the same hydrocarbon group as described for $R^{17}$, $R^{18}$, or $R^{19}$). p represents an integer of 3 or 4.

$Y^2$ represents an organic residue for forming a cyclic imido group, and preferably represents an organic residue represented by the following general formula (A) or (B):

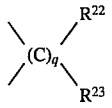

(A)

wherein $R^{22}$ and $R^{23}$, which may be the same or different, each represent a hydrogen atom, a halogen atom (e.g., chlorine or bromine), an alkyl group having from 1 to 18 carbon atoms which may be substituted (e.g., methyl, ethyl, propyl, butyl, hexyl, octyl, decyl, dodecyl, hexadecyl, octadecyl, 2-chloroethyl, 2-methoxyethyl, 2-cyanoethyl, 3-chloropropyl, 2-(methanesulfonyl)ethyl, or 2-(ethoxymethoxy-)ethyl), an aralkyl group having from 7 to 12 carbon atoms which may be substituted (e.g., benzyl, phenethyl, 3-phenylpropyl, methylbenzyl, dimethylbenzyl, methoxybenzyl, chlorobenzyl, or bromobenzyl), an alkenyl group having from 3 to 18 carbon atoms which may be substituted (e.g., allyl, 3-methyl-2-propenyl, 2-hexenyl, 4-propyl-2-pentenyl, or 12-octadecenyl), —S—$Z^8$ (wherein $Z^8$ represents an alkyl, aralkyl or alkenyl group having the same meaning as $R^{22}$ or $R^{23}$ described above or an aryl group which may be substituted (e.g., phenyl, tolyl, chlorophenyl, bromophenyl, methoxyphenyl, ethoxyphenyl, or ethoxycarbonylphenyl)) or —NH—$Z^9$ (wherein $Z^9$ has the same meaning as $Z^8$ described above). Alternatively, $R^{22}$ and $R^{23}$ may be taken together to form a ring, such as a 5- or 6-membered monocyclic ring (e.g., cyclopentane or cyclohexane) or a 5- or 6-membered bicyclic ring (e.g., bicyclopentane, bicycloheptane, bicycloheptene, bicyclooctane, or bicyclooctene). The ring may be substituted. The substituent includes those described for $R^{22}$ or $R^{23}$. q represents an integer of 2 or 3.

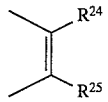

(B)

wherein $R^{24}$ and $R^{25}$, which may be the same or different, each have the same meaning as $R^{22}$ or $R^{23}$ described above. Alternatively, $R^{24}$ and $R^{25}$ may be taken together to form an aromatic ring (e.g., benzene or naphthalene).

According to another preferred embodiment of the present invention, the carboxyl group-forming functional group is a group containing an oxazolone ring represented by the following general formula (F-II):

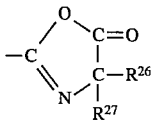

(F-II)

wherein $R^{26}$ and $R^{27}$, which may be the same or different, each represent a hydrogen atom or a hydrocarbon group, or $R^{26}$ and $R^{27}$ may be taken together to form a ring.

In the general formula (F-II), $R^{26}$ and $R^{27}$ each preferably represents a hydrogen atom, a straight chain or branched chain alkyl group having from 1 to 12 carbon atoms which may be substituted (e.g., methyl, ethyl, propyl, butyl, hexyl, 2-chloroethyl, 2-methoxyethyl, 2-methoxycarbonylethyl, or 3-hydroxypropyl), an aralkyl group having from 7 to 12 carbon atoms which may be substituted (e.g., benzyl, 4-chlorobenzyl, 4-acetamidobenzyl, phenethyl, or 4-methoxybenzyl), an alkenyl group having from 2 to 12 carbon atoms which may be substituted (e.g., vinyl, allyl, isopropenyl, butenyl, or hexenyl), a 5- to 7-membered alicyclic group which may be substituted (e.g., cyclopentyl, cyclohexyl, or chlorocyclohexyl), or an aromatic group which may be substituted (e.g., phenyl, chlorophenyl, methoxyphenyl, acetamidophenyl, methylphenyl, dichlorophenyl, nitrophenyl, naphthyl, butylphenyl, or dimethylphenyl). Alternatively, $R^{26}$ and $R^{27}$ may be taken together to form a 4- to 7-membered ring (e.g., tetramethylene, pentamethylene, or hexamethylene).

A functional group capable of forming at least one sulfo group upon the chemical reaction includes a functional group represented by the following general formula (F-III) or (F-IV):

$$-SO_2-O-L^2 \quad \text{(F-III)}$$

$$-SO_2-S-L^2 \quad \text{(F-IV)}$$

wherein $L^2$ represents

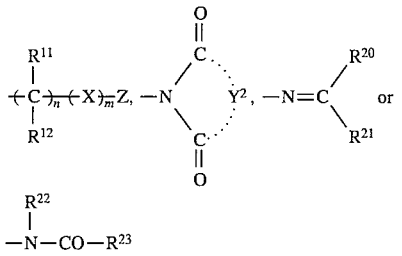

wherein $R^{11}$, $R^{12}$, X, Z, n, m, $Y^2$, $R^{20}$, $R^{21}$, $R^{22}$ and $R^{23}$ each has the same meaning as defined above.

A functional group capable of forming at least one sulfinic acid group upon the chemical reaction includes a functional group represented by the following general formula (F-V):

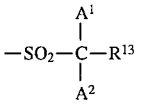

(F-V)

wherein $A^1$, $A^2$ and $R^{13}$ each has the same meaning as defined above.

A functional group capable of forming at least one $—PO_3H_2$ group upon the chemical reaction includes a functional group represented by the following general formula (F-VI):

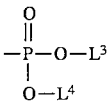

(VI)

wherein $L^3$ and $L^4$, which may be the same or different, each has the same meaning as $L^1$ described above.

One preferred embodiment of functional groups capable of forming at least one hydroxyl group upon the chemical reaction includes a functional group represented by the following general formula (F-VII):

(F-VII)

wherein $L^5$ represents

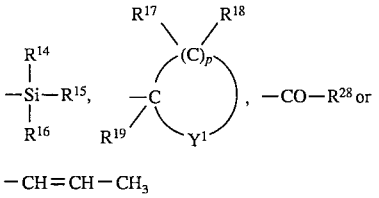

wherein $R^{14}$, $R^{15}$, $R^{16}$, $R^{17}$, $R^{18}$, $R^{19}$, $Y^1$ and p each has the same meaning as defined above; and $R^{28}$ represents a hydrocarbon group, and specifically the same hydrocarbon group as described for $R^{11}$.

Another preferred embodiment of functional groups capable of forming at least one hydroxyl group upon the chemical reaction includes a functional group wherein at least two hydroxyl groups which are sterically close to each other are protected with one protective group. Such hydroxyl group-forming functional groups are represented, for example, by the following general formulae (F-VIII), (F-IX) and (F-X):

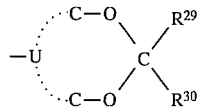

(F-VIII)

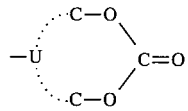

(F-IX)

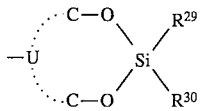

(F-X)

wherein $R^{29}$ and $R^{30}$, which may be the same or different, each represents a hydrogen atom, a hydrocarbon group, or $—O—Z^{10}$ (wherein $Z^{10}$ represents a hydrocarbon group); and U represents a carbon-to-carbon bond which may contain a hetero atom, provided that the number of atoms present between the two oxygen atoms is 5 or less.

More specifically, $R^{29}$ and $R^{30}$, which may be the same as different, each preferably represents a hydrogen atom, an alkyl group having from 1 to 12 carbon atoms which may be substituted (e.g., methyl, ethyl, propyl, butyl, hexyl, 2-methoxyethyl, or octyl), an aralkyl group having from 7 to 9 carbon atoms which may be substituted (e.g., benzyl, phenethyl, methylbenzyl, methoxybenzyl, or chlorobenzyl), an alicyclic group having from 5 to 7 carbon atoms (e.g., cyclopentyl or cyclohexyl), an aryl group which may be substituted (e.g., phenyl, chlorophenyl, methoxyphenyl, methylphenyl, or cyanophenyl), or $—OZ^{10}$ (wherein $Z^{10}$ represents a hydrocarbon group, and specifically the same hydrocarbon group as described for $R^{29}$ or $R^{30}$), and U represents a carbon-to-carbon bond which may contain a hetero atom, provided that the number of atoms present between the two oxygen atoms is 5 or less.

Specific examples of the functional groups represented by the general formulae (F-I) to (F-X) described above are set forth below, but the present invention should not be construed as being limited thereto. In the following formulae (b-1) through (b-67), the symbols used have the following meanings respectively:

$W_1$: —CO—, $—SO_2—$, or

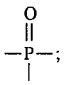

$W_2$: —CO— or $—SO_2—$;

$Q^1$: $—C_nH_{2n+1}$ (n: an integer of from 1 to 8),

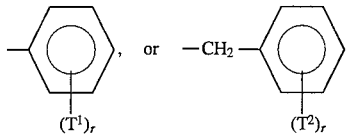

$T^1$, $T^2$: —H, $—C_nH_{2n+1}$, $—OC_nH_{2n+1}$, —CN, $—NO_2$, —Cl, —Br, $—COOC_nH_{2n+1}$, $—NHCO—C_nH_{2n+1}$, or $—COC_nH_{2n+1}$;

r: an integer of from 1 to 5;

$Q^2$: $—C_nH_{2n+1}$, $—CH_2C_6H_5$, or $—C_6H_5$;

$Q^3$: $—C_mH_{2m+1}$ (m: an integer of from 1 to 4) or $—CH_2C_6H_5$;

$Q^4$: —H , —$CH_3$, or —$OCH_3$;
$Q^5$, $Q^6$: —H, —$CH_3$, —$OCH_3$, —$C_6H_5$, or —$CH_2C_6H_5$;
G: —O— or —S—; and
J: —Cl or —Br
$-W_1-O-(CH_2)_2COQ^1$ (b-1)
$-W_1-O-C(CH_3)_2-CH_2COQ^1$ (b-2)
$-W_1-O(CH_2)_2COOQ^1$ (b-3)
$-W_1-O(CH_2)_2SO_2Q^1$ (b-4)
$-W_1-O(CH_2)_2CN$ (b-5)
$-W_1-O(CH_2)_2NO_2$ (b-6)
$-W_1-OCH(Q^2)CH_2COQ^1$ (b-7)
$-W_1-O-CH_2CH(Q^2)COQ^1$ (b-8)
$-W_1-OCH(Q^2)CH(Q^2)COQ^1$ (b-9)
$-W_1-O-C(CH_3)_2CH_2SO_2Q^1$ (b-10)
$-W_1-O-C(COCH_3)(Q^3)(COOQ^1)$ (b-11)
$-W_1-O-C(COOQ^1)(Q^3)(COOQ^1)$ (b-12)
$-W_1-O-C(CN)(Q^3)(CN)$ (b-13)
$-W_1-O-C(COQ^1)(Q^3)(COQ^1)$ (b-14)
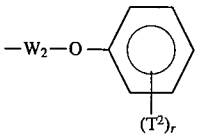
(b-15)
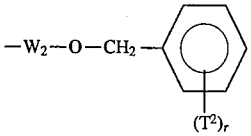
(b-16)
-continued
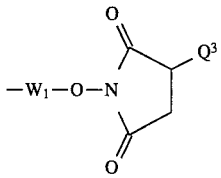
(b-17)
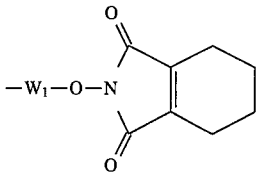
(b-18)
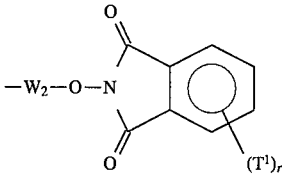
(b-19)
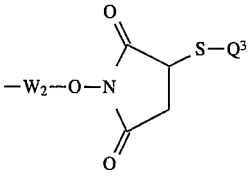
(b-20)
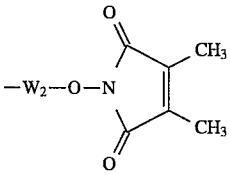
(b-21)
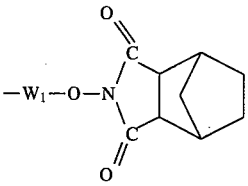
(b-22)
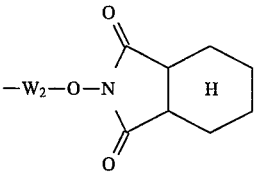
(b-23)
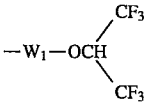
(b-24)
$-W_1-O-CH_2CF_3$ (b-25)
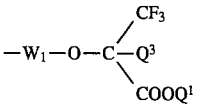
(b-26)
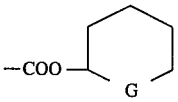
(b-27)

-continued
(b-28)
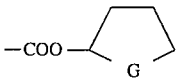
(b-29)
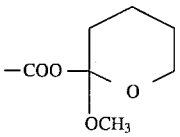
(b-30)
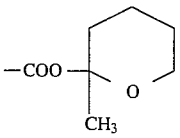
(b-31) $-COOSi(C_3H_7)_3$
(b-32)
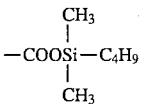
(b-33)
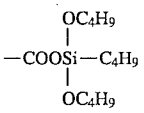
(b-34)
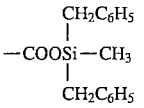
(b-35) $-SO_3-CH_2COQ^1$
(b-36) $-SO_3CH_2COOQ^1$
(b-37) $-SO_3(CH_2)_2J$
(b-38)
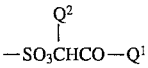
(b-39)
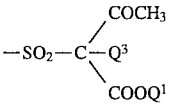
(b-40)
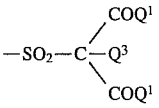
(b-41)
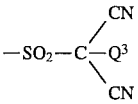
(b-42)
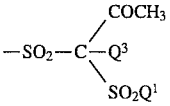
(b-43)
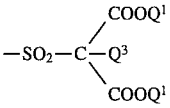
(b-44)
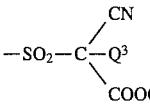
-continued
(b-45)
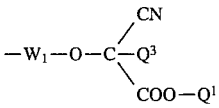
(b-46)
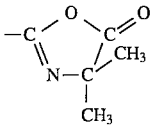
(b-47)
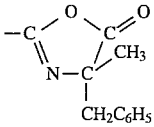
(b-48)
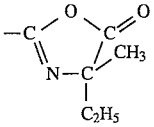
(b-49)
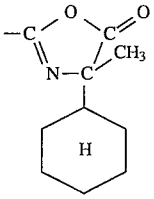
(b-50)
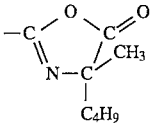
(b-51)
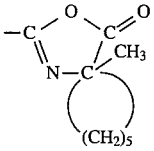
(b-52)
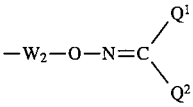
(b-53)
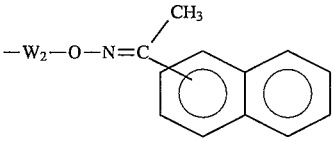
(b-54)
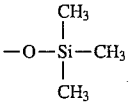
(b-55)
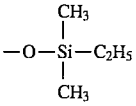
(b-56)
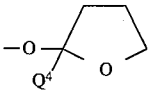

-continued (b-57)

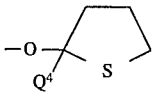

(b-58)

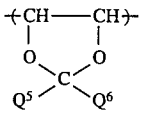

(b-59)

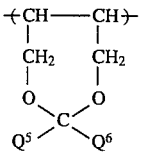

(b-60)

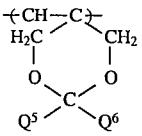

(b-61)

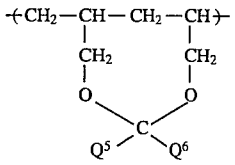

(b-62)

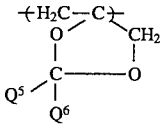

(b-63)

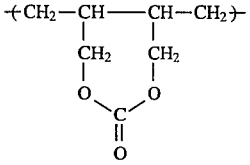

(b-64)

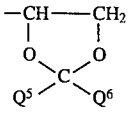

(b-65)

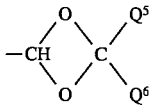

(b-66)

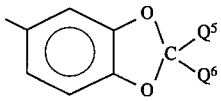

(b-67)

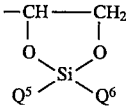

The polymer component (b) which contains the functional group capable of forming at least one hydrophilic group selected from —COOH, —CHO, —$SO_3H$, —$SO_2H$, —$PO_3H_2$ and —OH upon the chemical reaction which can be used in the present invention is not particularly limited. Specific examples thereof include polymer components obtaining by protecting the polar group in the polymer components (a) described above.

The above-described functional group capable of forming at least one hydrophilic group selected from —COOH, —CHO, —$SO_3H$, —$SO_2H$, —$PO_3H_2$, and —OH upon the chemical reaction used in the present invention is a functional group in which such a hydrophilic group is protected with a protective group. Introduction of the protective group into a hydrophilic group by a chemical bond can easily be carried out according to conventionally known methods. For example, the reactions as described in J. F. W. McOmie, *Protective Groups in Organic Chemistry*, Plenum Press (1973), T. W. Greene, *Protective Groups in Organic Synthesis*, Wiley-Interscience (1981), Nippon Kagakukai (ed.), *Shin Jikken Kagaku Koza*, Vol. 14, "Yuki Kagobutsu no Gosei to Han-no", Maruzen (1978), and Yoshio Iwakura and Keisuke Kurita, *Han-nosei Kobunshi*, Kodansha can be employed.

In order to introduce the functional group which can be used in the present invention into a resin, a process using a so-called polymer reaction in which a polymer containing at least one hydrophilic group selected from —COOH, —CHO, —$SO_3H$, —$SO_2H$, —$PO_3H_2$, and —OH is reacted to convert its hydrophilic group to a protected hydrophilic group or a process comprising synthesizing at least one monomer containing at least one of the functional groups, for example, those represented by the general formulae (F-I) to (F-X) and then polymerizing the monomer or copolymerizing the monomer with any appropriate other copolymerizable monomer(s) is used.

The latter process (comprising preparing the desired monomer and then conducting polymerization reaction) is preferred for reasons that the amount or kind of the functional group to be incorporated into the polymer can be appropriately controlled and that incorporation of impurities can be avoided (in case of the polymer reaction process, a catalyst to be used or by-products are mixed in the polymer).

For example, a resin containing a carboxyl group-forming functional group may be prepared by converting a carboxyl group of a carboxylic acid containing a polymerizable double bond or a halide thereof to a functional group represented by the general formula (F-I) by the method as described in the literature references cited above and then subjecting the functional group-containing monomer to a polymerization reaction.

Also, a resin containing an oxazolone ring represented by the general formula (F-II) as a carboxyl group-forming functional group may be obtained by conducting a polymerization reaction of at least one monomer containing the oxazolone ring, if desired, in combination with other copolymerizable monomer(s). The monomer containing the oxazolone ring can be prepared by a dehydrating cyclization reaction of an N-acyloyl-α-amino acid containing a polymerizable unsaturated bond. More specifically, it can be prepared according to the method described in the literature references cited in Yoshio Iwakura and Keisuke Kurita, *Han-nosei Kobunshi*, Ch. 3, Kodansha.

Of the resins (A), those containing not only at least one of the polymer components (a) but also at least one of the polymer components (b) are preferred. Since an insulating property and a glass transition point are appropriately controlled in the resin (A) of such type, electrophotographic characteristics and transferability of the transfer layer formed therefrom is further improved. Also, the transfer layer in the non-image areas is rapidly and completely removed without causing degradation in the image areas. As a result, the image transferred on receiving material has excellent reproducibility, and a transfer apparatus of small size can be utilized since the transfer is easily conducted under conditions of low temperature and low pressure. Moreover, in the resulting printing plate, cutting of toner image in highly accurate image portions such as fine lines, fine letters and dots for continuous tone areas is prevented and the residual transfer layer is not observed in the non-image areas.

When the resin (A) contains only the polymer component (a), the content of polymer component (a) is preferably from 3 to 50% by weight, and more preferably from 5 to 40% by weight based on the total polymer components in the resin (A).

On the other hand, when the resin (A) contains only the polymer component (b), the content of polymer component (b) is preferably from 3 to 100% by weight, and more preferably from 5 to 70% by weight based on the total polymer components in the resin (A). Further, when the resin (A) contains both the polymer component (a) and the polymer component (b), the content of polymer component (a) is preferably from 0.5 to 30% by weight, more preferably from 1 to 25% by weight, and the content of polymer component (b) is preferably from 3 to 99.5% by weight, more preferably from 5 to 50% by weight, based on the total polymer components in the resin (A).

The resin (A) may contain, in addition to the polymer components (a) and/or (b), a polymer component (c) containing a moiety having at least one of a fluorine atom and a silicon atom in order to increase releasability of the resin (A) itself.

The moiety having a fluorine and/or silicon atom to be contained in a polymer of the resin (A) includes that incorporated into the main chain of the polymer and that contained as a substituent in the side chain of the polymer.

The polymer components (c) are preferably present as a block in the resin (A). The content of polymer component (c) is preferably from 1 to 20% by weight based on the total polymer components in the resin (A). If the content of polymer component (c) is less than 1% by weight, the effect for improving the releasability of the resin (A) is small and on the other hand, if the content is more than 20% by weight, wettability of the resin (A) with a processing solution may tend to decrease, resulting in some difficulties for complete removal of the transfer layer.

The moiety having a fluorine and/or silicon atom, the polymer component containing the moiety and the block copolymer containing the polymer component are same as those described for the compound (S) hereinbefore.

The resin (A) preferably contains other polymer component(s) in addition to the above-described specific polymer components (a) and/or (b) and, if desired, the polymer component (c) in order to maintain its electrically insulating property and thermoplasticity. As such polymer components, those which form a homopolymer having a glass transition point of not more than 130° C. are preferred. More specifically, examples of such other polymer components include those corresponding to the repeating unit represented by the following general formula (U):

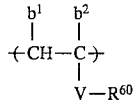

(I)

wherein V represents —COO—, —OCO—, —O—, —CO—, $-C_6H_4-$, $-(CH_2)_nCOO-$ or $-(CH_2)_nOCO-$; n represents an integer of from 1 to 4; $R^{60}$ represents a hydrocarbon group having from 1 to 22 carbon atoms; and $b^1$ and $b^2$, which may be the same or different, each represents a hydrogen atom, a fluorine atom, a chlorine atom, a bromine atom, a cyano group, a trifluoromethyl group, a hydrocarbon group having from 1 to 7 carbon atoms (e.g., methyl, ethyl, propyl, butyl, pentyl, hexyl, phenyl and benzyl) or $-COOZ^{11}$ (wherein $Z^{11}$ represents a hydrocarbon group having from 1 to 7 carbon atoms).

Preferred examples of the hydrocarbon group represented by $R^{60}$ include an alkyl group having from 1 to 18 carbon atoms which may be substituted (e.g., methyl, ethyl, propyl, butyl, pentyl, hexyl, octyl, decyl, dodecyl, tridecyl, tetradecyl, 2-chloroethyl, 2-bromoethyl, 2-cyanoethyl, 2-hydroxyethyl, 2-methoxyethyl, 2-ethoxyethyl, and 2-hydroxypropyl), an alkenyl group having from 2 to 18 carbon atoms which may be substituted (e.g., vinyl, allyl, isopropenyl, butenyl, hexenyl, heptenyl, and octenyl), an aralkyl group having from 7 to 12 carbon atoms which may be substituted (e.g., benzyl, phenethyl, naphthylmethyl, 2-naphthylethyl, methoxybenzyl, ethoxybenzyl, and methylbenzyl), a cycloalkyl group having from 5 to 8 carbon atoms which may be substituted (e.g., cyclopentyl, cyclohexyl, and cycloheptyl), and an aromatic group having from 6 to 12 carbon atoms which may be substituted (e.g., phenyl, tolyl, xylyl, mesityl, naphthyl, methoxyphenyl, ethoxyphenyl, fluorophenyl, methylchlorophenyl, difluorophenyl, bromophenyl, chlorophenyl, dichlorophenyl, methylcarbonylphenyl, methoxycarbonylphenyl, ethoxycarbonylphenyl, methanesulfonylphenyl, and cyanophenyl).

The content of one or more components represented by the general formula (U) is preferably from 50 to 97% by weight based on the total polymer components in the resin (A).

Moreover, the resin (A) may further contain other copolymerizable polymer components than the above described polymer components and the polymer component represented by the general formula (U). Examples of monomers corresponding to such other polymer components include, in addition to methacrylic acid esters, acrylic acid esters and crotonic acid esters containing substituents other than those described for the general formula (U), α-olefins, vinyl or allyl esters of carboxylic acids (including, e.g., acetic acid, propionic acid, butyric acid, valeric acid, benzoic acid, naphthalenecarboxylic acid, as examples of the carboxylic acids), acrylonitrile, methacrylonitrile, vinyl ethers, itaconic acid esters (e.g., dimethyl ester, and diethyl ester), acrylamides, methacrylamides, styrenes (e.g., styrene, vinyltoluene, chlorostyrene, N,N-dimethylaminomethylstyrene, methoxycarbonylstyrene, methanesulfonyloxystyrene, and vinylnaphthalene), vinyl sulfone compounds, vinyl ketone compound, and heterocyclic vinyl compounds (e.g., vinylpyrrolidone, vinylpyridine, vinylimidazole, vinylthiophene, vinylimidazoline, vinylpyrazoles, vinyldioxane, vinylquinoline, vinyltetrazole, and vinyloxazine). However, the examples of monomers should not be construed as being limited thereto. Such other polymer components may be employed in an appropriate range wherein the transferability of the resin (A) is not damaged. Specifically, it is preferred that the content of such other polymer components does not exceed 30% by weight based on the total polymer components of the resin (A).

The resin (A) may be employed individually or as a combination of two or more thereof.

According to a preferred embodiment of the present invention, the transfer layer is composed of at least two resins (A) having a glass transition point or a softening point different from each other. By using such a combination of the resins (A), transferability of the transfer layer is further improved.

Specifically, the transfer layer mainly contains a resin (AH) having a glass transition point of from 10° C. to 140° C. or a softening point of from 35° C. to 180° C. and a resin (AL) having a glass transition point of from −50° C. to 45° C. or a softening point of from 0° C. to 60° C. in which a difference in the glass transition point or softening point between the resin (AH) and the resin (AL) is at least 2° C.

Further, the resin (AH) has a glass transition point of preferably from 30° C. to 120° C., and more preferably from 35° C. to 90° C., or a softening point of preferably from 38° C. to 160° C., and more preferably from 40° C. to 120° C., and on the other hand, the thermoplastic resin (AL) has a glass transition point of preferably from −30° C. to 40° C., and more preferably from −20° C. to 33° C., or a softening point of preferably from 0° C. to 45° C., and more preferably from 5° C. to 40° C. The difference in the glass transition point or softening point between the resin (AH) and the resin (AL) used is preferably at least 5° C., and more preferably in a range of from 10° C. to 50° C. The difference in the glass transition point or softening point between the resin (AH) and the resin (AL) means a difference between the lowest glass transition point or softening point of those of the resins (AH) and the highest glass transition point or softening point of those of the resins (AL) when two or more of the resins (AH) and/or resins (AL) are employed.

A weight ratio of the resin (AH)/the resin (AL) used in the transfer layer is preferably from 5/95 to 90/10, more preferably from 10/90 to 70/30.

If desired, the transfer layer may further contain other conventional resins in addition to the resin (A). It should be noted, however, that such other resins be used in a range that the easy removal of the transfer layer is not deteriorated.

Specifically, the polymer components (a) and/or (b) should be present at least 3% by weight based on the total resin used in the transfer layer.

Examples of other resins which may be used in combination with the resin (A) include vinyl chloride resins, polyolefin resins, acrylic ester polymers or copolymers, methacrylic ester polymers or copolymers, styrene-acrylic ester copolymers, styrene-methacrylic ester copolymers, itaconic diester polymers or copolymers, maleic anhydride copolymers, acrylamide copolymers, methacrylamide copolymers, hydroxy-modified silicone resins, polycarbonate resins, ketone resins, polyester resins, silicone resins, amide resins, hydroxy- or carboxy-modified polyester resins, butyral resins, polyvinyl acetal resins, cyclized rubber-methacrylic ester copolymers, cyclized rubber-acrylic ester copolymers, copolymers containing a heterocyclic ring (the heterocyclic ring including furan, tetrahydrofuran, thiophene, dioxane, dioxofuran, lactone, benzofuran, benzothiophene and 1,3-dioxethane rings), cellulose resins, fatty acid-modified cellulose resins, and epoxy resins.

Further, specific examples of usable resins are described, e.g., in *Plastic Zairyo Koza Series*, Vols. 1 to 18, Nikkan Kogyo Shinbunsha (1981), Kinki Kagaku Kyokai Vinyl Bukai (ed.), *Polyenka Vinyl*, Nikkan Kogyo Shinbunsha (1988), Eizo Omori, *Kinosei Acryl Jushi*, Techno System (1985), Ei-ichiro Takiyama, *Polyester Jushi Handbook*, Nikkan Kogyo Shinbunsha (1988), Kazuo Yuki, *Howa Polyester Jushi Handbook*, Nikkan Kogyo Shinbunsha (1989), Kobunshi Gakkai (ed.), *Kobunshi Data Handbook* (*Oyohen*), Ch. 1, Baifukan (1986), Yuji Harasaki (ed.), *Saishin Binder Gijutsu Binran*, Ch. 2, Sogo Gijutsu Center (1985), Taira Okuda (ed.), *Kobunshi Kako*, Vol 20, Supplement "Nenchaku", Kobunshi Kankokai (1976), Keizi Fukuzawa, *Nenchaku Gijutsu*, Kobunshi Kankokai (1987), Mamoru Nishiguchi, *Secchaku Binran*, 14th Ed., Kobunshi Kankokai (1985), and Nippon Secchaku Kokai (ed.), *Secchaku Handbook*, 2nd Ed., Nikkan Kogyo Shinbunsha (1980).

These resins may be used either individually or in combination of two or more thereof.

If desired, the transfer layer may contain various additives for improving physical characteristics, such as adhesion, film-forming property, and film strength. For example, rosin, petroleum resin, or silicone oil may be added for controlling adhesion; polybutene, DOP, DBP, low-molecular weight styrene resins, low molecular weight polyethylene wax, micro-crystalline wax, or paraffin wax, as a plasticizer or a softening agent for improving wetting property to the light-sensitive element or decreasing melting viscosity; and a polymeric hindered polyvalent phenol, or a triazine derivative, as an antioxidant. For the details, reference can be made to Hiroshi Fukada, *Hot-melt Secchaku no Jissai*, pp. 29 to 107, Kobunshi Kankokai (1983).

The transfer layer may be composed of two or more layers, if desired. In such a case, the resin (A) should be present at least in a layer which is in contact with the surface of the electrophotographic light-sensitive element. In accordance with a preferred embodiment, the transfer layer is composed of a lower layer which is contact with the surface of the electrophotographic light-sensitive element and which comprises a thermoplastic resin having a relatively high glass transition point or softening point, for example, one of the thermoplastic resins (AH) described above, and an upper layer provided thereon comprising a thermoplastic resin having a relatively low glass transition point or softening point, for example, one of the thermoplastic resins (AL) described above, and in which the difference in the glass transition point or softening point therebetween is at least 2° C., and preferably at least 5° C. By introducing such a configuration of the transfer layer, transferability of the transfer layer to a receiving material is remarkably improved, a further enlarged latitude of transfer conditions (e.g., heating temperature, pressure, and transportation speed) can be achieved, and the transfer can be easily performed irrespective of the kind of receiving material which is to be converted to a printing plate. Moreover, transfer layer is preserved without the formation of peeling from the receiving material when the receiving materials having the transfer layer which are printing plate precursors are placed one over another before a step for removing the transfer layer by a chemical reaction treatment, since the surface of the transfer layer transferred onto a receiving material is composed of the thermoplastic resin having a relatively high glass transition point or softening point.

The transfer layer suitably has a thickness of from 0.2 to 20 μm, and preferably from 0.5 to 10 μm. If the transfer layer is too thin, it is liable to result in insufficient transfer, and if the layer is too thick, troubles on the electrophotographic process tend to occur, failing to obtain a sufficient image density or resulting in degradation of image quality. When the transfer layer is composed of a plurality of layers, a thickness of a single layer is at least 0.1 μm while the thickness of the total layers is usually at most 20 μm.

As described above, the method for preparation of a printing plate according to the present invention is characterized by applying the compound (S) onto the surface of electrophotographic light-sensitive element before or at the same time as the formation of transfer layer. Specifically, the compound (S) is at first applied to the surface of light-sensitive material and then the transfer layer is formed thereon, or the application of compound (S) is simultaneously conducted with the formation of transfer layer. The term "application of the compound (S) onto the surface of electrophotographic light-sensitive element" means that the compound is supplied on the surface of electrophotographic light-sensitive element to form a state wherein the compound (S) is adsorbed or adhered thereon. By the application of compound (S), the surface of electrophotographic light-sensitive element is modified to have good releasability.

In order to apply the compound (S) to the surface of electrophotographic light-sensitive element, conventionally known various methods can be employed. For example, methods using an air doctor coater, a blade coater, a knife coater, a squeeze coater, a dip coater, a reverse roll coater, a transfer roll coater, a gravure coater, a kiss roll coater, a spray coater, a curtain coater, or a calender coater as described, for example, in Yuji Harasaki, *Coating Kogaku*, Asakura Shoten (1971), Yuji Harasaki, *Coating Hoshiki*, Maki Shoten (1979), and Hiroshi Fukada, *Hot-melt Secchaku no Jissai* Kobunshi Kankokai (1979) can be used.

A method wherein cloth, paper or felt impregnated with the compound (S) is pressed on the surface of light-sensitive element, a method of pressing a curable resin impregnated with the compound (S), a method wherein the light-sensitive element is wetted with a non-aqueous solvent containing the compound (S) dissolved therein, and then dried to remove the solvent, and a method wherein the compound (S) dispersed in a non-aqueous solvent is migrated and adhered on the surface of light-sensitive element due to electrophoresis according to a wet-type electrodeposition method as described hereinafter can also be employed.

Further, the compound (S) can be applied on the surface of light-sensitive element by utilizing a non-aqueous solvent containing the compound (S) according to an ink jet method, followed by drying. The ink jet method can be performed with reference to the descriptions in Shin Ohno (ed.), *Non-impact Printing*, C.M.C. (1986). More specifically, a Sweet process or Hartz process of a continuous jet type, a Winston process of an intermittent jet type, a pulse jet process or bubble jet process of an ink on-demand type, and a mist process of an ink mist type are illustrated. In any system, the compound (S) itself or diluted with a solvent is filled in an ink tank or ink head cartridge in place of an ink to use. The solution of compound (S) used ordinarily has a viscosity of from 1 to 10 cp and a surface tension of from 30 to 60 dyne/cm, and may contain a surface active agent, or may be heated if desired. Although a diameter of ink droplet is in a range of from 30 to 100 μm due to a diameter of an orifice of head in a conventional ink jet printer in order to reproduce fine letters, droplets of a larger diameter can also be used in the present invention. In such a case, an amount of jet of the compound (S) becomes large and thus a time necessary for the application can be shortened. Further, to use multiple nozzles is very effective to shorten the time for application.

When silicone rubber is used as the compound (S), it is preferred that silicone rubber is provided on a metal axis to cover and the resulting-silicone rubber roller is directly pressed on the surface of electrophotographic light-sensitive element. In such a case, a nip pressure is ordinarily in a range of from 0.5 to 10 $Kgf/cm^2$ and a time for contact is ordinarily in a range of from 1 second to 30 minutes. Also, the light-sensitive element and/or silicone rubber roller may be heated up to a temperature of 150° C. According to this method, it is believed that a part of low molecular weight components contained in silicone rubber is moved from the silicone rubber roller onto the surface of light-sensitive element during the press. The silicone rubber may be swollen with silicone oil. Moreover, the silicone rubber may be a form of sponge and the sponge roller may be impregnated with silicone oil or a solution of silicone surface active agent.

The application method of the compound (S) is not particularly limited, and an appropriate method can be selected depending on a state (i.e., liquid, wax or solid) of the compound (S) used. A flowability of the compound (S) can be controller using a heat medium, if desired.

The application of compound (S) is preferably performed by a means which is easily incorporated into an electrophotographic apparatus.

An amount of the compound (S) applied to the surface of electrophotographic light-sensitive element is adjusted in a range wherein the electrophotographic characteristics of light-sensitive element do not adversely affected in substance. Ordinarily, a thickness of the coating is sufficiently 1 μm or less. By the formation of weak boundary layer as defined in Bikerman, *The Science of Adhesive Joints*, Academic Press (1961), the releasability-imparting effect of the present invention can be obtained. Specifically, when an adhesive strength of the surface of an electrophotographic light-sensitive element to which the compound (S) has been applied is measured according to JIS Z 0237-1980 "Testing methods of pressure sensitive adhesive tapes and sheets", the resulting adhesive strength is desirably not more than 100 gram.force, more desirably not more than 50 gram-.force.

The measurement of adhesive strength is conducted according to JIS Z 0237-1980 8.3.1. 180 *Degrees Peeling Method* with the following modifications:

(i) As a test plate, an electrophotographic light-sensitive element comprising a substrate and a photo-conductive layer, on the surface of which a transfer layer is to be provided is used.

(ii) As a test piece, a pressure sensitive adhesive tape of 6 mm in width prepared according to JIS C-2338 is used.

(iii) A peeling rate is 120 mm/min using a constant rate of traverse type tensile testing machine.

Specifically, the test piece is laid its adhesive face downward on the cleaned test plate and a roller is reciprocate one stroke at a rate of approximately 300 mm/min upon the test piece for pressure sticking. Within 20 to 40 minutes after the sticking with pressure, a part of the stuck portion is peeled approximately 25 mm in length and then peeled continuously at the rate of 120 mm/min using the constant rate of traverse type tensile testing machine. The strength is read at an interval of approximately 20 mm in length of peeling, and eventually read 4 times. The test is conducted on three test pieces. The mean value is determined from 12 measured values for three test pieces and the resulting mean value is converted in terms of 10 mm in width.

In a case wherein the application of compound (S) is simultaneously conducted with the formation of transfer layer, since a pressure sensitive adhesive tape which is a test piece can not be directly brought into contact with the surface of electrophotographic light-sensitive element to be measured, an adhesive strength between the electrophotographic light-sensitive element and the transfer layer is measured in the same manner as above using the electrophotographic light-sensitive element having the transfer layer formed thereon and the resulting value is adopted as the adhesive strength of the surface of electrophotographic light-sensitive element.

In accordance with the present invention, the surface of electrophotographic light-sensitive element is provided with appropriate releasability by the application of compound (S), and the light-sensitive element can be repeatedly employed as far as the releasability is maintained. Specifically, the application of compound (S) is not always necessarily whenever a series of steps comprising the formation of transfer layer, formation of image and transfer of the transfer layer onto a receiving material is repeated.

In order to form the transfer layer in the present invention, conventional layer-forming methods can be employed. For instance, a solution or dispersion containing the composition for the transfer layer is applied onto the surface of light-sensitive element in a known manner. In particular, for the formation of transfer layer on the surface of light-sensitive element, a hot-melt coating method, electrodeposition coating method or transfer method is preferably used. These methods are preferred in view of easy formation of the transfer layer on the surface of light-sensitive element in an electrophotographic apparatus. Each of these methods will be described in greater detail below.

The hot-melt coating method comprises hot-melt coating of the composition for the transfer layer by a known method. For such a purpose, a mechanism of a non-solvent type coating machine, for example, a hot-melt coating apparatus for a hot-melt adhesive (hot-melt coater) as described in the above-mentioned *Hot-melt Secchaku no Jissai*, pp. 197 to 215 can be utilized with modification to suit with coating onto the light-sensitive drum. Suitable examples of coating machines include a direct roll coater, an offset gravure roll coater, a rod coater, an extrusion coater, a slot orifice coater, and a curtain coater.

A melting temperature of the resin at coating is usually in a range of from 50° to 180° C., while the optimum temperature is determined depending on the composition of the resin to be used. It is preferred that the resin is first molten using a closed pre-heating device having an automatic temperature controlling means and then heated in a short time to the desired temperature in a position to be coated on the light-sensitive element. To do so can prevent from degradation of the resin upon thermal oxidation and unevenness in coating.

A coating speed may be varied depending on flowability of the resin at the time of being molten by heating, a kind of coater, and a coating amount, etc., but is suitably in a range of from 1 to 100 mm/sec, preferably from 5 to 40 mm/sec.

Now, the electrodeposition coating method will be described below. According to this method, the resin is electrostatically adhered or electrodeposited (hereinafter simply referred to as electrodeposition sometimes) on the surface of light-sensitive element in the form of resin grains and then transformed into a uniform thin film, for example, by heating, thereby the transfer layer being formed. Grains of resins (A), (AH) and (AL) are sometimes referred to as resin grains (AR), (ARH) and (ARL), respectively hereinafter.

The resin grains forming the transfer layer must have either a positive charge or a negative charge. The electroscopicity of the resin grains is appropriately determined depending on a charging property of the electrophotographic light-sensitive element to be used in combination.

An average grain diameter of the resin grains having the physical property described above is generally in a range of from 0.01 to 15 μm, preferably from 0.05 to 5 μm and more preferably from 0.1 to 1 μm. The resin grains may be employed as powder grains (in case of dry type electrodeposition) or grains dispersed in a non-aqueous system (in case of wet type electrodeposition). The resin grains dispersed in a non-aqueous system are preferred since they can easily prepare a thin layer of uniform thickness.

The resin grains used in the present invention can be produced by a conventionally known mechanical powdering method or polymerization granulation method. These methods can be applied to the production of resin grains for both of dry type electrodeposition and wet type electrodeposition.

The mechanical powdering method for producing powder grains used in the dry type electrodeposition method includes a method wherein the thermoplastic resin is directly powdered by a conventionally known pulverizer to form fine grains (for example, a method using a ball mill, a paint shaker or a jet mill). If desired, mixing, melting and kneading of the materials for resin grains before the powdering and classification for a purpose of controlling a grain diameter and after-treatment for treating the surface of grain after the powdering may be performed in an appropriate combination. A spray dry method is also employed.

Specifically, the powder grains can be easily produced by appropriately using a method as described in detail, for example, in Shadanhojin Nippon Funtai Kogyo Gijutsu Kyokai (ed.), *Zoryu Handbook*, II ed., Ohm Sha (1991), Kanagawa Keiei Kaihatsu Center, *Saishin Zoryu Gijutsu no Jissai*, Kanagawa Keiei Kaihatsu Center Shuppan-bu (1984), and Masafumi Arakawa et al (ed.), *Saishin Funtai no Sekkei Gijutsu*, Techno System (1988).

The polymerization granulation methods include conventionally known methods using an emulsion polymerization reaction, a seed polymerization reaction or a suspension polymerization reaction each conducted in an aqueous system, or using a dispersion polymerization reaction conducted in a non-aqueous solvent system.

More specifically, grains are formed according to the methods as described, for example, in Soichi Muroi, *Kobunshi Latex no Kagaku*, Kobunshi Kankokai (1970), Taira Okuda and Hiroshi Inagaki, *Gosei Jushi Emulsion*, Kobunshi Kankokai (1978), soichi Muroi, *Kobunshi Latex Nyumon*, Kobunsha (1983), I. Pürma and P. C. Wang, *Emulsion Polymerization*, I. Pürma and J. L. Gaudon, *ACS Symp. Sev.*, 24, p. 34 (1974), Fumio Kitahara et al, *Bunsan Nyukakei no Kagaku*, Kogaku Tosho (1979), and Soichi Muroi (supervised), *Chobiryushi Polymer no Saisentan Gijutsu*, C.M.C. (1991), and then collected and pulverized in such a manner as described in the reference literatures cited with respect to the mechanical method above, thereby the resin grains being obtained.

In order to conduct dry type electrodeposition of the fine powder grains thus-obtained, a conventionally known method, for example, a coating method of electrostatic powder and a developing method with a dry type electrostatic developing agent can be employed. More specifically, a method for electrodeposition of fine grains charged by a method utilizing, for example, corona charge, triboelectrification, induction charge, ion flow charge, and inverse ionization phenomenon, as described, for example, in J. F. Hughes, *Seiden Funtai Toso*, translated by Hideo Nagasaka and Machiko Midorikawa, or a developing method, for example, a cascade method, a magnetic brush method, a fur brush method, an electrostatic method, an induction method, a touchdown method and a powder cloud method, as described, for example, in Koich Nakamura (ed.), *Saikin no Denshishashin Genzo System to Toner Zairyo no Kaihatsu.Jitsuyoka*, Ch. 1, Nippon Kogaku Joho (1985) is appropriately employed.

The production of resin grains dispersed in a non-aqueous system which are used in the wet type electrodeposition method can also be performed by any of the mechanical powdering method and polymerization granulation method as described above.

The mechanical powdering method includes a method wherein the resin is dispersed together with a dispersion polymer in a wet type dispersion machine (for example, a ball mill, a paint shaker, Keddy mill, and Dyno-mill), and a method wherein the materials for resin grains and a dispersion assistant polymer (or a covering polymer) have been previously kneaded, the resulting mixture is pulverized and then is dispersed together with a dispersion polymer. Specifically, a method of producing paints or electrostatic developing agents can be utilized as described, for example, in Kenji Ueki (translated), *Toryo no Ryudo to Ganryo Bunsan*, Kyoritsu Shuppan (1971), D. H. Solomon, *The Chemistry of Organic Film Formers*, John Wiley & Sons (1967), *Paint and Surface Coating Theory and Practice*, Yuji Harasaki, *Coating Kogaku*, Asakura Shoten (1971), and Yuji Harasaki, *Coating no Kiso Kagaku*, Maki Shoten (1977).

The polymerization granulation method includes a dispersion polymerization method in a non-aqueous system conventionally known and is specifically described, for example, in *Chobiryushi Polymer no Saisentan Gijutsu*, Ch. 2, mentioned above, *Saikin no Denshishashin Genzo System to Toner Zairyo no Kaihatsu.Jitsuyoka*, Ch. 3, mentioned above, and K. E. J. Barrett, *Dispersion Polymerization in Organic Media*, John Wiley & Sons (1975).

The resin grains composed of a random copolymer containing the polymer components (a) and/or (b) and the polymer component (c) can be easily obtained by performing a polymerization reaction using monomers corresponding to the polymer components (a) and/or (b) together with a monomer corresponding to the polymer component (c) according to the polymerization granulation method described above.

The resin grains containing the polymer component (c) as a block can be prepared by conducting a polymerization reaction using, as a dispersion stabilizing resins, a block copolymer containing the polymer component (c) as a block, or conducting polymerization reaction using a monofunctional macromonomer having a weight average molecular weight of from $1\times10^3$ to $2\times10^4$, preferably from $3\times10^3$ to $5\times10^4$ and containing the polymer component (c) as main repeating unit together with the polymer components (a) and/or (b). Alternatively, the resin grains composed of block copolymer can be obtained by conducting a polymerization reaction using a polymer initiator (for example, azobis polymer initiator or peroxide polymer initiator) containing the polymer component (c) as main repeating unit.

As the non-aqueous solvent used in the dispersion polymerization method in a non-aqueous system, there can be used any of organic solvents having a boiling point of at most 200° C., individually or in a combination of two or more thereof. Specific examples of the organic solvent include alcohols such as methanol, ethanol, propanol, butanol, fluorinated alcohols and benzyl alcohol, ketones such as acetone, methyl ethyl ketone, cyclohexanone and diethyl ketone, ethers such as diethyl ether, tetrahydrofuran and dioxane, carboxylic acid esters such as methyl acetate, ethyl acetate, butyl acetate and methyl propionate, aliphatic hydrocarbons containing from 6 to 14 carbon atoms such as hexane, octane, decane, dodecane, tridecane, cyclohexane and cyclooctane, aromatic hydrocarbons such as benzene, toluene, xylene and chlorobenzene, and halogenated hydrocarbons such as methylene chloride, dichloroethane, tetrachloroethane, chloroform, methylchloroform, dichloropropane and trichloroethane. However, the present invention should not be construed as being limited thereto.

When the dispersed resin grains are synthesized by the dispersion polymerization method in a non-aqueous solvent system, the average grain diameter of the dispersed resin grains can readily be adjusted to at most 1 μm while simultaneously obtaining grains of mono-disperse system with a very narrow distribution of grain diameters.

A dispersive medium used for the resin grains dispersed in a non-aqueous system is usually a non-aqueous solvent having an electric resistance of not less than $10^8$ Ω.cm and a dielectric constant of not more than 3.5, since the dispersion is employed in a method wherein the resin grains are electrodeposited utilizing a wet type electrostatic photographic developing process or electrophoresis in electric fields.

The method in which grains comprising the resin forming the transfer layer dispersed in an electrical insulating solvent having an electric resistance of not less than $10^8$ Ω.cm and a dielectric constant of not more than 3.5 are supplied is preferred in view of easy preparation of the transfer layer having a uniform and small thickness.

The insulating solvents which can be used include straight chain or branched chain aliphatic hydrocarbons, alicyclic hydrocarbons, aromatic hydrocarbons, and halogen-substituted derivatives thereof. Specific examples of the solvent include octane, isooctane, decane, isodecane, decalin, nonane, dodecane, isododecane, cyclohexane, cyclooctane, cyclodecane, benzene, toluene, xylene, mesitylene, Isopar E, Isopar G, Isopar H, Isopar L (Isopar: trade name of Exxon Co.), Shellsol 70, Shellsol 71 (Shellsol: trade name of Shell Oil Co.), Amsco OMS and Amsco 460 Solvent (Amsco: trade name of Americal Mineral Spirits Co.). They may be used singly or as a combination thereof.

The insulating organic solvent described above is preferably employed as a non-aqueous solvent from the beginning of polymerization granulation of resin grains dispersed in the non-aqueous system. However, it is also possible that the granulation is performed in a solvent other than the above-described insulating solvent and then the dispersive medium is substituted with the insulating solvent to prepare the desired dispersion.

Another method for the preparation of a dispersion of resin grains in non-aqueous system is that a block copolymer comprising a polymer portion which is soluble in the above-described non-aqueous solvent having an electric resistance of not less than $10^8$ Ω.cm and a dielectric constant of not more than 3.5 and a polymer portion which is insoluble in the non-aqueous solvent, is dispersed in the non-aqueous solvent by a wet type dispersion method. Specifically, the block copolymer is first synthesized in an organic solvent which dissolves the resulting block copolymer according to the synthesis method of block copolymer as described above and then dispersed in the non-aqueous solvent described above.

In order to electrodeposit dispersed grains in a dispersive medium upon electrophoresis, the grains must be electroscopic grains of positive charge or negative charge. The impartation of electroscopicity to the grains can be performed by appropriately utilizing techniques on developing agents for wet type electrostatic photography. More specifically, it can be carried out using electroscopic materials and other additives as described, for example, in *Saikin no Denshishashin Genzo System to Toner Zairyo no Kaihatsu.Jitsuyoka*, pp. 139 to 148, mentioned above, Denshishashin Gakkai (ed.), *Denshishashin Gijutsu no Kiso to Oyo*, pp. 497 to 505, Corona Sha (1988), and Yuji Harasaki, *Denshishashin*, Vol. 16, No. 2, p. 44 (1977). Further, compounds as described, for example, in British Patents 893,429 and 934,038, U.S. Pat. Nos. 1,122,397, 3,900,412 and 4,606,989, JP-A-60-179751, JP-A-60-185963 and JP-A-2-13965 are employed.

The dispersion of resin grains in a non-aqueous system (latex) which can be employed for electrodeposition usually comprises from 0.1 to 20 g of grains containing the resin for forming the transfer layer, from 0.01 to 50 g of a dispersion stabilizing resin and if desired, from 0.0001 to 10 g of a charge control agent in one liter of an electrically insulating dispersive medium.

Furthermore, if desired, other additives may be added to the dispersion of resin grains in order to maintain dispersion stability and charging stability of grains. Suitable examples of such additives include rosin, petroleum resins, higher alcohols, polyethers, silicone oil, paraffin wax and triazine derivatives. The total amount of these additives is restricted by the electric resistance of the dispersion. Specifically, if the electric resistance of the dispersion in a state of excluding the grains therefrom becomes lower than $10^8$ Ω.cm, a sufficient amount of the thermoplastic resin grains deposited is reluctant to obtain and, hence, it is necessary to control the amounts of these additives in the range of not lowering the electric resistance than $10^8$ Ω.cm.

In order to perform the application of the compound (S) and the formation of transfer layer in one step, the electrodeposition coating method can be conducted using a dispersion for electrodeposition comprising an insulating organic solvent having an electric resistance of not less than $10^8$ Ω.cm, and a dielectric constant of not more than 3.5, the compound (S) which is soluble at least 0.01 g in one liter of the insulating organic solvent and grains of the resin (A) dispersed therein.

The amount of compound (S) added to the dispersion for electrodeposition may be varied depending on the compound (S) and the insulating organic solvent to be used. A suitable amount of the compound (S) is determined taking the effect to be obtained and adverse affects on electrophoresis of resin grains (e.g., decrease in electric resistance or increase in viscosity of the dispersion) into consideration. A preferred range of the compound (S) added is ordinarily from 0.01 to 20 g per one liter of insulating organic solvent.

The resin grains for forming the transfer layer which are prepared, provided with an electrostatic charge and dispersed in an electrically insulting liquid behave in the same manner as an electrophotographic wet type developing agent. For instance, the resin grains can be subjected to electrophoresis on the surface of light-sensitive element using a developing device, for example, a slit development electrode device as described in *Denshishashin Gijutsu no Kiso to Oyo*, pp. 275 to 285, mentioned above. Specifically, the grains comprising the resin for forming the transfer layer are supplied between the electrophotographic light-sensitive element and an electrode placed in face of the light-sensitive element, and migrate due to electrophoresis according to potential gradient applied from an external power source to adhere to or electrodeposit on the electrophotographic light-sensitive element, thereby a film being formed.

In general, if the charge of grains is positive, an electric voltage was applied between an electroconductive support of the light-sensitive element and a development electrode of a developing device from an external power source so that the light-sensitive material is negatively charged, thereby the grains being electrostatically electrodeposited on the surface of light-sensitive element.

Electrodeposition of grains can also be performed by wet type toner development in a conventional electrophotographic process. Specifically, the light-sensitive element is uniformly charged and then subjected to a conventional wet type toner development without exposure to light or after conducting a so-called print-off in which only unnecessary regions are exposed to light, as described in *Denshishashin Gijutsu no Kiso to Oyo*, pp. 46 to 79, mentioned above.

The amount of resin grain adhered to the light-sensitive element can be appropriately controlled, for example, by an external bias voltage applied, a potential of the light-sensitive element charged and a developing time.

After the electrodeposition of grains, the developing solution is wiped off upon squeeze using a rubber roller, a gap roller or a reverse roller. Other known methods, for example, corona squeeze and air squeeze can also be employed. Then, the deposit is dried with cool air or warm air or by a infrared lamp preferably to be rendered the thermoplastic resin grains in the form of a film, thereby the transfer layer being formed.

Now, the formation of transfer layer by the transfer method will be described below. According to this method, the transfer layer provided on a releasable support typically represented by release paper (hereinafter simply referred to as release paper) is transferred onto the surface of electrophotographic light-sensitive element.

The release paper having the transfer layer thereon is simply supplied to a transfer device in the form of a roll or sheet.

The release paper which can be employed in the present invention include those conventionally known as described, for example, in *Nenchaku (Nensecchaku) no Shin Gijutsu to Sono Yoto.Kakushu Oyoseihin no Kaihatsu Siryo*, published by Keiei Kaihatsu Center Shuppan-bu (May 20, 1978), and *All Paper Guide Shi no Shohin Jiten, Jo Kan, Bunka Sangyo Hen*, published by Shigyo Times Sha (Dec. 1, 1983).

Specifically, the release paper comprises a substrate such as nature Clupak paper laminated with a polyethylene resin, high quality paper pre-coated with a solvent-resistant resin, kraft paper, a PET film having an under-coating or glassine having coated thereon a release agent mainly composed of silicone.

A solvent type of silicone is usually employed and a solution thereof having a concentration of from 3 to 7% by weight is coated on the substrate, for example, by a gravure roll, a reverse roll or a wire bar, dried and then subjected to heat treatment at not less than 150° C. to be cured. The coating amount is usually about 1 g/m$^2$.

Release paper for tapes, labels, formation industry use and cast coat industry use each manufactured by a paper making company and put on sale are also generally employed. Specific examples thereof include Separate Shi (manufactured by Ohji Seishi K.K.), King Rease (manufactured by Shikoku Seishi K.K.), Sun Release (manufactured by Sanyo Kokusaku Pulp K.K.) and NK High Release (manufactured by Nippon Kako Seishi K.K.).

In order to form the transfer layer on release paper, a composition for the transfer layer mainly composed of the resin is applied to releasing paper in a conventional manner, for example, by bar coating, spin coating or spray coating to form a film. The transfer layer may also be formed on release paper by a hot-melt coating method or an electrodeposition coating method.

For a purpose of heat transfer of the transfer layer on release paper to the electrophotographic light-sensitive element, conventional heat transfer methods are utilized. Specifically, release paper having the transfer layer thereon is pressed on the electrophotographic light-sensitive element to heat transfer the transfer layer.

The conditions for transfer of the transfer layer from release paper to the surface of light-sensitive element are preferably as follows. A nip pressure of the roller is from 0.1 to 10 kgf/cm$^2$ and more preferably from 0.2 to 8 kgf/cm$^2$. A temperature at the transfer is from 25° to 100° C. and more preferably from 40° to 80° C. A speed of the transportation is from 0.5 to 100 mm/sec and more preferably from 3 to 50 mm/sec. The speed of transportation may differ from that of the electrophotographic step or that of the heat transfer step of the transfer layer to the receiving material.

Instead of applying the compound (S) onto the surface of electrophotographic light-sensitive element before the heat transfer of transfer layer from release paper, it is carried out that the compound (S) is applied onto the surface of transfer layer provided on release paper by an appropriate method described above and the resulting release paper is pressed on the electrophotographic light-sensitive element to transfer the transfer layer. According to this procedure, the application of compound (S) to the surface of electrophotographic light-sensitive element and the formation of transfer layer thereon are performed at the same time.

Now, the electrophotographic light-sensitive element on the surface of which the transfer layer is formed will be described in detail below.

Any conventionally known electrophotographic light-sensitive element can be employed in the present invention.

Suitable examples of electrophotographic light-sensitive element used are described, for example, in R. M. Schaffert, *Electrophotography*, Forcal Press, London (1980), S. W. Ing, M. D. Tabak and W. E. Haas, *Electrophotography Fourth International Conference*, SPSE (1983), Isao Shinohara, Hidetoshi Tsuchida and Hideaki Kusakawa (ed.), *Kirokuzairyo to Kankoseijushi*, Gakkai Shuppan Center (1979), Hiroshi Kokado, *Kagaku to Kogyo*, Vol. 39, No. 3, p. 161 (1986), *Saikin no Kododen Zairyo to Kankotai no Kaihatsu.Jitsuyoka*, Nippon Kagaku Joho Shuppanbu (1986), Denshishashin Gakkai (ed.), *Denshishashin no Kiso to Oyo*, Corona (1986), and Denshishashin Gakkai (ed.), *Denshishashinyo Yukikankotai no Genjo Symposium* (preprint), (1985).

A photoconductive layer for the electrophotographic light-sensitive element which can be used in the present invention is not particularly limited, and any known photoconductive layer may be employed.

Specifically, the photoconductive layer includes a single layer made of a photoconductive compound itself and a photoconductive layer comprising a binder resin having dispersed therein a photoconductive compound. The dispersed type photoconductive layer may have a single layer structure or a laminated structure. The photoconductive compounds used in the present invention may be inorganic compounds or organic compounds.

Inorganic photoconductive compounds used in the present invention include those conventionally known for example, zinc oxide, titanium oxide, zinc sulfide, cadmium sulfide, selenium, selenium-tellurium, silicon, lead sulfide. These compounds are used together with a binder resin to form a photoconductive layer, or they are used alone to form a photoconductive layer by vacuum evaporation or spattering.

Where an inorganic photoconductive compound, e.g., zinc oxide or titanium oxide, is used, a binder resin is usually used in an amount of from 10 to 100 parts by weight, and preferably from 15 to 40 parts by weight, per 100 parts by weight of the inorganic photoconductive compound.

Organic photoconductive compounds used may be selected from conventionally known compounds. Suitable photoconductive layers containing an organic photoconductive compound include (i) a layer mainly comprising an organic photoconductive compound, a sensitizing dye, and a binder resin as described, e.g., in JP-B-37-17162, JP-B-62-51462, JP-A-52-2437, JP-A-54-19803, JP-A-56-107246, and JP-A-57-161863; (ii) a layer mainly comprising a charge generating agent, a charge transporting agent, and a binder resin as described, e.g., in JP-A-56-146145, JP-A-60-17751, JP-A-60-17752, JP-A-60-17760, JP-A-60-254142, and JP-A-62-54266; and (iii) a double-layered structure containing a charge generating agent and a charge transporting agent in separate layers as described, e.g., in JP-A-60-230147, JP-A-60-230148, and JP-A-60-238853.

The photoconductive layer of the electrophotographic light-sensitive element according to the present invention may have any of the above-described structure.

The organic photoconductive compounds which may be used in the present invention include (a) triazole derivatives described, e.g., in U.S. Pat. No. 3,112,197, (b) oxadiazole derivatives described, e.g., in U.S. Pat. No. 3,189,447, (c) imidazole derivatives described in JP-B-37-16096, (d) polyarylalkane derivatives described, e.g., in U.S. Pat. Nos. 3,615,402, 3,820,989, and 3,542,544, JP-B-45-555, JP-B-51-10983, JP-A-51-93224, JP-A-55-108667, JP-A-55-156953, and JP-A-56-36656, (e) pyrazoline derivatives and pyrazolone derivatives described, e.g., in U.S. Pat. Nos. 3,180,729 and 4,278,746, JP-A-55-88064, JP-A-55-88065, JP-A-49-105537, JP-A-55-51086, JP-A-56-80051, JP-A-56-88141, JP-A-57-45545, JP-A-54-112637, and JP-A-55-74546, (f) phenylenediamine derivatives described, e.g., in U.S. Pat. No. 3,615,404, JP-B-51-10105, JP-B-46-3712, JP-B-47-28336, JP-A-54-83435, JP-A-54-110836, and JP-A-54-119925, (g) arylamine derivatives described, e.g., in U.S. Pat. Nos. 3,567,450, 3,180,703, 3,240,597, 3,658,520, 4,232,103, 4,175,961, and 4,012,376, JP-B-49-35702, West German Patent (DAS) 1,110,518, JP-B-39-27577, JP-A-55-144250, JP-A-56-119132, and JP-A-56-22437, (h) amino-substituted chalcone derivatives described, e.g., in U.S. Pat. No. 3,526,501, (i) N,N-bicarbazyl derivatives described, e.g., in U.S. Pat. No. 3,542,546, (j) oxazole derivatives described, e.g., in U.S. Pat. No. 3,257,203, (k) styrylanthracene derivatives described, e.g., in JP-A-56-46234, (l) fluorenone derivatives described, e.g., in JP-A-54-110837, (m) hydrazone derivatives described, e.g., in U.S. Pat. No. 3,717,462, JP-A-54-59143 (corresponding to U.S. Pat. No. 4,150,987), JP-A-55-52063, JP-A-55-52064, JP-A-55-46760, JP-A-55-85495, JP-A-57-11350, JP-A-57-148749, and JP-A-57-104144, (n) benzidine derivatives described, e.g., in U.S. Pat. Nos. 4,047,948, 4,047,949, 4,265,990, 4,273,846, 4,299,897, and 4,306,008, (o) stilbene derivatives described, e.g., in JP-A-58-190953, JP-A-59-95540, JP-A-59-97148, JP-A-59-195658, and JP-A-62-36674, (p) polyvinylcarbazole and derivatives thereof described in JP-B-34-10966, (q) vinyl polymers, such as polyvinylpyrene, polyvinylanthracene, poly-2-vinyl-4-(4'-dimethylaminophenyl)-5-phenyloxazole, and poly-3-vinyl-N-ethylcarbazole, described in JP-B-43-18674 and JP-B-43-19192, (r) polymers, such as polyacenaphthylene, polyindene, and an acenaphthylene-styrene copolymer, described in JP-B-43-19193, (s) condensed resins, such as pyrene-formaldehyde resin, bromopyrene-formaldehyde resin, and ethylcarbazole-formaldehyde resin, described, e.g., in JP-B-56-13940, and (t) triphenylmethane polymers described in JP-A-56-90833 and JP-A-56-161550.

The organic photoconductive compounds which can be used in the present invention are not limited to the above-described compounds (a) to (t), and any of known organic photoconductive compounds may be employed in the present invention. The organic photoconductive compounds may be used either individually or in combination of two or more thereof.

The sensitizing dyes which can be used in the photoconductive layer of (i) include those conventionally known as described, e.g., in *Denshishashin*, Vol. 12, p. 9 (1973) and *Yuki Gosei Kagaku*, Vol. 24, No. 11, p. 1010 (1966). Specific examples of suitable sensitizing dyes include pyrylium dyes described, e.g., in U.S. Pat. Nos. 3,141,770 and 4,283,475, JP-A-48-25658, and JP-A-62-71965; triarylmethane dyes described, e.g., in *Applied Optics Supplement*, Vol. 3, p. 50 (1969) and JP-A-50-39548; cyanine dyes described, e.g., in U.S. Pat. No. 3,597,196; and styryl dyes described, e.g., in JP-A-60-163047, JP-A-59-164588, and JP-A-60-252517.

The charge generating agents which can be used in the photoconductive layer of (ii) include various conventionally known charge generating agents, either organic or inorganic, such as selenium, seleniumtellurium, cadmium sulfide, zinc oxide, and organic pigments, for example, (1) azo pigments (including monoazo, bisazo, and trisazo pigments) described, e.g., in U.S. Pat. Nos. 4,436,800 and 4,439,506, JP-A-47-37543, JP-A-58-123541, JP-A-58-192042, JP-A-58-219263, JP-A-59-78356, JP-A-60-179746, JP-A-61-148453, JP-A-61-238063, JP-B-60-5941, and JP-B-60-45664, (2) metal-free or metallized phthalocyanine pigments described, e.g., in U.S. Pat. Nos. 3,397,086 and 4,666,802, JP-A-51-90827, and JP-A-52-55643, (3) perylene pigments described, e.g., in U.S. Pat. No. 3,371,884 and JP-A-47-30330, (4) indigo or thioindigo derivatives described, e.g., in British Patent 2,237,680 and JP-A-47-30331, (5) quinacridone pigments described, e.g., in British Patent 2,237,679 and JP-A-47-30332, (6) polycyclic quinone dyes described, e.g., in British Patent 2,237,678, JP-A-59-184348, JP-A-62-28738, and JP-A-47-18544, (7) bisbenzimidazole pigments described, e.g., in JP-A-47-30331 and JP-A-47-18543, (8) squarylium salt pigments described, e.g., in U.S. Pat. Nos. 4,396,610 and 4,644,082, and (9) azulenium salt pigments described, e.g., in JP-A-59-53850 and JP-A-61-212542.

These organic pigments may be used either individually or in combination of two or more thereof.

With respect to a mixing ratio of the organic photoconductive compound and a binder resin, particularly the upper limit of the organic photoconductive compound is determined depending on the compatibility between these materials. The organic photoconductive compound, if added in an amount over the upper limit, may undergo undesirable crystallization. The lower the content of the organic photoconductive compound, the lower the electrophotographic sensitivity. Accordingly, it is desirable to use the organic photoconductive compound in an amount as much as possible within such a range that crystallization does not occur in general, 5 to 120 parts by weight, and preferably from 10 to 100 parts by weight, of the organic photoconductive compound is used per 100 parts by weight of the total binder resins.

The binder resins which can be used in the light-sensitive element according to the present invention include those for conventionally known electrophotographic light-sensitive elements. A preferred weight average molecular weight of the binder resin is from $5\times10^3$ to $1\times10^6$, and particularly from $2\times10^4$ to $5\times10^5$. A preferred glass transition point of the binder resin is from −40° to 200° C., and particularly from −10° to 140° C.

Conventional binder resins which may be used in the present invention are described, e.g., in Takaharu Shibata and Jiro Ishiwatari, *Kobunshi*, Vol. 17, p. 278 (1968), Harumi Miyamoto and Hidehiko Takei, *Imaging*, Vol. 1973, No. 8, Koichi Nakamura (ed.), *Kiroku Zairyoyo Binder no Jissai Gijutsu*, Ch. 10, C.M.C. (1985), Denshishashin Gakkai (ed.), *Denshishashinyo Yukikankotai no Genjo Symposium* (preprint) (1985), Hiroshi Kokado (ed.), *Saikin no Kododen Zairyo to Kankotai no Kaihatsu.Jitsuyoka*, Nippon Kagaku Joho (1986), Denshishashin Gakkai (ed.), *Denshishashin Gijutsu no Kiso to Oyo*, Ch. 5, Corona (1988), D. Tatt and S. C. Heidecker, *Tappi*, Vol. 49, No. 10, p. 439 (1966), E. S. Baltazzi and R. G. Blanchlotte, et al., *Photo. Sci. Eng.*, Vol. 16, No. 5, p. 354 (1972), and Nguyen Chank Keh, Isamu Shimizu and Eiichi Inoue, *Denshi Shashin Gakkaishi*, Vol. 18, No. 2, p. 22 (1980).

Specific-examples of these known binder resins used include olefin polymers or copolymers, vinyl chloride copolymers, vinylidene chloride copolymers, vinyl alkanoate polymers or copolymers, allyl alkanoate polymers or copolymers, polymers or copolymers of styrene or derivatives thereof, butadiene-styrene copolymers, isoprene-styrene copolymers, butadiene-unsaturated carboxylic ester copolymers, acrylonitrile copolymers, methacrylonitrile copolymers, alkyl vinyl ether copolymers, acrylic ester polymers or copolymers, methacrylic ester polymers or copolymers, styreneacrylic ester copolymers, styrene-methacrylic ester copolymers, itaconic diester polymers or copolymers, maleic anhydride copolymers, acrylamide copolymers, methacrylamide copolymers, hydroxy-modified silicone resins, polycarbonate resins, ketone resins, polyester resins, silicone resins, amide resins, hydroxy- or carboxy-modified polyester resins, butyral resins, polyvinyl acetal resins, cyclized rubber-methacrylic ester copolymers, cyclized rubber-acrylic ester copolymers, copolymers containing a heterocyclic ring containing no nitrogen atom (the heterocyclic ring including furan, tetrahydrofuran, thiophene, dioxane, dioxofuran, lactone, benzofuran, benzothiophene and 1,3-dioxetane rings), and epoxy resins.

Further, the electrostatic characteristics of the photoconductive layer are improved by using, as a binder resin, a resin having a relatively low molecular weight (e.g., a weight average molecular weight of from $10^3$ to $10^4$) and containing an acidic group such as a carboxy group, a sulfo group or a phosphono group. For instance, JP-A-63-217354 discloses a resin having polymer components containing an acidic group at random in the polymer main chain, JP-A-64-70761 discloses a resin having an acidic group bonded at one terminal of the polymer main chain, JP-A-2-67563, JP-A-2-236561, JP-A-2-238458, JP-A-2-236562 and JP-A-2-247656 disclose a resin of graft type copolymer having an acidic group bonded at one terminal of the polymer main chain or a resin of graft type copolymer containing acidic groups in the graft portion, and JP-A-3-181948 discloses an AB block copolymer containing acidic groups as a block.

Moreover, in order to obtain a satisfactorily high mechanical strength of the photoconductive layer which may be insufficient by only using the low molecular weight resin, a medium to high molecular weight resin is preferably used together with the low molecular weight resin. For instance, JP-A-2-68561 discloses a thermosetting resin capable of forming crosslinked structures between polymers, JP-A-2-68562 discloses a resin partially having crosslinked structures, and JP-A-2-69759 discloses a resin of graft type copolymer having an acidic group bonded at one terminal of the polymer main chain. Also, in order to maintain the relatively stable performance even when ambient conditions are widely fluctuated, a specific medium to high molecular weight resin is employed in combination. For instance, JP-A-3-29954, JP-A-3-77954, JP-A-3-92861 and JP-A-3-53257 disclose a resin of graft type copolymer having an acidic group bonded at the terminal of the graft portion or a resin of graft type copolymer containing acidic groups in the graft portion. Moreover, JP-A-3-206464 and JP-A-3-223762 discloses a medium to high molecular weight resin of graft type copolymer having a graft portion formed from an AB block copolymer comprising an A block containing acidic groups and a B block containing no acidic group.

In a case of using these resins, the photoconductive substance is uniformly dispersed to form a photoconductive layer having good smoothness. Also, excellent electrostatic characteristics can be maintained even when ambient conditions are fluctuated or when a scanning exposure system using a semiconductor laser beam is utilized for the image exposure.

The photoconductive layer usually has a thickness of from 1 to 100 μm, and preferably from 10 to 50 μm.

Where a photoconductive layer functions as a charge generating layer of a laminated type light-sensitive element composed of a charge generating layer and a charge transporting layer, the charge generating layer has a thickness of from 0.01 to 5 μm, and preferably from 0.05 to 2 μm.

Depending on the kind of a light source for exposure, for example, visible light or semiconductor laser beam, various dyes may be used as spectral sensitizers. The sensitizing dyes used include carbonium dyes, diphenylmethane dyes, triphenylmethane dyes, xanthene dyes, phthalein dyes, polymethine dyes (including oxonol dyes, merocyanine dyes, cyanine dyes, rhodacyanine dyes, and styryl dyes), and phthalocyanine dyes (including metallized dyes), as described e.g., in Harumi Miyamoto and Hidehiko Takei, *Imaging*, Vol. 1973, No. 8, p. 12, C. J. Young et al., *RCA Review*, Vol. 15, p. 469 (1954), Kohei Kiyota et al., *Denkitsushin Gakkai Ronbunshi*, Vol. J 63-C, No. 2, p. 97 (1980), Yuji Harasaki et al., *Kogyo Kagaku Zasshi*, Vol. 66, p. 78 and 188 (1963), and Tadaaki Tani, *Nihon Shashin Gakkaishi*, Vol. 35, p. 208 (1972).

Specific examples of carbonium dyes, triphenylmethane dyes, xanthene dyes, and phthalein dyes are described, e.g., in JP-B-51-452, JP-A-50-90334, JP-A-50-114227, JP-A-53-39130, JP-A-53-82353, U.S. Pat. Nos. 3,052,540 and 4,054,450, and JP-A-57-16456.

Usable polymethine dyes, such as oxonol dyes, merocyanine dyes, cyanine dyes, and rhodacyanine dyes, are described in F. M. Hamer, *The Cyanine Dyes and Related Compounds*. Specific examples of these dyes are described, e.g., in U.S. Pat. Nos. 3,047,384, 3,110,591, 3,121,008, 3,125,447, 3,128,179, 3,132,942, and 3,622,317, British Patents 1,226,892, 1,309,274, and 1,405,898, JP-B-48-7814, and JP-B-55-18892.

Further, polymethine dyes capable of performing spectral sensitization in the near infrared to infrared region of 700 nm or more include those described, e.g., in JP-A-47-840, JP-A-47-44180, JP-B-51-41061, JP-A-49-5034, JP-A-49-45122, JP-A-57-46245, JP-A-56-35141, JP-A-57-157254, JP-A-61-26044, JP-A-61-27551, U.S. Pat. Nos. 3,619,154 and 4,175,956, and *Research Disclosure*, No. 216, pp. 117–118 (1982).

The light-sensitive element of the present invention is excellent in that the characteristics thereof hardly vary with the combined use of various sensitizing dyes.

If desired, the light-sensitive element may further contain various additives conventionally known for electrophotographic light-sensitive elements. The additives include chemical sensitizers for increasing electrophotographic sensitivity and plasticizers or surface active agents for improving film properties.

Suitable examples of the chemical sensitizers include electron attracting compounds such as a halogen, benzoquinone, chloranil, fluoranil, bromanil, dinitrobenzene, anthraquinone, 2,5-dichlorobenzoquinone, nitrophenol, tetrachlorophthalic anhydride, phthalic anhydride, maleic anhydride, N-hydroxymaleimide, N-hydroxyphthalimide, 2,3-dichloro-5,6-dicyanobenzoquinone, dinitrofluorenone, trinitrofluorenone, tetracyanoethylene, nitrobenzoic acid, and dinitrobenzoic acid; and polyarylalkane compounds, hindered phenol compounds and p-phenylenediamine compounds as described in the literature references cited in Hiroshi Kokado, et al., *Saikin no Kododen Zairyo to Kankotai no Kaihatsu.Jitsuyoka*, Chs. 4 to 6, Nippon Kagaku Joho (1986). In addition, the compounds as described in JP-A-58-65439, JP-A-58-102239, JP-A-58-129439, and JP-A-62-71965 may also be used.

Suitable examples of the plasticizers, which may be added for improving flexibility of a photoconductive layer, include dimethyl phthalate, dibutyl phthalate, dioctyl phthalate, diphenyl phthalate, triphenyl phosphate, diisobutyl adipate, dimethyl sebacate, dibutyl sebacate, butyl laurate, methyl phthalyl glycolate, and dimethyl glycol phthalate. The plasticizer can be added in an amount that does not impair electrostatic characteristics of the photoconductive layer.

The amount of the additive to be added is not particularly limited, but ordinarily ranges from 0.001 to 2.0 parts by weight per 100 parts by weight of the photoconductive substance.

The photoconductive layer of the present invention can be provided on a conventionally known support. In general, a support for an electrophotographic light-sensitive layer is preferably electrically conductive. The electrically conductive support which can be used includes a substrate (e.g., a metal plate, paper, or a plastic sheet) having been rendered conductive by impregnation with a low-resistant substance, a substrate whose back side (opposite to the light-sensitive layer side) is rendered conductive and further having coated thereon at least one layer for, for example, curling prevention, the above-described substrate having formed on the surface thereof a water-resistant adhesive layer, the above-described substrate having on the surface thereof at least one precoat layer, and a paper substrate laminated with a plastic film on which aluminum, etc. has been vacuum deposited.

Specific examples of the conductive substrate and materials for rendering non-conductive substrates electrically conductive are described, for example, in Yukio Sakamoto, *Denshishashin*, Vol. 14, No. 1, pp. 2–11 (1975), Hiroyuki Moriga, *Nyumon Tokushushi no Kagaku*, Kobunshi Kankokai (1975), and M. F. Hoover, *J. Macromol. Sci. Chem.*, Vol. A-4, No. 6, pp. 1327–1417 (1970).

After the formation of peelable transfer layer on the surface of electrophotographic light-sensitive element in the presence of the compound (S) as described above, the resulting light-sensitive material is subjected to the formation of toner image. For the formation of toner image, a conventional electrophotographic process can be utilized. Specifically, each step of charging, light exposure, development and fixing is performed in a conventionally known manner. Particularly, a combination of a scanning exposure system using a laser beam based on digital information and a development system using a liquid developer is an advantageous process in order to form highly accurate images.

In order to form the toner image by an electrophotographic process according to the present invention, any methods and apparatus conventionally known can be employed.

The developers which can be used in the present invention include conventionally known developers for electrostatic photography, either dry type or liquid type. For example, specific examples of the developer are described in *Denshishashin Gijutsu no Kiso to Oyo*, supra, pp. 497–505, Koichi Nakamura (ed.), *Toner Zairyo no Kaihatsu.Jitsuyoka*, Ch. 3, Nippon Kagaku Joho (1985), Gen Machida, *Kirokuyo Zairyo to Kankosei Jushi*, pp. 107–127 (1983), and Denshishashin Gakkai (ed.), *Imaging*, Nos. 2–5, "Denshishashin no Genzo.Teichaku.Taiden.Tensha", Gakkai Shuppan Center.

Dry developers practically used include one-component magnetic toners, two-component toners, one-component non-magnetic toners, and capsule toners. Any of these dry developers may be employed in the present invention.

The typical liquid developer is basically composed of an insulating organic solvent, for example, an isoparaffinic aliphatic hydrocarbon (e.g., Isopar H or Isopar G (manufactured by Esso Chemical Co.), Shellsol 70 or Shellsol 71 (manufactured by Shell Oil Co.) or IP-Solvent 1620 (manufactured by Idemitsu Petro-Chemical Co., Ltd.)) as a dispersion medium, having dispersed therein a colorant (e.g., an organic or inorganic dye or pigment) and a resin for imparting dispersion stability, fixability, and chargeability to the developer (e.g., an alkyd resin, an acrylic resin, a polyester resin, a styrene-butadiene resin, and rosin). If desired, the liquid developer can contain various additives for enhancing charging characteristics or improving image characteristics.

The colorant is appropriately selected from known dyes and pigments, for example, benzidine type, azo type, azomethine type, xanthene type, anthraquinone type, phthalocyanine type (including metallized type), titanium white, nigrosine, aniline black, and carbon black.

Other additives include, for example, those described in Yuji Harasaki, *Denshishashin*, Vol. 16, No. 2, p. 44, such as di-2-ethylhexylsufosuccinic acid metal salts, naphthenic acid metal salts, higher fatty acid metal salts, alkylbenzenesulfonic acid metal salts, alkylphosphoric acid metal salts, lecithin, polyvinylpyrrolidone, copolymers containing a maleic acid monoamido component, coumarone-indene resins, higher alcohols, polyethers, polysiloxanes, and waxes.

With respect to the content of each of the main components of the liquid developer, toner particles mainly comprising a resin (and, if desired, a colorant) are preferably present in an amount of from 0.5 to 50 parts by weight per 1000 parts by weight of a carrier liquid. If the toner content is less than 0.5 part by weight, the image density is insufficient, and if it exceeds 50 parts by weight, the occurrence of fog in the non-image areas may be tended to.

If desired, the above-described resin for dispersion stabilization which is soluble in the carrier liquid is added in an amount of from about 0.5 to about 100 parts by weight per 1000 parts by weight of the carrier liquid. The above-described charge control agent can be preferably added in an amount of from 0.001 to 1.0 part by weight per 1000 parts by weight of the carrier liquid. Other additives may be added to the liquid developer, if desired. The upper limit of the total amount of other additives is determined, depending on electrical resistance of the liquid developer. Specifically, the amount of each additive should be controlled so that the liquid developer exclusive of toner particles has an electrical resistivity of not less than $10^9$ Ωcm. If the resistivity is less than $10^9$ Ωcm, a continuous gradation image of good quality can hardly be obtained.

The liquid developer can be prepared, for example, by mechanically dispersing a colorant and a resin in a dispersing machine, e.g., a sand mill, a ball mill, a jet mill, or an attritor, to produce colored particles, as described, for example, in JP-B-35-5511, JP-B-35-13424, JP-B-50-40017, JP-B-49-98634, JP-B-58-129438, and JP-A-61-180248.

The colored particles may also be obtained by a method comprising preparing dispersed resin grains having a fine grain size and good monodispersity in accordance with a non-aqueous dispersion polymerization method and coloring the resulting resin grains. In such a case, the dispersed grains prepared can be colored by dyeing with an appropriate dye as described, e.g., in JP-A-57-48738, or by chemical bonding of the dispersed grains with a dye as described, e.g., in JP-A-53-54029. It is also effective to polymerize a monomer already containing a dye at the polymerization granulation to obtain a dye-containing copolymer as described, e.g., in JP-B-44-22955.

The heat-transfer of the toner image together with the transfer layer onto a receiving material can be performed using known methods and apparatus.

An example of apparatus suitable for transferring the transfer layer with the tone image thereon to a receiving material is composed of a pair of rollers covered with rubber each containing therein a heating means which are driven with a predetermined nip pressure applied. The surface temperature of rollers is preferable in a range of from 50° to 150° C., and more preferably from 80° to 120° C., the nip pressure between rollers is preferably in a range of from 0.2 to 20 Kgf/cm$^2$, and more preferably from 0.5 to 10 Kgf/cm$^2$, and the transportation speed is preferably in a range of from 0.1 to 100 mm/sec, and more preferably from 1 to 30 mm/sec. As a matter of course, these conditions should be optimized according to the physical properties of the transfer layer and light-sensitive element of the light-sensitive material and the receiving material each employed.

The temperature of roller surface is preferably maintained within a predetermined range by means of a surface temperature detective means and a temperature controller. A pre-heating means and a cooling means for the light-sensitive material may be provided in front of and at the rear of the heating roller portion, respectively. Further, as a means for pressing two rollers, a pair of springs provided at both ends of the shaft of at least one roller or an air cylinder using compressed air may be employed.

The receiving material used in the present invention is any of material which provide a hydrophilic surface suitable for lithographic printing. Supports conventionally used for offset printing plates (lithographic printing plates) can be preferably employed. Specific examples of support include a substrate having a hydrophilic surface, for example, a plastic sheet, paper having been rendered durable to printing, an aluminum plate, a zinc plate, a bimetal plate, e.g., a copper-aluminum plate, a copper-stainless steel plate, or a chromium-copper plate, a trimetal plate, e.g., a chromium-copper-aluminum plate, a chromium-lead-iron plate, or a chromium-copper-stainless steel plate. The support preferably has a thickness of from 0.1 to 3 mm, and particularly from 0.1 to 1 mm.

A support with an aluminum surface is preferably subjected to a surface treatment, for example, surface graining, immersion in an aqueous solution of sodium silicate, potassium fluorozirconate or a phosphate, or anodizing. Also, an aluminum plate subjected to surface graining and then immersion in a sodium silicate aqueous solution as described in U.S. Pat. No. 2,714,066, or an aluminum plate subjected to anodizing and then immersion in an alkali silicate aqueous solution as described in JP-B-47-5125 is preferably employed.

Anodizing of an aluminum surface can be carried out by electrolysis of an electrolytic solution comprising at least one aqueous or nonaqueous solution of an inorganic acid (e.g., phosphoric acid, chromic acid, sulfuric acid or boric acid) or an organic acid (e.g., oxalic acid or sulfamic acid) or a salt thereof to oxidize the aluminum surface as an anode.

Silicate electrodeposition as described in U.S. Pat. No. 3,658,662 or a treatment with polyvinylsulfonic acid described in West German Patent Application (OLS) 1,621,478 is also effective.

The surface treatment is conducted not only for rendering the surface of a support hydrophilic, but also for improving adhesion of the support to the transferred toner image.

Further, in order to control an adhesion property between the support and the transfer layer having provided thereon the toner image, a surface layer may be provided on the surface of the support.

A plastic sheet or paper as the support should have a hydrophilic surface layer, as a matter of course, since its areas other than those corresponding to the toner images must be hydrophilic. Specifically, a receiving material having the same performance as a known direct writing type lithographic printing plate precursor or an image-receptive layer thereof may be employed.

Now, the step of removing the transfer layer transferred on the receiving material will be described below. In order to remove the transfer layer, an appropriate means can be selected in consideration of a chemical reaction treatment upon which a resin used in the transfer layer is removed. For instance, an alkaline processing solution is employed when the resin is a kind of resin which is soluble in an aqueous alkaline solution.

The alkaline processing solution used for removing the transfer layer is not particularly limited as far as it has a pH of not less than 8. A pH of 9 or higher is preferred in order to conduct the removal of transfer layer rapidly and efficiently. The alkaline processing solution can be prepared by using any of conventionally known inorganic or organic compounds, for example, carbonates, sodium hydroxide, potassium hydroxide, potassium silicate, sodium silicate and organic amine compounds, either individually or in combination thereof. Known pH control agents may also be employed in order to adjust the pH of solution.

The processing solution may further contain other compounds. For example, a water-soluble organic solvent may be used in a range of from about 1 to about 50 parts by weight per 100 parts by weight of water. Suitable examples of the water-soluble organic solvent include alcohols (e.g., methanol, ethanol, propanol, propargyl alcohol, benzyl alcohol, and phenethyl alcohol), ketones (e.g., acetone, methyl ethyl ketone, cyclohexanone and acetophenone), ethers (e.g., dioxane, trioxane, tetrahydrofuran, ethylene glycol dimethyl ether, propylene glycol diethyl ether, ethylene glycol monomethyl ether, propylene glycol monomethyl ether, and tetrahydropyran), amides (e.g., dimethylformamide, pyrrolidone, N-methylpyrrolidone, and dimethylacetamide) esters (e.g., methyl acetate, ethyl acetate, and ethyl formate), sulforan and tetramethylurea. These organic solvents may be used either individually or in combination of two or more thereof.

The processing solution may contain a surface active agent in an amount ranging from about 0.1 to about 20 parts by weight per 100 parts of weight of the processing solution. Suitable examples of the surface active agent include conventionally known anionic, cationic or nonionic surface active agents, such as the compounds as described, for example, in Hiroshi Horiguchi, *Shin Kaimen Kasseizai*, Sankyo Shuppan (1975) and Ryohei Oda and Kazuhiro Teramura, *Kaimen Kasseizai no Gosei to Sono Oyo*, Maki Shoten (1980). Moreover, conventionally known antiseptic compounds and antimoldy compounds are employed in appropriate amounts in order to improve the antiseptic property and antimoldy property of the processing solution during preservation.

With respect to the conditions of the treatment, a temperature of from about 15° to about 60° C., and an immersion time of from about 10 seconds to about 5 minutes are preferred.

When the resin used is a kind of resin which reveals a hydrophilic property upon a chemical reaction, treatment with a processing solution or treatment with irradiation of actinic ray can be employed for removal the transfer layer.

In order to effect the removal by a chemical reaction with a processing solution, an aqueous solution which is adjusted to the prescribed pH is used. Known pH control agents can be employed to adjust the pH of solution. While the pH of the processing solution used may be any of acidic, neutral and alkaline region, the processing solution is preferably employed in a neutral to alkaline region taking account of an anticorrosive property and a property of dissolving the transfer layer. The alkaline processing solution can be prepared by using any of conventionally known organic or inorganic compounds, such as carbonates, sodium hydroxide, potassium hydroxide, potassium silicate, sodium silicate, and organic amine compounds, either individually or in combination thereof.

The processing solution may contain a hydrophilic compound which contains a substituent having a Pearson's nucleophilic constant n (refer to R. G. Pearson and H. Sobel, *J. Amer. Chem. Soc.*, Vol. 90, p. 319 (1968)) of not less than 5.5 and has a solubility of at least 1 part by weight in 100 parts by weight of distilled water, in order to accelerate the reaction for rendering hydrophilic.

Suitable examples of such hydrophilic compounds include hydrazines, hydroxylamines, sulfites (e.g., ammonium sulfite, sodium sulfite, potassium sulfite or zinc sulfite), thiosulfates, and mercapto compounds, hydrazide compounds, sulfinic acid compounds and primary or secondary amine compounds each containing at least one polar group selected from a hydroxyl group, a carboxyl group, a sulfo group, a phosphono group and an amino group in the molecule thereof.

Specific examples of the polar group-containing mercapto compounds include 2-mercaptoethanol, 2-mercaptoethylamine, N-methyl-2-mercaptoethylamine, N-(2-hydroxyethyl)-2-mercaptoethylamine, thioglycolic acid, thiomalic acid, thiosalicylic acid, mercaptobenzenecarboxylic acid, 2-mercaptotoluensulfonic acid, 2-mercaptoethylphosphonic acid, mercaptobenzenesulfonic acid, 2-mercaptopropionylaminoacetic acid, 2-mercapto-1-aminoacetic acid, 1-mercaptopropionylaminoacetic acid, 1,2-dimercaptopropionylaminoacetic acid, 2,3-dihydroxypropylmercaptan, and 2-methyl-2-mercapto-1-aminoacetic acid. Specific examples of the polar group-containing sulfinic acid compounds include 2-hydroxyethylsulfinic acid, 3-hydroxypropanesulfinic acid, 4-hydroxybutanesulfinic acid, carboxybenzenesulfinic acid, and dicarboxybenzenesulfinic acid. Specific examples of the polar group-containing hydrazide compounds include 2-hydrazinoethanolsulfonic acid, 4-hydrazinobutanesulfonic acid, hydrazinobenzenesulfonic acid, hydrazinobenzenesulfonic acid, hydrazinobenzoic acid, and hydrazinobenzenecarboxylic acid. Specific examples of the polar group-containing primary or secondary amine compounds include N-(2-hydroxyethyl)amine, N, N-di(2-hydroxyethyl)amine, N,N-di(2-hydroxyethyl)ethylenediamine, tri(2-hydroxyethyl)ethylenediamine, N-(2,3-dihydroxypropyl)amine, N,N-di(2,3-dihydroxypropyl)amine, 2-aminopropionic acid, aminobenzoic acid, aminopyridine, aminobenzenedicarboxylic acid, 2-hydroxyethylmorpholine, 2-carboxyethylmorpholine, and 3-carboxypiperazine.

The amount of the nucleophilic compound present in the processing solution is preferably from 0.05 to 10 mol/l, and more preferably from 0.1 to 5 mol/l. The pH of the processing solution is preferably not less than 4.

The processing solution may contain other compounds in addition to the pH control agent and nucleophilic compound described above. For example, organic solvents soluble in water, surface active agents, antiseptic compounds and antimoldy compounds each illustrated with respect to the alkaline processing solution described hereinbefore may be employed. The amounts of such additives are same as those described above.

With respect to the conditions of the treatment, a temperature of from about 15° to about 60° C., and an immersion time of from about 10 seconds to about 5 minutes are preferred.

The treatment with the processing solution may be combined with a physical operation, for example, application of ultrasonic wave or mechanical movement (such as rubbing with a brush).

Actinic ray which can be used for decomposition to render the transfer layer hydrophilic upon the irradiation treatment includes any of visible light, ultraviolet light, far ultraviolet light, electron beam, X-ray, γ-ray, and α-ray, with ultraviolet light being preferred. More preferably rays having a wavelength range of from 310 to 500 nm are used. As a light source, a high-pressure or ultrahigh-pressure mercury lamp is ordinarily utilized. Usually, the irradiation treatment can be sufficiently carried out from a distance of from 5 to 50 cm for a period of from 10 seconds to 10 minutes. The thus irradiated transfer layer is then soaked in an aqueous solution whereby the transfer layer is easily removed.

One example of method for preparing a printing plate is illustrated below. An electrophotographic light-sensitive material is positioned on a flat bed by a register pin system and fixed on the flat bed by air suction from the backside. Then it is charged by means of a charging device, for example, the device as described in Denshishashin Gakkai (ed.), *Denshishashin Gijutsu no Kiso to Oyo*, p. 212 et seg., Corona Sha (1988). A corotron or scotron system is usually used for the charging process. In a preferred charging process, the charging conditions may be controlled by a feedback system of the information on charged potential from a detector connected to the light-sensitive material thereby to control the surface potential within a predetermined range.

Thereafter, the charged light-sensitive material is exposed to light by scanning with a laser beam in accordance with the system described, for example, in ibidem, p. 254 et seq.

Toner development is then conducted using a liquid developer. The light-sensitive material charged and exposed is removed from the flat bed and developed according to the direct wet type developing method as described, for example, in ibidem, p. 275 et seq. The exposure mode is determined in accord with the toner image development mode. Specifically, in case of reversal development, a negative image is irradiated with a laser beam, and a toner having the same charge polarity as that of the charged light-sensitive material is electrodeposited on the exposed area with a bias voltage applied. For the details, reference can be made to ibidem, p. 157 et seq.

After the toner development, the light-sensitive material is squeezed to remove the excess developer as described in ibidem, p. 283 and dried. Preferably, the light-sensitive material may be rinsed with the carrier liquid used in the liquid developer before squeezing.

The thus-formed toner image on the light-sensitive material is then heat-transferred to a receiving material together with the transfer layer thereof.

The transfer layer transferred on the receiving material is then subjected to a chemical reaction treatment, through which the transfer layer is dissolved or swollen and then/eliminated, whereby the transfer layer is completely removed to prepare an offset printing plate.

The method for preparation of a printing plate by an electrophotographic process according to the present invention will be described as well as a plate-making apparatus useful for carrying out the method with reference to the accompanying drawings, hereinbelow.

Figure 2:
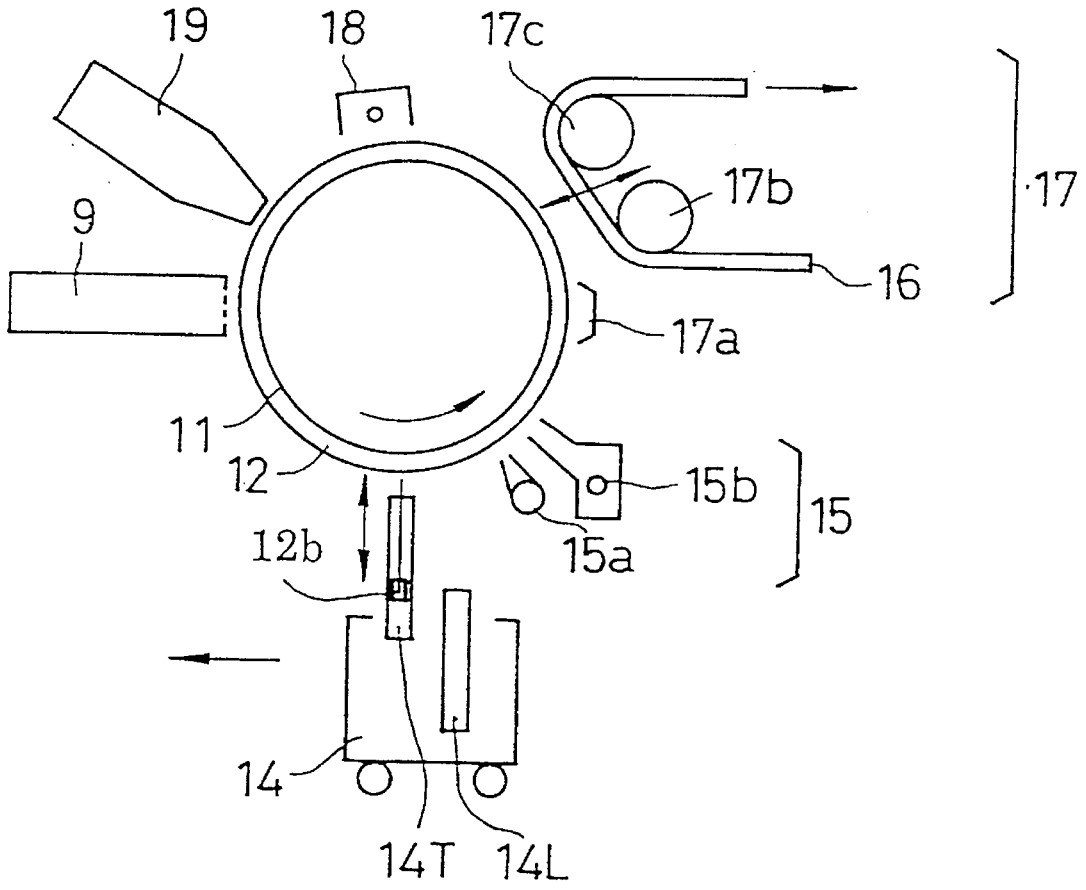
FIG. 2 is a schematic view of an electrophotographic plate-making apparatus using an electrodeposition coating method for the formation of transfer layer.

FIG. 2 is a schematic view of an electrophotographic plate-making apparatus suitable for carrying out the method of the present invention. In this example, the transfer layer is formed by the electrodeposition coating method.

An applying unit 9 for applying the compound (S) according to the present invention onto the surface of electrophotographic light-sensitive element can be either fixed or movable.

A dispersion **12*b* of resin grains is supplied to an electrodeposition unit 14T provided in a movable liquid developing unit set 14**.

The compound (S) is first supplied on the surface of light-sensitive element 11 from the applying unit 9 for the compound (S). The electrodeposition unit 14T is then brought near the surface of the light-sensitive element 11 and is kept stationary with a gap of 1 mm therebetween. The light-sensitive element 11 is rotated while supplying the dispersion **12*b* of resin grains into the gap and applying an electric voltage across the gap from an external power source (not shown), whereby the grains are deposited over the entire image-forming areas of the surface of the light-sensitive element 11**.

The dispersion **12*b* of thermoplastic resin grains excessively adhered to the surface of the light-sensitive element 11 is removed by a squeezing device built in the electrodeposition unit 14T, and the light-sensitive element is dried by passing under the suction/exhaust unit 15. Then the resin grains are fused by the pre-heating means 17*a* and thus a transfer layer 12** in the form of resin film is obtained.

Thereafter the transfer layer is cooled to a predetermined temperature, if desired, from an outside of the light-sensitive element or from an inside of the drum of the light-sensitive element by a cooling device which is similar to the suction/exhaust unit 15, although not shown.

After moving away the electrodeposition unit 14T, the liquid developing unit set 14 is posited. The unit set 14 is provided with a liquid developing unit **14*a*** containing a liquid developer. The unit may be provided, if desired, with a pre-bathing means, a rinsing means and/or a squeeze means in order to prevent stains of the non-image portions. As the pre-bathing solution and the rinse solution, a carrier liquid for the liquid developer is generally used.

The light-sensitive element 11 bearing thereon the transfer layer 12 of the resin is then subjected to the electrophotographic process. Specifically, when it is uniformly charged to, for instance, a positive polarity by a corona charger 18 and then is exposed imagewise by an exposure device (e.g., a semi-conductor laser) 19 on the basis of image information, the potential is lowered in the exposed regions and thus, a contrast in potential is formed between the exposed regions and the unexposed regions. The liquid developing unit 14L containing a liquid developer having a positive electrostatic charge of the liquid developing unit set 14 is brought near the surface of the light-sensitive element 11 and is kept stationary with a gap of 1 mm therebetween.

The light-sensitive material is first pre-bathed by a pre-bathing means provided in the developing unit set, and then the liquid developer is supplied on the surface of the light-sensitive material while applying a developing bias voltage between the light-sensitive material and a development electrode by a bias voltage source and wiring (not shown). The bias voltage is applied so that it is slightly lower than the surface potential of the unexposed regions, while the development electrode is charged to positive and the light-sensitive material is charged to negative. When the bias voltage applied is too low, a sufficient density of the toner image cannot be obtained.

The liquid developer is subsequently washed off by a rinsing means of the developing unit set and the rinse solution adhering to the surface of the light-sensitive material is removed by a squeeze means. Then, the light-sensitive material is dried by passing under the suction/exhaust unit 15. Meanwhile a heat transfer means 17 is kept away from the surface of the light-sensitive material.

After the toner image is formed on the transfer layer, the transfer layer is pre-heated by a pre-heating means 17*a* and is pressed against a rubber roller 17*b* having therein a heater with a temperature control means with the receiving material 16 intervening therebetween. The transfer layer and the receiving material are then passed under a cooling roller 17*c*, thereby heat-transferring the toner image to the receiving material 16 together with the transfer layer 12. Thus a cycle of steps is terminated.

The heat transfer means 17 for heating-transferring the transfer layer to the receiving material comprises the pre-heating means 17*a*, the heating roller 17*b* which is in the form of a metal roller having therein a heater and is covered with rubber, and the cooling roller 17*c*. As the pre-heating means 17*a*, a non-contact type heater such as an infrared line heater, a flash heater or the like is used, and the transfer layer is pre-heated in a range below a temperature of the surface of the light-sensitive material achieved with heating by the heating roller 17*b*. The surface temperature of light-sensitive material heated by the heating roller 17*b* is preferably in a range of from 50° to 150° C., and more preferably from 80° to 120° C.

The cooling roller 17*c* comprises a metal roller which has a good thermal conductivity such as aluminum, copper or the like and is covered with silicone rubber. It is preferred that the cooling roller 17*c* is provided with a cooling means therein or on a portion of the outer surface which is not brought into contact with the receiving material in order to radiate heat. The cooling means includes a cooling fan, a coolant circulation or a thermoelectric cooling element, and it is preferred that the cooling means is coupled with a temperature controller so that the temperature of the cooling roller 17*c* is maintained within a predetermined range.

The nip pressure of the rollers is preferably in a range of from 0.2 to 20 kgf/cm$^2$ and more preferably from 0.5 to 15 kgf/cm$^2$. Although not shown, the rollers may be pressed by springs provided on opposite ends of the roller shaft or by an air cylinder using compressed air.

A speed of the transportation is suitably in a range of from 0.1 to 100 mm/sec and preferably in a range of from 1 to 30 mm/sec. The speed of transportation may differ between the electrophotographic process and the heat transfer step.

By stopping the apparatus in the state where the transfer layer has been formed, the next operation can start with the electrophotographic process. Further the transfer layer acts to protect the light-sensitive layer and prevent the properties of the light-sensitive layer from deteriorating due to environmental influence.

It is needless to say that the above-described conditions should be optimized depending on the physical properties of the transfer layer, the light-sensitive element (i.e., the light-sensitive layer and the support) and the receiving material. Especially it is important to determine the conditions of pre-heating, roller heating and cooling in the heat transfer step taking into account the factors such as glass transition point, softening temperature, flowability, tackiness, film properties and film thickness of the transfer layer. Specifically, the conditions should be set so that the tackiness of the transfer layer increases and the transfer layer is closely adhered to the receiving material when the transfer layer softened to a certain extent by the pre-heating means passes the heating roller, and so that the temperature of the transfer layer is decreased to reduce the flowability and the tackiness after the transfer layer subsequently passes the cooling roller and thus the transfer layer is peeled as a film from the surface of the light-sensitive element together with the toner thereon.

Thereafter the transfer layer on the receiving material is subjected to a chemical reaction treatment to remove the transfer layer by dissolution or swell and release thereby obtaining an offset printing plate.

Figure 3:
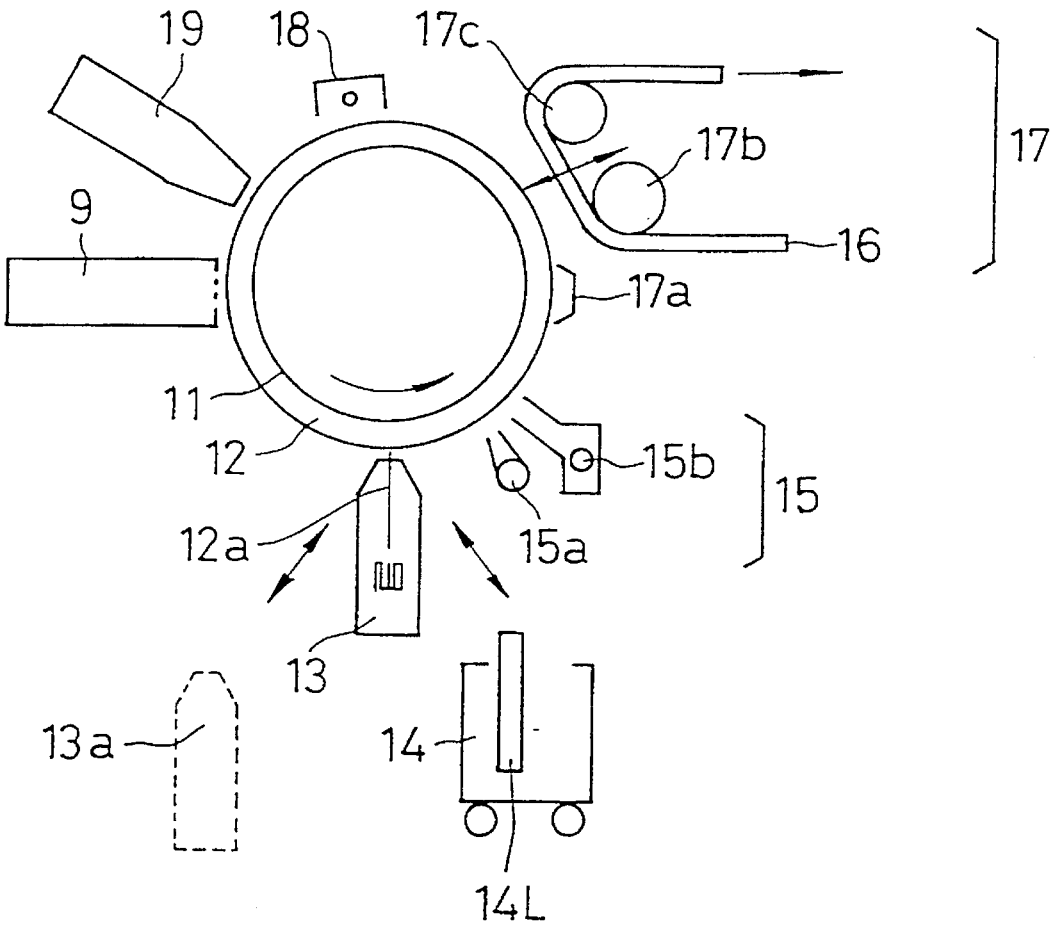
FIG. 3 is a schematic view of an electrophotographic plate-making apparatus using a hot-melt coating method for the formation of transfer layer.

FIG. 3 is a schematic view of another electrophotographic plate making apparatus suitable for carrying out the method of the present invention. In this example, the transfer layer is formed by the hot-melt coating method. The apparatus of FIG. 3 has essentially the same constitution as the apparatus (FIG. 2) used in the electrodeposition coating method described above except for a means for forming the transfer layer on the surface of light-sensitive element.

After the compound (S) is applied onto the surface of light-sensitive element 11 by an applying unit 9, resin 12*a* for forming the transfer layer is coated on the surface of light-sensitive element 11 provided on the peripheral surface of a drum by a hot-melt coater 13 and is caused to pass under a suction/exhaust unit 15 to be cooled to a predetermined temperature to form te transfer layer. After the hot-melt coater 13 is moved to the stand-by position indicated as 13*a*, a liquid developing unit set 14 is moved to the position where the hot-melt coater 13 was. The unit set 14 is provided with a liquid developing unit 14L containing a liquid developer.

Then the electrophotographic process and the transfer process are subsequently effected. These processes are the same as those described above in conjunction with the example where the electrodeposition coating method is used. Also, other conditions related to the apparatus are the same as those described above.

Figure 4:
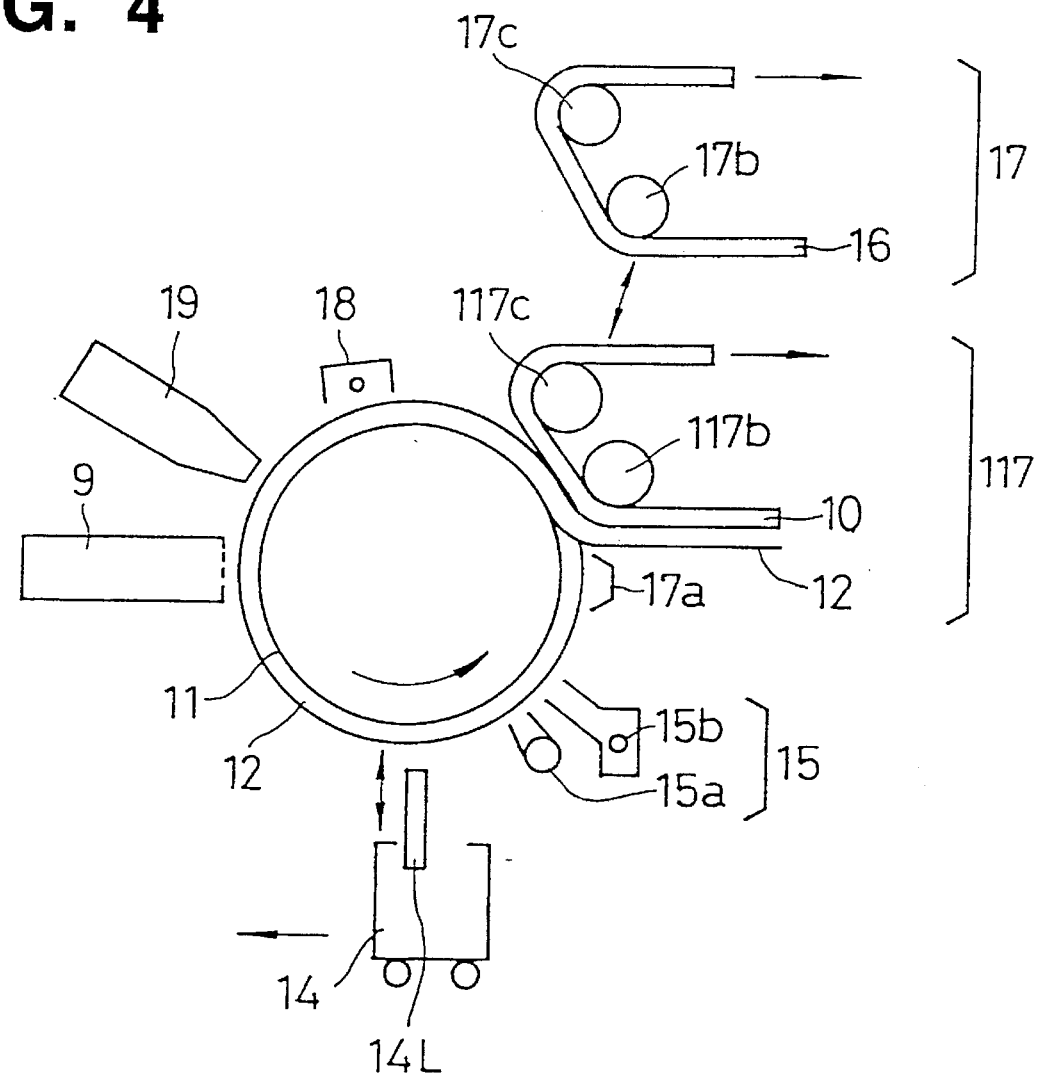
FIG. 4 is a schematic view of an electrophotographic plate-making apparatus using a transfer method for the formation of transfer layer.

FIG. 4 is a schematic view of still another electrophotographic plate making apparatus suitable for carrying out the method of the present invention. In this example, the transfer layer is formed by the transfer method.

The apparatus of FIG. 4 has essentially the same constitution as the apparatus (FIG. 2) used in the electrodeposition coating method described above except for a means for forming the transfer layer on the surface of light-sensitive element. The electrophotographic process, the transfer process and the conditions thereof performed after forming the transfer layer 12 on the surface of light-sensitive element 11 are also the same as those described above.

In FIG. 4, release paper 10 having thereon the transfer layer 12 comprising the resin (A) is heat-pressed on the light-sensitive element 11 by a heating roller 117*b*, thereby the transfer layer 12 being transferred on the surface of light-sensitive element 11. The release paper 10 is cooled by a cooling roller 117*c* and recovered. The light-sensitive element is heated by a pre-heating means 17*a* to improve transferability of the transfer layer 12 upon heat-press, if desired.

In FIG. 4, the apparatus separately provided with a transfer means 117 for transferring the transfer layer 12 from release paper 10 onto the light-sensitive element 11 and a transfer means 17 for transferring the transfer layer having a toner image thereon onto the receiving material 16 is shown. However, a method wherein the transfer layer 12 is first transferred from the release paper 10 to the light-sensitive element using the transfer means 117, a toner image is formed thereon by an electrophotographic process and then the toner image is transferred to the receiving material 16 together with the transfer layer using again the transfer means 117 while now supplying the receiving material 16 can also be employed.

When the transfer layer of integrated layered type is employed in the present invention, they can be formed using two or more transfer layer-forming devices which may be the same or different from each other.

The method for preparation of a printing plate by an electrophotographic process according to the present invention can provide a printing plate excellent in image qualities of plate-making and printing, and continuously produce such printing plates in a stable manner for a long period of time and which is suitable for a scanning exposure system using a laser beam.

Further, according to the present invention, the transfer layer is easily prepared on a light-sensitive element on demand in an apparatus and the light-sensitive element is repeatedly usable, thereby reducing a running cost.

The present invention is illustrated in greater detail with reference to the following examples, but the present invention is not to be construed as being limited thereto.

Synthesis Examples of Resin Grain (AR):

SYNTHESIS EXAMPLE 1 OF RESIN GRAIN (ARH): (ARH-1)

A mixed solution of 16 g of Dispersion Stabilizing Resin (Q-1) having the structure shown below and 550 g of Isopar H was heated to a temperature of 50° C. under nitrogen gas stream while stirring.

Dispersion Stabilizing Resin (Q-1)

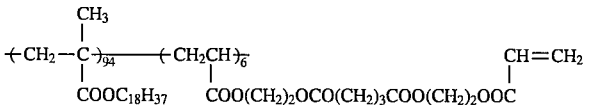

Mw $5\times10^4$

To the solution was dropwise added a mixed solution of 85.5 g of benzyl methacrylate, 12.5 g of acrylic acid, 2.0 g of methyl 3-mercaptopropionate and 1.2 g of 2,2'-azobis(2-cyclopropylpropionitrile) (abbreviated as ACPP) over a period of one hour, followed by stirring for one hour. To the reaction mixture was added 0.8 g of ACPP, followed by reacting for 2 hours. Further, 0.5 g of 2,2'-azobis-(isobutyronitrile) (abbreviated as AIBN) was added thereto, the reaction temperature was adjusted to 80° C., and the reaction was continued for 3 hours. After cooling, the reaction mixture was passed through a nylon cloth of 200 mesh to obtain a white dispersion which was a latex of goof monodispersity with a polymerization ratio of 97% and an average grain diameter of 0.17 μm. The grain diameter was measured by CAPA-500 manufactured by Horiba Ltd. (hereinafter the same).

A part of the white dispersion was centrifuged at a rotation of $1\times10^4$ r.p.m. for 60 minutes and the resin grains precipitated were collected and dried. A weight average molecular weight (Mw) of the resin grain measured by a GPC method and calculated in terms of polystyrene (hereinafter the same) was $1.5\times10^4$. A glass transition point (Tg) thereof was 63° C.

SYNTHESIS EXAMPLE 2 OF RESIN GRAIN (ARH): (ARH-2)

A mixed solution of 14 g of Dispersion Stabilizing Resin (Q-2) having the structure shown below, 10 g of Macromonomer (M-1) having the structure shown below, and 553 g of Isopar H was heated to a temperature of 55° C. under nitrogen gas stream while stirring.

Dispersion Stabilizing Resin (Q-2)

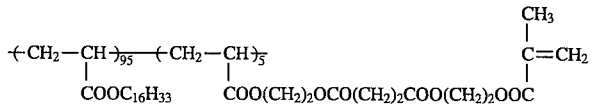

Mw $4\times10^4$

Macromonomer (M-1)

-continued

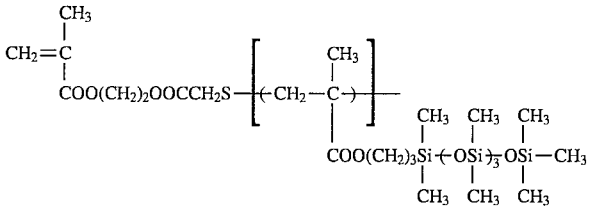

Mw $8 \times 10^3$

To the solution was added dropwise a mixed solution of 51.2 g of methyl methacrylate, 30 g of methyl acrylate, 12.5 g of acrylic acid, 1.3 g of methyl 3-mercaptopropionate, and 1.2 g of ACPP over a period of one hour, followed by reacting for one hour. Then, 0.8 g of 2,2'-azobis(isovaleronitrile) (abbreviated as AIVN) was added thereto and the temperature was immediately adjusted to 75° C., and the reaction was continued for 2 hours. To the reaction mixture was further added 0.5 g of AIVN, followed by reacting for 2 hours. After cooling, the reaction mixture was passed through a nylon cloth of 200 mesh to obtain a white dispersion which was a latex of good monodispersity with a polymerization ratio of 98% and an average grain diameter of 0.18 μm. An Mw of the resin grain was $2\times10^4$ and a Tg thereof was 50° C.

SYNTHESIS EXAMPLES 3 TO 11 OF RESIN GRAIN (ARH): (ARH-3) TO (ARH-11)

A mixed solution of 20 g of Dispersion Stabilizing Resin (Q-3) having the structure shown below and 480 g of Isopar G was heated to a temperature of 50° C. under nitrogen gas stream while stirring.

Dispersion Stabilizing Resin (Q-3)

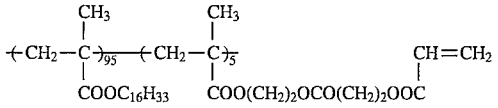

Mw $4.5 \times 10^4$

To the solution was added dropwise a mixed solution of each of the monomers shown in Table A below, 2.6 g of methyl 3-mercaptopropionate, 1.5 g of AIVN and 60 g of tetrahydrofuran over a period of one hour, followed by reacting for one hour. Then, 1.0 g of AIVN was added thereto and the temperature was adjusted to 70° C., and the reaction was continued for 2 hours. To the reaction mixture was further added 0.8 g of AIVN, followed by reacting for 3 hours. To the reaction mixture was added 60 g of Isopar H, the tetrahydrofuran was distilled off under a reduced pressure of an aspirator at a temperature of 50° C. After cooling, the reaction mixture was passed through a nylon cloth of 200 mesh to obtain a white dispersion which was a latex of good monodispersity. An average grain diameter of each of the resin grains was in a range of from 0.15 to 0.30 μm. An Mw thereof was in a range of from $1\times10^4$ to $2\times10^4$ and a Tg thereof was in a range of from 35° C. to 80° C.

TABLE A

| Synthesis Example of Resin Grain (ARH) | Resin Grain (ARH) | Monomer Corresponding to Component (a) | | Monomer Corresponding to Component (b) | | Other Monomer | |
|---|---|---|---|---|---|---|---|
| 3 | ARH-3 | 2-Carboxyethyl acrylate | 18 g | — | | Methyl methacrylate<br>Ethyl methacrylate | 60 g<br>22 g |
| 4 | ARH-4 | Methacrylic acid | 5 g | 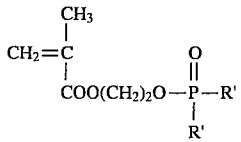 <br>R': $-O(CH_2)_2COC_4H_9$<br>(RM-7) | 25 g | Phenethyl methacrylate | 70 g |
| 5 | ARH-5 | — | | 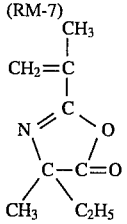 <br>(RM-8) | 40 g | Benzyl methacrylate | 60 g |
| 6 | ARH-6 | — | | 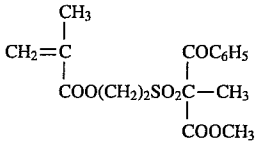 <br>(RM-9) | 70 g | Ethyl methacrylate | 30 g |
| 7 | ARH-7 | 4-Vinylbenzene-sulfonic acid | 7 g | 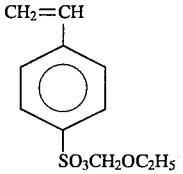 <br>(RM-10) | 40 g | Styrene<br>Vinyltoluene | 23 g<br>30 g |

TABLE A-continued

| Synthesis Example of Resin Grain (ARH) | Resin Grain (ARH) | Monomer Corresponding to Component (a) | | Monomer Corresponding to Component (b) | | Other Monomer | |
|---|---|---|---|---|---|---|---|
| 8 | ARH-8 | Itaconic anhydride | 5 g | 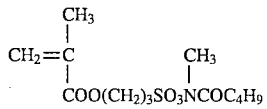 (RM-11) | 25 g | Methyl methacrylate<br>Ethyl methacrylate | 50 g<br>20 g |
| 9 | ARH-9 | Acrylic acid | 8 g | 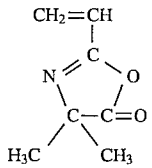 (RM-12) | 20 g | 2-Methylphenyl methacrylate | 72 g |
| 10 | ARH-10 | 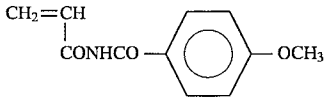 | 5 g | 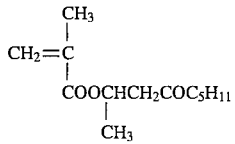 (RM-13) | 30 g | Methyl methacrylate<br> 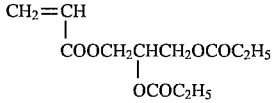 | 45 g<br>20 g |
| 11 | ARH-11 | Acrylic acid | 13 g | — | | 2-(Phenoxy carbonyl) ethyl methacrylate | 87 g |

SYNTHESIS EXAMPLES 12 TO 22 OF RESIN GRAIN (ARH): (ARH-12) TO (ARH-22)

Each of the resin grains was synthesized in the same manner as in Synthesis Example 2 of Resin Grain (ARH) except for using each of the macromonomers (Mw thereof being in a range of from $8\times10^3$ to $1\times10^4$) shown in Table B below in place of 10 g of Macromonomer (M-1). A polymerization ratio of each of the resin grains was in a range of from 98 to 99% and an average grain diameter thereof was in a range of from 0.15 to 0.25 μm with good monodispersity. An Mw of each of the resin grains was in a range of from $9\times10^3$ to $2\times10^4$ and a Tg thereof was in a range of from 40° C. to 70° C.

TABLE B

| Synthesis Example of Resin Grain (ARH) | Resin Grain (ARH) | Macromonomer Component |
|---|---|---|
| 12 | ARH-12 | 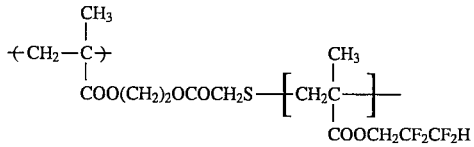 |
| 13 | ARH-13 | 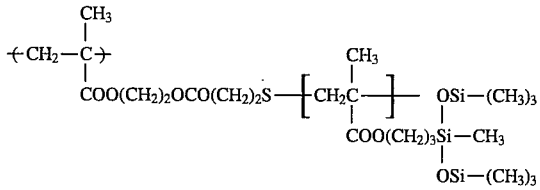 |
| 14 | ARH-14 | 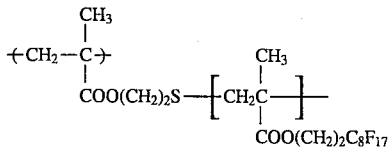 |
| 15 | ARH-15 | 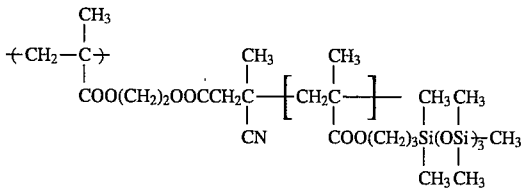 |
| 16 | ARH-16 | 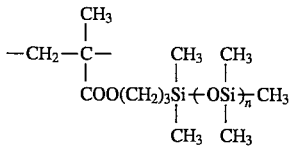 |
| 17 | ARH-17 | 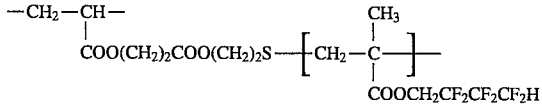 |
| 18 | ARH-18 | 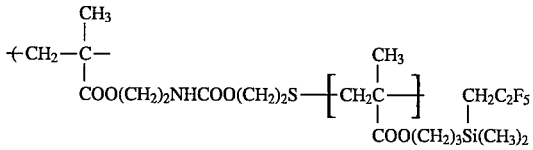 |
| 19 | ARH-19 | 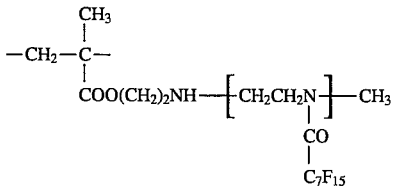 |

TABLE B-continued

| Synthesis Example of Resin Grain (ARH) | Resin Grain (ARH) | Macromonomer Component |
|---|---|---|
| 20 | ARH-20 | 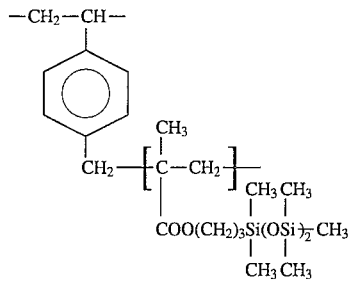 |
| 21 | ARH-21 | 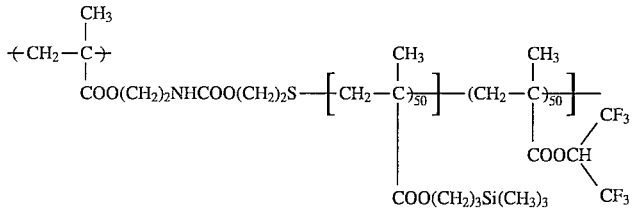 |
| 22 | ARH-22 | 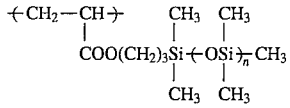 |

SYNTHESIS EXAMPLE 1 OF RESIN GRAIN (ARL): (ARL-1)

A mixed solution of 18 g of Dispersion Stabilizing Resin (Q-4) having the structure shown below and 560 g of Isopar H was heated to a temperature of 55° C. under nitrogen gas stream while stirring.

Dispersion Stabilizing Resin (Q-4)

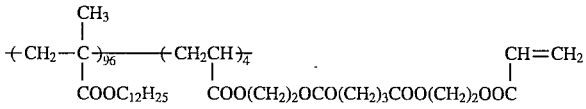

Mw $3\times10^4$

To the solution was dropwise added a mixed solution of 84.8 g of phenethyl methacrylate, 10.0 g of acrylic acid, 5.2 g of 3-mercaptopropionic acid and 0.8 g of AIVN over a period of one hour, followed by stirring for one hour. Then, 0.8 g of AIVN was added to the reaction mixture, the reaction was carried out for 2 hours and 0.5 g of AIBN was further added thereto and the reaction temperature was adjusted to 80° C., followed by reacting for 3 hours. After cooling, the reaction mixture was passed through a nylon cloth of 200 mesh to obtain a white dispersion which was a latex of good monodispersity having a polymerization ratio of 97% and an average grain diameter of 0.18 μm. An Mw of the resin grain was $6\times10^3$ and a Tg thereof was 25° C.

SYNTHESIS EXAMPLE 2 OF RESIN GRAIN (ARL): (ARL-2)

(1) Synthesis of Dispersion Stabilizing Resin (Q-5)

A mixed solution of 99.5 g of dodecyl methacrylate, 0.5 g of divinylbenzene and 200 g of toluene was heated to a temperature of 80° C. under nitrogen gas stream with stirring. To the solution was added 2 g of AIBN, followed by reaction for 3 hours, and 0.5 g of AIBN was further added thereto, followed by reacting for 4 hours. The resulting polymer had a solid content of 33.3% by weight and an Mw of $4\times10^4$.

(2) Synthesis of Grain

A mixed solution of 25 g (as solid basis) of Dispersion Stabilizing Resin (Q-5) above, 54 g of vinyl acetate, 40 g of vinyl butyrate, 6 g of crotonic acid and 275 g of Isopar H was heated to a temperature of 80° C. under nitrogen gas stream with stirring. To the solution was added 1.6 g of AIVN, followed by reacting for 1.5 hours, 0.8 g of AIVN was added thereto, followed by reacting for 2 hours, and 0.5 g of AIBN was further added thereto, followed by reacting for 4 hours. Then, the temperature of the reaction mixture was raised to 100° C. and stirred for 2 hours to distil off the unreacted monomers. After cooling, the reaction mixture was passed through a nylon cloth of 200 mesh to obtain a white dispersion which was a monodispersed latex with a polymerization ratio of 93% and an average grain diameter of 0.25 μm. An Mw of the resin grain was $8\times10^4$ and a Tg thereof was 30° C.

SYNTHESIS EXAMPLE 3 OF RESIN GRAIN (ARL): (ARL-3)

A mixed solution of 20 g of Dispersion Stabilizing Resin (Q-6) having the structure shown below, 57 g of methyl methacrylate, 30 g of ethyl acrylate, 10 g of acrylic acid, 3 g of thioglycolic acid and 546 g of Isopar H was heated to a temperature of 60° C. under nitrogen gas stream while stirring.

Dispersion Stabilizing Resin (Q-6)

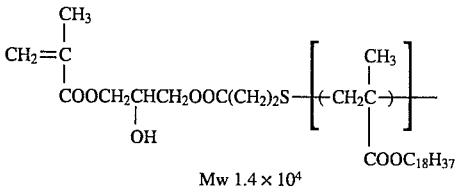

Mw $1.4\times10^4$

To the solution was added 1.0 g of AIVN, followed by reacting for 2 hours, 0.8 g of AIVN was added thereto, followed by reacting for 2 hours, and 0.5 g of AIBN was further added thereto, the temperature was adjusted to 80° C., followed by reacting for 3 hours. After cooling, the reaction mixture was passed through a nylon cloth of 200 mesh to obtain a white dispersion which was a monodispersed latex with a polymerization ratio of 99% and an average grain diameter of 0.22 μm. An Mw of the resin grain was $9\times10^3$ and a Tg thereof was 23° C.

SYNTHESIS EXAMPLE 4 OF RESIN GRAIN (ARL): (ARL-4)

A mixed solution of 18 g of Dispersion Stabilizing Resin (Q-7) having the structure shown below and 500 g of Isopar H was heated to a temperature of 50° C. under nitrogen gas stream with stirring.

Dispersion Stabilizing Resin (Q-7)

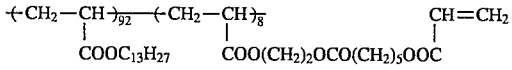

Mw $4.5\times10^4$

To the solution was added dropwise a mixed solution of 39.1 g of methyl methacrylate, 30 g of ethyl acrylate, 25 g of 2-sulfoethyl methacrylate, 5.9 g of methyl 3-mercaptopropionate, 1.5 g of AIVN and 120 g of tetrahydrofuran over a period of one hour, followed by further reacting for one hour. Then 1.0 g of AIVN was added to the reaction mixture, the temperature thereof was adjusted to 70° C., and the reaction was conducted for 2 hours. Further, 1.0 g of AIVN was added thereto, followed by reacting for 3 hours. To the reaction mixture was added 120 g of Isopar H, the tetrahydrofuran was distilled off under a reduced pressure of an aspirator at a temperature of 50° C. After cooing, the reaction mixture was passed through a nylon cloth of 200 mesh to obtain a white dispersion which was a latex of good monodispersity having a polymerization ratio of 98% and an average grain diameter of 0.18 μm. An Mw of the resin grain was $4\times10^3$ and a Tg thereof was 28° C.

SYNTHESIS EXAMPLE 5 OF RESIN GRAIN (ARL): (ARL-5)

A mixed solution of 20 g of Dispersion Stabilizing Resin (Q-8) having the structure shown below, 15 g of a dimethylsiloxane macromonomer (FM-0721 manufactured by Chisso Corp.; Mw: $6\times10^4$), 30.8 g of methyl methacrylate, 30 g of ethyl acrylate, 15 g of acrylic acid, 9.2 g of ethyl 3-mercaptopropionate, and 547 g of Isopar G was heated to a temperature of 60° C. under nitrogen gas stream while stirring.

Dispersion Stabilizing Resin (Q-8)

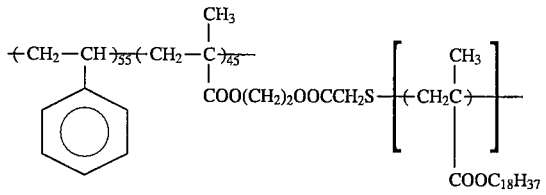

Mw $5\times10^4$ (Mw of graft portion: $1.0\times10^4$)

To the solution was added 2.0 g of AIVN, followed by reacting for 2 hours, 1.0 g of AIVN was added to the reaction mixture, and the reaction was carried out for 2 hours. Then, 1.0 g of AIVN was further added thereto, the temperature was immediately adjusted to 75° C., followed by reacting for 2 hours, and 0.8 g of AIVN was further added thereto, followed by reacting for 2 hours. After cooling, the reaction mixture was passed through a nylon cloth of 200 mesh to obtain a white dispersion which was a latex of good monodispersity having a polymerization ratio of 98% and an average grain diameter of 0.20 μm. An Mw of the resin grain was $4\times10^3$ and a Tg thereof was 18° C.

SYNTHESIS EXAMPLE 6 OF RESIN GRAIN (ARL): (ARL-6)

A mixed solution of 12 g of Dispersion Stabilizing Resin (Q-4) described above and 455 g of Isopar G was heated to a temperature of 50° C. under nitrogen gas stream while stirring. To the solution was dropwise added a mixed solution of 62.5 g of phenethyl methacrylate, 20 g of (2-pentylcarbonyl-1-methyl)ethyl methacrylate, 7.5 g of acrylic acid, 10 g of methyl 4-mercaptobutanecarboxylate, 3 g of ACPP and 100 g of Isopar G over a period of one hour, followed by reacting for one hour, and 1.0 g of ACPP was added thereto, followed by reacting for 2 hours. Then, 0.8 g of AIVN was added thereto and the temperature was immediately adjusted to 75° C., and the reaction was continued for 2 hours. To the reaction mixture was further added 0.5 g of AIVN, followed by reacting for 2 hours. After cooling, the reaction mixture was passed through a nylon cloth of 200 mesh to obtain a white dispersion which was a latex of good monodispersity with a polymerization ratio of 98% and an average grain diameter of 0.17 μm. An Mw of the resin grain was $6\times10^3$ and a Tg thereof was 15° C.

SYNTHESIS EXAMPLES 7 TO 16 OF RESIN GRAIN (ARL): (ARL-7) TO (ARL-16)

A mixed solution of 25 g of Dispersion Stabilizing Resin (Q-9) having the structure shown below and 392 g of Isopar H was heated to a temperature of 50° C. under nitrogen gas stream while stirring.

Dispersion Stabilizing Resin (Q-9)

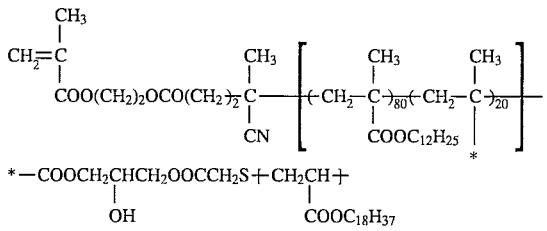

Mw $4 \times 10^4$ (Mw of graft portion: $8 \times 10^3$)

To the solution was dropwise added a mixed solution of each of the monomers shown in Table C below, 3.1 g of methyl 3-mercaptopropionate, 3 g of ACPP and 150 g of methyl ethyl ketone over a period of one hour, followed by reacting for one hour. To the reaction mixture was further added 1.0 g of ACPP, followed by reacting for 2 hours. Then, 1.0 g of AIVN was added thereto and the temperature was immediately adjusted to 75° C., and the reaction was continued for 2 hours To the reaction mixture was further added 0.8 g of AIVN, followed by reacting for 2 hours. After cooling, the reaction mixture was passed through a nylon cloth of 200 mesh to obtain a white dispersion. A polymerization ratio of each of the white dispersions obtained was in a range of from 93 to 99% and an average grain diameter thereof was in a range of from 0.15 to 0.25 μm with narrow size distribution. An Mw of each of the resin grains was in a range of from $8\times10^3$ to $1\times10^4$ and a Tg thereof was in a range of from 10° C. to 35° C.

TABLE C

| Synthesis Example of Resin Grain (ARL) | Resin Grain (ARL) | Monomer Corresponding to Component (a) | | Monomer Corresponding to Component (b) | | Other Monomer | |
|---|---|---|---|---|---|---|---|
| 7 | ARL-7 | Acrylic acid | 12.5 g | — | | Benzyl methacrylate<br>2-Methoxyethyl methacrylate | 55 g<br>32.5 g |
| 8 | ARL-8 | 2-Phosphonoethyl methacrylate | 18 g | 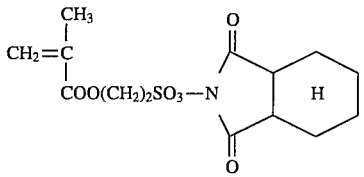 <br>(RM-2) | 12.5 g | Methyl methacrylate<br>Ethyl methacrylate | 35.5 g<br>34 g |
| 9 | ARL-9 | 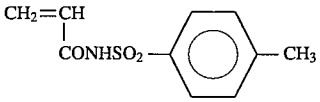 | 8 g | 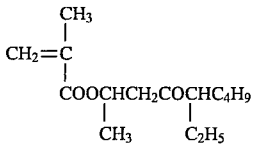 <br>(RM-3) | 30 g | Methyl methacrylate<br>Methyl acrylate | 35 g<br>27 g |
| 10 | ARL-10 | Acrylic acid | 15 g | — | | Benzyl methacrylate<br> 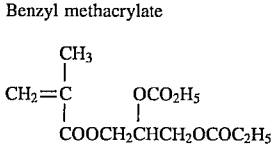 | 55 g<br>30 g |
| 11 | ARL-11 | Acrylic acid<br>2-Sulfopropyl methacrylate | 8 g<br>8 g | — | | 3-Phenylpropyl methacrylate<br>Diethylene glycol monomethyl ether monomethacrylate | 64 g<br>20 g |
| 12 | ARL-12 | Acrolein | 10 g | 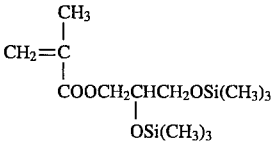 <br>(RM-4) | 15 g | Methyl methacrylate<br>Propyl acrylate | 50 g<br>25 g |

TABLE C-continued

| Synthesis Example of Resin Grain (ARL) | Resin Grain (ARL) | Monomer Corresponding to Component (a) | | Monomer Corresponding to Component (b) | | Other Monomer | |
|---|---|---|---|---|---|---|---|
| 13 | ARL-13 | — | | 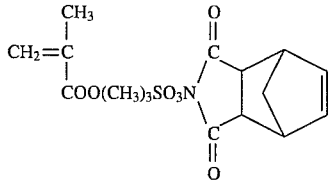 (RM-5) | 28 g | 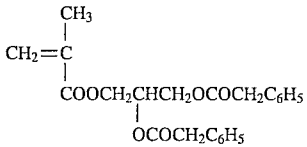 | 72 g |
| 14 | ARL-14 | — | | 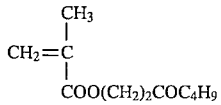 (RM-6) | 30 g | Phenyl methacrylate<br>Methyl acrylate | 40 g<br>30 g |
| 15 | ARL-15 | 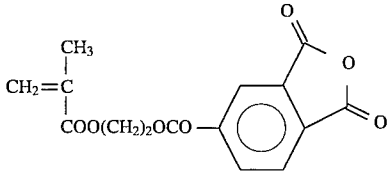 | 25 g | — | | Methyl methacrylate<br>Ethyl methacrylate | 50 g<br>25 g |
| 16 | ARL-16 | 4-Vinylbenzene-carboxylic acid | 15 g | — | | Methyl methacrylate<br>4-Vinyltoluene | 65 g<br>20 g |

EXAMPLE 1

An amorphous silicon electrophotographic light-sensitive element was installed in an apparatus as shown in FIG. 2. The adhesive strength of the surface thereof was 180 gf.

Impartation of releasability to the surface of light-sensitive element was conducted by dipping the light-sensitive element in a solution of the compound (S) according to the present invention (dip method). Specifically, the light-sensitive element rotated at a circumferential speed of 10 mm/sec was brought into contact with a bath containing a solution prepared by dissolving 1.0 g of Compound (S-1) shown below in one liter of Isopar G (manufactured by Esso Standard Oil Co.) for 7 seconds and dried using air-squeezing. The adhesive strength of the surface of the light-sensitive element thus-treated was 5 gf and the light-sensitive element exhibited good releasability.

Compound (S-1)

Silicone surface active agent (SILWet FZ-2171 manufactured by Nippon Unicar Co., Ltd.)

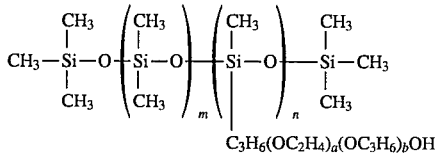

(presumptive structure)

On the surface of light-sensitive element installed on a drum, whose surface temperature was adjusted to 60° C. and which was rotated at a circumferential speed of 10 mm/sec, Dispersion of Positively Charged Resin Grains (L-1) shown below was supplied using a slit electrodeposition device, while putting the light-sensitive element to earth and applying an electric voltage of −200 V to an electrode of the slit electrodeposition device, whereby the resin grains were electrodeposited. The resin grains were fixed.

| Dispersion of Positively Charged Resin Grains (L-1) | |
|---|---|
| Resin Grain (ARH-16) | 8 g (solid basis) |
| Positive-Charge Control Agent (CD-1) (octadecyl vinyl ether/N-hexadecyl maleic monoamide copolymer (1/1 ratio by mole) | 0.02 g |
| Isopar G (manufactured by Esso Standard Oil Co.) | up to make 1 liter |

The resulting light-sensitive material was evaluated for image forming performance and transferability as follows.

The light-sensitive material was charged to 700 V with a corona discharge in dark and exposed to light of a gallium-aluminum-arsenic semiconductor laser (output: 5 mW; oscillation wavelength: 780 nm) at an irradiation dose (on the surface of the light-sensitive material) of 30 erg/cm$^2$, a pitch of 25 μm, and a scanning speed of 300 cm/sec. The scanning exposure was in a negative mirror image mode based on the digital image data of an original read by a color scanner and memorized in a hard disc.

Thereafter, the light-sensitive material was subjected to reversal development using Liquid Developer (LD-1) prepared in the manner as described below in a developing machine having a pair of flat development electrodes, and a bias voltage of +400 V was applied to the electrode on the side of the light-sensitive material to thereby electrodeposit toner particles on the exposed areas. The light-sensitive material was then rinsed in a bath of Isopar H alone to remove any stains on the non-image areas.

Preparation of Liquid Developer (LD-1)

1) Synthesis of Toner Particles:

A mixed solution of 65 g of methyl methacrylate, 35 g of methyl acrylate, 20 g of a dispersion polymer having the structure shown below, and 680 g of Isopar H was heated to 65° C. under nitrogen gas stream with stirring. To the solution was added 1.2 g of 2,2'-azobis(isovaleronitrile) (AIVN), followed by reacting for 2 hours. To the reaction mixture was further added 0.5 g of AIVN, and the reaction was continued for 2 hours. To the reaction mixture was further added 0.5 g of AIVN, and the reaction was continued fro 2 hours. The temperature was raised up to 90° C., and the mixture was stirred under a reduced pressure of 30 mm Hg for 1 hour to remove any unreacted monomers. After cooling to room temperature, the reaction mixture was filtered through a nylon cloth of 200 mesh to obtain a white dispersion. The reaction rate of the monomers was 95%, and the resulting dispersion had an average grain diameter of resin grain of 0.25 μm (grain diameter being measured by CAPA-500 manufactured by Horiba, Ltd.) and good monodispersity.

Dispersion Polymer

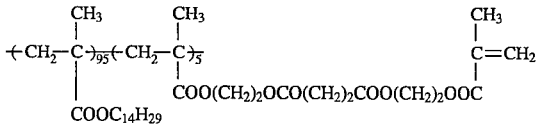

Mw $5\times10^4$

2) Preparation of Colored Particles:

Ten grams of a tetradecyl methacrylate/methacrylic acid copolymer (95/5 ratio by weight), 10 g of nigrosine, and 30 g of Isopar G were put in a paint shaker (manufacture by Toyo Seiki Seisakusho Co.) together with glass beads and dispersed for 4 hours to prepare a fine dispersion of nigrosine.

3) Preparation of Liquid Developer:

A mixed of 45 g of the above-prepared toner particle dispersion, 25 g of the above-prepared nigrosine dispersion, 0.2 g of a hexadecene/maleic acid monooctadecylamide copolymer (1/1 ratio by mole), and 15 g of branched octadecyl alcohol (FOC-1800 manufactured by Nissan Chemical Industries, Ltd.) was diluted with 1 l of Isopar G to prepare a liquid developer for electrophotography.

The light-sensitive material was then subjected to fixing by means of a heat roll whereby the toner image thus-formed was fixed.

An aluminum substrate used for the production of FUJI PS-Plate FPD (manufactured by Fuji Photo Film Co., Ltd.) and the thus-developed light-sensitive material were superposed each other, and they were passed through between a pair of rubber rollers having a nip pressure of 15 Kgf/cm$^2$ at a transportation speed of 5 mm/sec. The surface temperature of the rollers was controlled to maintain constantly at 130° C.

After cooling the both materials while being in contact with each other to room temperature, the aluminum substrate was stripped from the light-sensitive element. The image formed on the aluminum substrate was visually evaluated for fog and image quality. As a result it was found that the whole toner image on the light-sensitive material according to the present invention was heat-transferred together with the transfer layer onto the aluminum substrate to provide a clear image without background stain on the aluminum substrate which showed substantially no degradation in image quality as compared with the original.

For comparison, the same procedure as above was repeated except that the transfer layer was formed without the treatment with Compound (S-1). As a result of transfer onto an aluminum substrate, neither uniform nor complete release of the transfer layer was observed.

For further comparison, the same procedure as above was repeated without the formation of transfer layer. As a result of transfer of the toner images, many cuttings were observed in the toner images formed on the aluminum substrate and many toner images remained on the light-sensitive element.

From these results, it can be seen that the method for forming toner images according to the present invention comprising imparting releasability onto the surface of light-sensitive element, providing the transfer layer, and transferring toner images formed on the transfer layer to a receiving material is excellent in reproduction of images without cutting of duplicated images.

Then, the plate of aluminum substrate having thereon the transfer layer was subjected to an oil-desensitizing treatment (i.e., removal of the transfer layer) to prepare a printing plate and its printing performance was evaluated. Specifically, the plate was immersed in Oil-Desensitizing Solution (E-1) having the composition shown below at 35° C. for one minute with mild rubbing with a brush to remove the transfer layer, thoroughly washed with water, and gummed to obtain an offset printing plate.

Oil-Desensitizing Solution (E-1)

A solution prepared by diluting PS plate processing solution (DP-4 manufactured by Fuji Photo Film Co., Ltd.) 50-fold with distilled water (pH: 12.5)

The printing plate thus prepared was observed visually using an optical microscope of 200 magnifications. It was found that the non-image areas had no residual transfer layer, and the image areas suffered no defects in high definition regions (i.e., cutting of fine lines and fine letters).

The printing plate was subjected to printing on neutral paper with various offset printing color inks using an offset printing machine (Oliver 94 Model manufactured by Sakurai Seisakusho K.K.), and an aqueous solution (pH: 7.0) prepared by diluting dampening water for PS plate (SG-23 manufactured by Tokyo Ink K.K.) 130-fold with distilled water, as dampening water. As a result, more than 60,000 prints with clear images free from background stains were obtained irrespective of the kind of color inks.

Moreover, when the printing plate according to the present invention was exchanged for an ordinary PS plate and printing was continued under ordinary conditions, no trouble arose. It was thus confirmed that the printing plate according to the present invention can share a printing machine with other offset printing plates such as PS plates.

As described above, the offset printing plate according to the present invention exhibits excellent performance in that an image formed by a scanning exposure system using semiconductor laser beam has excellent image reproducibility and the image of the plate can be reproduced on prints with satisfactory quality, in that the plate exhibits sufficient color ink receptivity without substantial ink-dependency to enable to perform full color printing with high printing durability, and in that it can share a printing machine in printing with other offset printing plates without any trouble.

EXAMPLE 2

Toner images were formed on an aluminum substrate in the same manner as in Example 1, except for replacing the means for imparting releasability to the surface of light-sensitive element with the following method. Specifically, a metering roll having a silicone rubber layer on the surface thereof was brought into contact with a bath containing an oil of Compound (S-2) shown below on one side and with the light-sensitive element on the other side and they were rotated at a circumferential speed of 15 mm/sec for 20 seconds. The adhesive strength of the surface of resulting light-sensitive element was 5 gf.

Compound (S-2)

Carboxy-modified silicone oil (TSF 4770 manufactured by Toshiba Silicone Co., Ltd.)

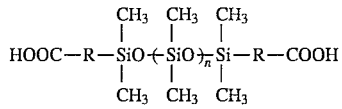

Further, a transfer roll having a styrene-butadiene layer on the surface thereof was placed between the metering roll dipped in the silicone oil bath of Compound (S-2) and the light-sensitive element, and the treatment was conducted in the same manner as above. Good releasability of the surface of light-sensitive element similar to the above was obtained.

Figure 5:
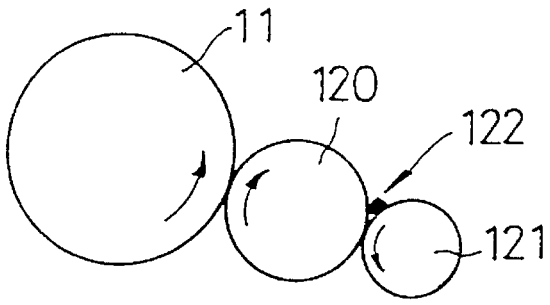
FIG. 5 is a schematic view of an apparatus for applying Compound (S).

Moreover, Compound (S-2) was supplied between the metering roll and the transfer roll as shown in FIG. 5 and the treatment was conducted in the same manner as above. Again, good result similar to the above was obtained.

Using these light-sensitive elements printing plates were prepared in the same manner as above. As a result of printing, each printing plate exhibited the good performance similar to that of Example 1.

EXAMPLE 3

Toner images were formed on an aluminum substrate in the same manner as in Example 1, except for replacing the means for imparting releasability to the surface of light-sensitive element with the following method. Specifically, an AW-treated felt (material: wool having a thickness of 15 mm and a width of 20 mm) impregnated uniformly with 2 g of Compound (S-3), i.e., dimethyl silicone oil KF-96L-2.0 (manufactured by ShinEtsu Silicone Co., Ltd.) was pressed under a pressure of 200 g on the surface of light-sensitive element and the light-sensitive element was rotated at a circumferential speed of 20 mm/sec for 30 seconds. The adhesive strength of the surface of light-sensitive element thus-treated was 10 gf. The images on prints and printing durability were good similar to those in Example 1.

EXAMPLE 4

Toner images were formed on an aluminum substrate in the same manner as in Example 1, except for replacing the means for imparting releasability to the surface of light-sensitive element with the following method. Specifically, a roller having a heating means integrated therein and covered with cloth impregnated with Compound (S-4), i.e., fluorine-containing surface active agent (Sarflon S-141 manufactured by Asahi Glass Co., Ltd.) was heated to a surface temperature of 60° C., then brought into contact with the light-sensitive element and they were rotated at a circumferential speed of 20 mm/sec for 30 seconds. The adhesive strength of the surface of light-sensitive element thus-treated was 12 gf. The images on prints and printing durability were good similar to those in Example 1.

EXAMPLE 5

Toner images were formed on an aluminum substrate in the same manner as in Example 1, except for replacing the means for imparting releasability to the surface of light-sensitive element with the following method. Specifically, a silicone rubber roller comprising a metal axis covered with silicone rubber (manufactured by Kinyosha K.K.) was pressed on the light-sensitive element at a nip pressure of 500 gf/cm$^2$ and rotated at a circumferential speed of 15 mm/sec for 10 minutes. The adhesive strength of the surface of light-sensitive element thus-treated was 48 gf/cm$^2$. The images on prints and printing durability were good similar to those in Example 1.

EXAMPLE 6

Toner images were formed on an aluminum substrate in the same manner as in Example 1, except for forming a transfer layer of a double-layered structure shown below on the surface of electrophotographic light-sensitive element in place of the transfer layer formed using Dispersion of Positively Charged Resin Grains (L-1).

Formation of Transfer Layer

Using Dispersion of Resin Grains (L-2) prepared by adding 10 g (solid basis) of Resin Grain (ARH-1), 0.02 g of Charge Control Agent (CD-1) described above and 10 g of branched octadecyl alcohol (FOC-1800) described above to Isopar G to make one liter, a first transfer layer having a thickness of 3 μm was formed on the surface of electrophotographic light-sensitive element.

Using Dispersion of Resin Grains (L-3) prepared in the same manner as in Dispersion of Resin Grains (L-2) above except for replacing 10 g of Resin Grain (ARH-1) with 10 g (solid basis) of Resin Grain (ARL-9), a second transfer layer having a thickness of 1 μm was formed on the first transfer layer.

The resulting light-sensitive material was subjected to the formation of toner image thereon and the heat-transfer in the same manner as in Example 1 to prepare a printing plate precursor comprising an aluminum substrate for FPD having thereon the toner image together with the transfer layer.

Further, another printing plate precursor was prepared in the same manner as above except for changing the heat-transfer condition to a moderate one comprising a pressure of 10 Kgf/cm$^2$, a surface temperature of 100° C. and a transportation speed of 10 mm/sec.

As a result it was found that the whole toner image on the light-sensitive material having the transfer layer of double-layered structure according to the present invention was heat-transferred together with the transfer layer onto the aluminum substrate to provide a clear image without background stain on the aluminum substrate which showed substantially no degradation in image quality as compared with the original under each of two different heat-transfer conditions. On the contrary, when the light-sensitive material of Example 1 was subjected to heat-transfer under the moderate condition described above, a slight amount of residual transfer layer was observed on the light-sensitive element.

From these results it can be seen that the transfer layer of double-layered structure composed of a layer containing the resin (AH) having a relatively high glass transition point and a layer containing the resin (AL) having a relatively low glass transition point makes heat-transfer under moderate conditions of temperature and pressure and at increased speed possible due to the improvements in releasability of the transfer layer from the surface of light-sensitive element and adhesion to the surface of an aluminum substrate for FPD.

Further, the aluminum substrates bearing the images transferred together with the transfer layer thereon (i.e., printing plate precursors) were put one upon another, a pressure of 8 Kgf/cm$^2$ was applied thereto and allowed to stand under conditions of 30° C. and 85% RH for 3 days. After separation of these aluminium substrates, the transfer layer of the lower aluminum substrate was visually observed. As a result, no adherence of the transfer layer to the upper aluminum substrate was recognized. This result illustrates a good shelf life stability of the printing plate precursor.

Then, the printing plate precursor was subjected to the oil-desensitizing treatment to prepare a printing plate and printing was performed using the resulting printing plate in the same manner as in Example 1. Thus, 60,000 prints with clear images free from background stains similar to those in Example 1 were obtained.

EXAMPLE 7

An amorphous silicon electrophotographic light-sensitive element was installed in an apparatus as shown in FIG. 3. Impartation of releasability to the surface of light-sensitive element was conducted in the same manner as in Example 1. As a result, the adhesive strength of the surface of light-sensitive element was decreased from 180 gf to 5 gf.

A mixture of Resin (A-1) and Resin (A-2) each having the structure shown below (1:2 ratio by weight) was coated on the surface of light-sensitive layer at a rate of 20 mm/sec by a hot melt coater adjusted at 120° C. and cooled by blowing cool air from a suction/exhaust unit, followed by maintaining the surface temperature of light-sensitive element at 30° C. to prepare a transfer layer having a thickness of 3 μm.

Resin (A-1)

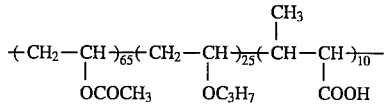

Mw $8\times10^4$, Tg 20° C.

Resin (A-2)

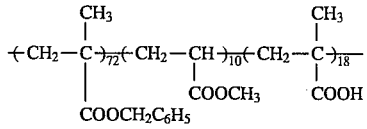

Mw $9\times10^3$, Tg 60° C.

Then, the formation of toner image, transfer onto an aluminum substrate for FPD, oil-desensitizing treatment to prepare a printing plate and offset printing were performed in the same manner as in Example 1 except for changing the transfer conditions to a pressure of 10 Kgf/cm$^2$, a temperature of 120° C. and a transportation speed of 15 mm/sec.

As a result, 60,000 prints with clear images free from background stains were obtained. Further, when a shelf life stability of the printing plate precursor was evaluated in the same manner as in Example 6, a good result was obtained.

EXAMPLE 8

The amorphous silicon electrophotographic light-sensitive element same as in Example 7 was installed in an apparatus as shown in FIG. 4, and impartation of releasability to the surface of light-sensitive element was conducted in the same manner as in Example 1.

On the surface of the resulting light-sensitive element, was formed a transfer layer according to the transfer method using release paper. Specifically, release paper (Separate Shi manufactured by Ohji Seishi K.K.) having coated thereon a transfer layer composed of a mixture of Resin (A-3) and Resin (A-4) each having the structure shown below (1:1 ratio by weight) having a thickness of 4 μm was brought into contact with the light-sensitive element under transfer conditions comprising a pressure between rollers of 3 Kgf/cm$^2$, a surface temperature of 90° C. and a transportation speed of 10 mm/sec to transfer the transfer layer onto the surface of light-sensitive element.

Resin (A-3)

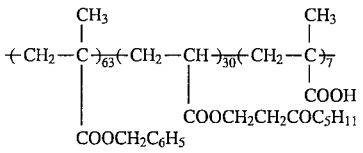

Mw 8 × 10$^3$, Tg 30° C.

Resin (A-4)

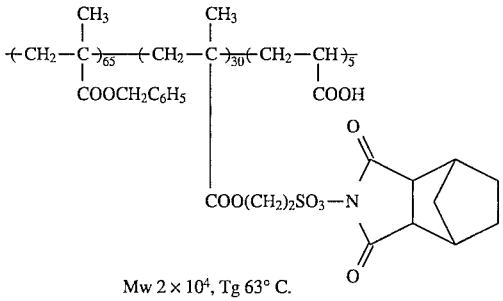

Mw 2 × 10$^4$, Tg 63° C.

The resulting light-sensitive element was subjected to the same procedure as described in Example 7 to prepare a printing plate. As a result of offset printing, good prints similar to those in Example 7 were obtained.

EXAMPLE 9

A mixture of 2 g of X-form metal-free phthalocyanine (manufactured by Dainippon Ink and Chemicals, Inc.), 10 g of Binder Resin (B-1) having the structure shown below, 0.15 g of Compound (A) having the structure shown below, and 80 g of tetrahydrofuran was put into a 500 ml-volume glass container together with glass beads and dispersed in a paint shaker (manufactured by Toyo Seiki Seisakusho Co.) for 60 minutes. To the dispersion were added 0.03 g of phthalic anhydride, and 0.001 g of o-chlorophenol, followed by further dispersing for 2 minutes. The glass beads were separated by filtration to prepare a dispersion for a light-sensitive layer.

Binder Resin (B-1)

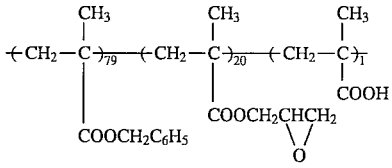

Mw 5 × 10$^4$

Compound (A)

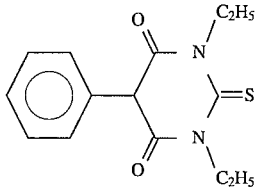

The resulting dispersion was applied onto a cylindrical aluminum substrate having a thickness of 0.25 mm, a surface of which had been grained, by dip coating, set to touch, and heated in a circulating oven at 110° C. for 20 seconds, and then further heated at 140° C. for one hour to form a light-sensitive layer having a thickness of 8 μm.

Impartation of releasability to the surface of light-sensitive element was conducted in the same manner as in Example 2 except for using Compound (S-5) shown below in place of Compound (S-2). The adhesive strength of the surface of light-sensitive element was 8 gf.

Compound (S-5).

Silicone surface active agent (SILWet FZ-2165 manufactured by Nippon Unicar Co., Ltd.)

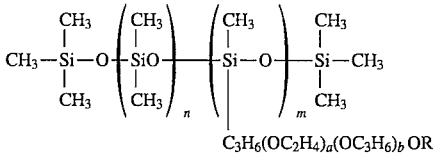

On the surface of the resulting light-sensitive element, was formed a transfer layer having a thickness of 4 μm in the same manner as in Example 1 except for using Dispersion of Resin Grains (L-4) shown below in place of Dispersion of Positively Charged Resin Grains (L-1).

| Dispersion of Resin Grains (L-4) | |
|---|---|
| Resin Grain (ARL-6) | 5 g (solid basis) |
| Resin Grain (ARH-4) | 5 g (solid basis) |
| Positive-Charge Control Agent (CD-2) shown below | 0.015 g |
| Branched Tetradecyl Alcohol (FOC-1400 manufactured by Nissan Chemical Industries, Ltd.) | 10 g |
| Isopar G | up to make 1 liter |

Positive-Charge Control Agent (CD-2)

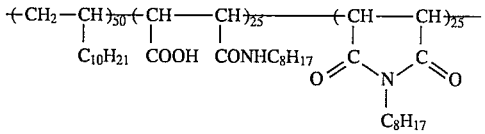

The resulting light-sensitive material was charged to 550 V with a corona discharge in dark and exposed to light of a gallium-aluminum-arsenic semiconductor laser (output: 5 mW; oscillation wavelength: 780 nm) at an irradiation dose on the surface of light-sensitive material of 30 erg/cm$^2$, a pitch of 25 μm, and a scanning speed of 300 cm/sec. The scanning exposure was in a negative mirror image mode based on the digital image data of an original read by a color scanner and memorized in a hard disc.

Then, the exposed light-sensitive material was developed using Liquid Developer (LD-1) in a developing machine having a pair of flat development electrodes while applying a bias voltage of 250 V to the electrode on the side of the light-sensitive material to thereby electrodeposit toner particles on the exposed areas, and rinsed in a bath of Isopar H alone to remove stains on the non-image areas. The toner images were fixed by a heat roll.

The light-sensitive material having the toner images was brought into contact with a sheet of Straight Master (manufactured by Mitsubishi Paper Mills, Ltd.) as a receiving material and they were passed between a pair of rubber rollers. A surface temperature of each of the rollers was controlled to maintain constantly at 100° C., a nip pressure between the rollers was 10 Kgf/cm$^2$, and a transportation speed was 10 mm/sec.

After cooling the both materials while being in contact with each other to room temperature, the Straight Master was separated from the light-sensitive element. The image formed on the Straight Master was visually evaluated for fog and image quality. As a result it was found that the whole toner image on the light-sensitive material according to the present invention was heat-transferred together with the transfer layer onto the Straight Master to provide a clear image without background stain on the Straight Master which showed substantially no degradation in image quality as compared with the original.

Then, the sheet Straight Master having thereon the transfer layer was subjected to an oil-desensitizing treatment (i.e., removal of the transfer layer) to prepare a printing plate and its printing performance was evaluated. Specifically, the sheet was immersed in Oil-Desensitizing Solution (E-2) having the composition shown below at 25° C. for 30 seconds with moderate rubbing to remove the transfer layer, thoroughly washed with water, and gummed to obtain a printing plate.

| Oil-Desensitizing Solution (E-2) | |
|---|---|
| Mercaptoethanesulfonic acid | 10 g |
| Neosoap (manufactured by Matsumoto Yushi K.K.) | 5 g |
| N,N-Dimethylacetamide | 10 g |
| Distilled water | to make 1.0 l |
| Sodium hydroxide | to adjust to pH 13.0 |

The printing plate thus prepared was observed visually using an optical microscope of 200 magnifications. It was found that the non-image areas had no residual transfer layer, and the image areas suffered no defects in high definition regions (i.e., cutting of fine lines and fine letters).

The printing plate was subjected to offset printing in the same manner as in Example 1. As a result, 2,000 prints of clear images free from background stains were obtained.

Further, the sheets of Straight Master having the images transferred together with the transfer layer thereon were put one upon another, a pressure of 5 Kgf/cm$^2$ was applied thereto and allowed to stand under condition of 25° C. and 65% RH for one week. Upon separation of these sheets, peeling of the transfer layer and cutting of toner image were not observed.

EXAMPLE 10

A mixture of 1.0 g of a bisazo pigment having the structure shown below as a charge generating agent, 2.0 g of a hydrazone compound having a structure shown below as an organic photoconductive compound, 5 g of a polyester resin (Vylon 200 manufactured by Toyobo Co., Ltd.) and 30 g of tetrahydrofuran was thoroughly pulverized in a ball mill. The mixture was added to 520 g of tetrahydrofuran with stirring. The resulting dispersion was coated on a conductive transparent substrate composed of a 100 μm-thick polyethylene terephthalate film having a deposited layer of indium oxide thereon (surface resistivity: $10^3\Omega$) by a wire round rod to prepare a charge generating layer having a thickness of about 0.7 μm.

Bisazo Pigment

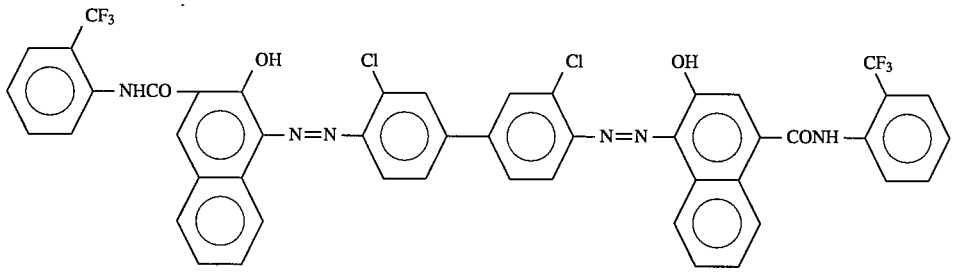

Hydrazone Compound

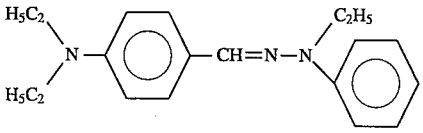

A mixed solution of 20 g of the hydrazone compound described above, 20 g of a polycarbonate resin (Lexan 121 manufactured by General Electric Co., Ltd.) and 160 g of tetrahydrofuran was coated on the above-described charge generating layer by a wire round rod, dried at 60° C. for 30 seconds and then heated at 100° C. for 20 seconds to form a charge transporting layer having a thickness of about 18 μm whereby an electrophotographic light-sensitive element having a light-sensitive layer of a double-layered structure was prepared.

Using the resulting light-sensitive element, a printing plate was prepared in the same manner as in Example 9 except for charging to +500 V of a surface potential in dark and exposing to light of a He—Ne laser (oscillation wavelength: 630 μm) at an irradiation dose on the surface of light-sensitive material of 30 erg/cm$^2$. As a result of offset printing, 2,000 prints of clear images free from background stains similar to those in Example 9 were obtained.

EXAMPLE 11

5 g of 4,4'-bis(diethylamino)-2,2'-dimethyltriphenylmethane as an organic photoconductive substance, 4 g of Binder Resin (B-2) having the structure shown below, 40 mg of Dye (D-1) having the structure shown below, and 0.2 g of Anilide Compound (B) having the structure shown below as a chemical sensitizer were dissolved in a mixed solvent of 30 ml of methylene chloride and 30 ml of ethylene chloride to prepare a light-sensitive solution.

Binder Resin (B-2)

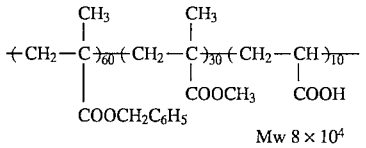

Mw 8 × 10$^4$

Dye (D-1)

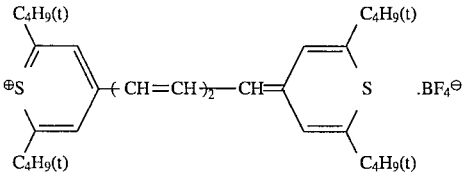

-continued

Anilide Compound (B)

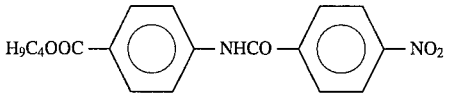

The light-sensitive solution was coated on a conductive transparent substrate composed of a 100 μm-thick polyethylene terephthalate film having a deposited layer of indium oxide thereon (surface resistivity: $10^3\Omega$) by a wire round rod to prepare a light-sensitive element having an organic light-sensitive layer having a thickness of about 10 μm.

Using the resulting light-sensitive element in place of the light-sensitive element employed in Example 1, the formation of transfer layer, formation of toner image by an electrophotographic process, transfer onto an aluminum substrate for FPD, oil-desensitizing treatment to prepare a printing plate and printing were performed in the same manner as in Example 1. As a result, more than 60,000 prints of clear images free from background stains similar to those in Example 1 were obtained.

EXAMPLE 12

A mixture of 100 g of photoconductive zinc oxide, 15 g of Binder Resin (B-3) having the structure shown below, 5 g of Binder Resin (B-4) having the structure shown below, 0.01 g of Dye (D-2) having the structure shown below, 0.1 g of salicylic acid and 150 g of toluene was dispersed in a ball mill for 2 hours to prepare a light-sensitive dispersion.

Binder Resin (B-3)

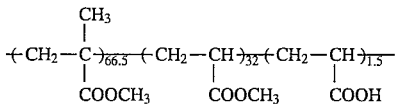

Mw 6.8 × 10$^4$

Binder Resin (B-4)

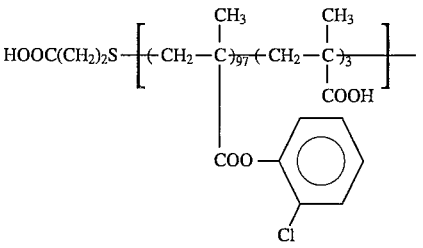

Mw 8 × 10$^3$

-continued

Dye (D-2)

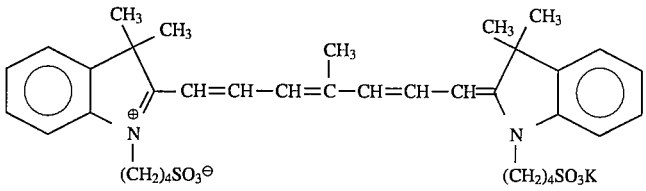

The resulting dispersion was coated on base paper for a paper master having a thickness of 0.2 mm, which had been subjected to electrically conductive treatment and solvent-resistant treatment, by a wire bar at a coverage of 25 g/m$^2$, set to touch, heated in a circulating oven at 110° C. for 20 seconds and allowed to stand in a dark place under conditions of 25° C. and 65% RH for 24 hours.

The surface of resulting light-sensitive element was treated in the same manner as in Example 3, thereby the adhesive strength of the surface decreasing to 18 gf. A transfer layer having a thickness of 4.5 μm was formed thereon using Dispersion of Resin Grains (L-4) shown in Example 9.

The light-sensitive material was charged to −650 V with a corona discharge in dark and exposed to light of a semiconductor laser (oscillation wavelength: 780 nm) at an irradiation dose on t-he surface of light-sensitive material of 25 erg/cm$^2$ in a positive mirror image mode based on the digital image data same as those in Example 1. The residual potential of the exposed areas was −120 V. The light-sensitive material was developed with Liquid Developer (LD-1) in a developing machine having a pair of flat development electrodes with a bias voltage of +200 V being applied to the electrode on the light-sensitive material side to thereby electrodeposit the toner particles on the non-exposed areas (normal development). The light-sensitive material was then rinsed in a bath of Isopar H alone to remove stains on the non-image areas.

A sheet of OK Master PS Type (manufactured by Ohji Koko Co.), as a receiving material, was superposed on the developed light-sensitive material with its image-receiving layer side being in contact with the light-sensitive material, and they were passed though a pair of rubber rollers whose surface temperature was kept constantly at 120° C. at a speed of 6 mm/sec under a nip pressure of 10 Kgf/cm$^2$.

After cooling the both materials while in contact with each other to room temperature, the OK Master was stripped from the light-sensitive element whereby the whole toner image on the light-sensitive material was thermally transferred together with the transfer layer to the OK Master. There was observed a very little difference in image quality between the toner image before the heat-transfer and that transferred on the OK Master.

The OK Master was then treated with Oil-Desensitizing Solution (E-3) prepared by adding 50 g of dimethylethanolamine to 1 liter of PS plate processing solution (DP-4) and diluting the resulting aqueous solution 50-fold with distilled water at a temperature of 25° C. for 20 seconds with moderately rubbing to remove the transfer layer.

The non-image areas and toner image areas of the thus obtained printing plate were visually observed using an optical microscope of 200 magnifications. It was found that the non-image areas had no residual transfer layer, and the image areas suffered no defects in high definition regions (i.e., cutting of fine lines and fine letters).

The printing plate was subjected to printing on neutral paper with various offset printing color inks using an offset printing machine (Ryobi 3200 MCD Model manufactured by Ryobi Ltd.), and an aqueous solution (pH: 7.0) prepared by diluting dampening water for PS plate (SG-23 manufactured by Tokyo Ink K.K.) 130-fold with distilled water, as dampening water. As a result, more than 3,000 prints with clear images free from background stains were obtained irrespective of the kind of color inks.

EXAMPLES 13 TO 33

Each printing plate was prepared in the same manner as in Example 1 except for using each of the compounds (S) shown in Table D below in place of 1.0 g of Compound (S-1).

TABLE D

| Example | | Compound (S) Containing Fluorine and/or Silicon Atom | | Amount (g/l) |
|---|---|---|---|---|
| 13 | (S-6) | Polyether-modified silicone (TSF 4446 manufactured by Toshiba Silicone Co., Ltd.) | | |
| | | $CH_3-Si(CH_3)_2O(Si(CH_3)_2O)_x(Si(CH_3)_2O)_ySi(CH_3)_2-CH_3$ (presumptive structure) | POA: polyoxyalkylene comprising ethylene oxide (EO) and propylene oxide(PO) (EO/PO: 100/0 by mole) | 0.5 |

TABLE D-continued

| Example | | Compound (S) Containing Fluorine and/or Silicon Atom | Amount (g/l) |
|---|---|---|---|
| 14 | (S-7) | Polyether-modified silicone (TSF 4453 manufactured by Toshiba Silicone Co., Ltd.)<br>$CH_3-SiO(SiO)_x(SiO)_ySi-CH_3$ (with $CH_3$ and POA substituents)<br>(presumptive structure) | POA portion (EO/PO: 75/25 by mole) 0.8 |
| 15 | (S-8) | Polyether-modified silicone (TSF 4460 manufactured by Toshiba Silicone Co., Ltd.)<br>$CH_3-SiO(SiO)_x(SiO)_ySi-CH_3$ (with $CH_3$ and POA substituents)<br>(presumptive structure) | POA portion (EO/PO: 0/100 by mole) 0.5 |
| 16 | (S-9) | Higher fatty acid-modified silicone (TSF 411 manufactured by Toshiba Silicone Co., Ltd.)<br>$R'OCORSiO(SiO)_nSiRCOOR'$ (with $CH_3$ substituents)<br>(presumptive structure) | 1.0 |
| 17 | (S-10) | Epoxy-modified silicone (XF42-A5041 manufactured by Toshiba Silicone Co., Ltd.)<br>$(CH_3)_3SiO(SiO)_x(SiO)_y(SiO)_zSi(CH_3)$ (with $CH_3$, POA, R substituents)<br>(presumptive structure) | 1.2 |
| 18 | (S-11) | Fluorine containing oligomer (Sarflon S-382 manufactured by Asahi Glass Co., Ltd.)<br>(structure unknown) | 0.3 |
| 19 | (S-12) | $(CH_2-C)_{60}-b-(CH_2C)_{40}$ ($COOC_8H_{17}$; $COO(CH_2)_2C_8F_{17}$)<br>Mw $6\times10^3$<br>—b—: bond connecting blocks | 1.5 |
| 20 | (S-13) | $(CH_2-C)_{75}-(CH_2-C)_{25}$ ($COO(CH_2)_2S-[CH_2CH]-COO(CH_2CH_2O)_2OCH_3$; $COO(CH_2)_3Si(OSi(CH_3)_3)_2-CH_3$)<br>Mw $8\times10^3$ (Mw of graft portion $3\times10^3$) | 2 |
| 21 | (S-14) | $R_fO(C_2H_4O)_n(C_3H_6O)_mH$<br>$R_f$: $C_8F_{17}$~$C_{12}F_{25}$ | 0.1 |
| 22 | (S-15) | $CH_2OCOC_8F_{17}$<br>$CHOH$<br>$CH_2OCOC_8F_{17}$ | 0.5 |

TABLE D-continued

| Example | | Compound (S) Containing Fluorine and/or Silicon Atom | Amount (g/l) |
|---|---|---|---|
| 23 | (S-16) | 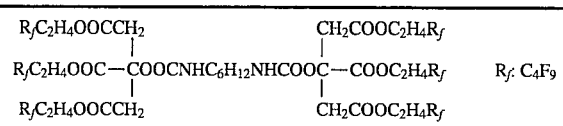 $R_f$: $C_4F_9$ | 0.3 |
| 24 | (S-17) | 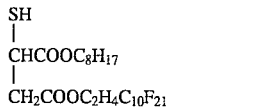 | 1.0 |
| 25 | (S-18) | 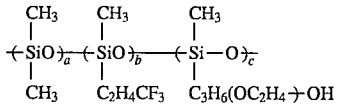 | 0.5 |
| 26 | (S-19) | 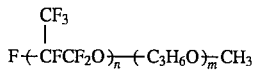 | 0.4 |
| 27 | (S-20) | Carboxy-modified silicone (X-22-3701E manufactured by Shin-Etsu Silicone Co., Ltd. 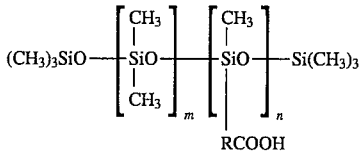 (presumptive structure) | 0.5 |
| 28 | (S-21) | Carbinol-modified silicone (X-22-176B manufactured by Shin-Etsu Silicone Co., Ltd.) 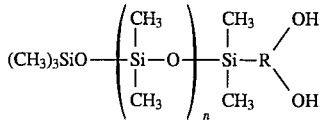 (presumptive structure) | 1.0 |
| 29 | (S-22) | Mercapto-modified silicone (X-22-167B manufactured by Shin-Etsu Silicone Co., Ltd.) 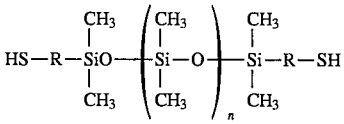 (presumptive structure) | 2 |
| 30 | (S-23) | Amino-modified silicone (KF-804 manufactured by Shin-Etsu Silicone Co., Ltd.) 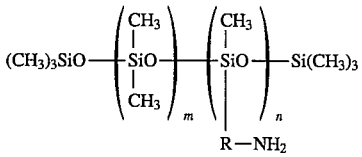 (presumptive structure) | 2.5 |
| 31 | (S-24) | 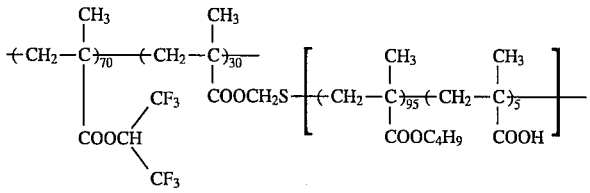 Mw $1\times10^4$ (Mw of graft portion $6\times10^3$) | 5 |

TABLE D-continued

| Example | | Compound (S) Containing Fluorine and/or Silicon Atom | Amount (g/l) |
|---|---|---|---|
| 32 | (S-25) | 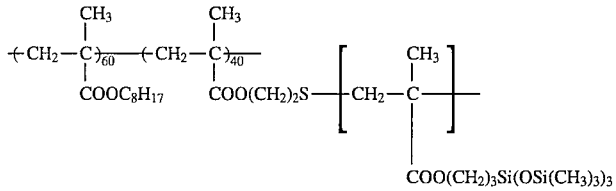 Mw $8\times10^4$ (Mw of graft portion $4\times10^3$) | 10 |
| 33 | (S-26) | 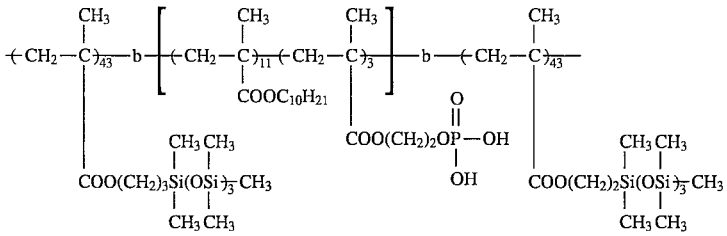 Mw $1.5\times10^4$ | 8 |

Each printing plate obtained provided 60,000 prints of clear images free from background stains. Further, when printing was conducted using various color printing inks in the same manner as in Example 1, the ink-dependency was not observed and good results similar to those in Example 1 were obtained.

EXAMPLES 34 TO 43

Each printing plate was prepared in the same manner as in Example 6 except for using each of the resin grains for the first transfer layer and second transfer layer shown in Table E below in place of Resin Grain (ARH-1) in Dispersion of Resin Grains (L-2) and Resin Grain (ARL-17) in Dispersion of Resin Grains (L-3) respectively. The total thickness of the first and second transfer layers was 4 μm.

TABLE E

| Example | Resin Grain First Layer/ Second Layer | Thickness Ratio First Layer/ Second Layer |
|---|---|---|
| 34 | ARH-4/ARL-2 | 3/2 |
| 35 | ARH-5/ARL-3 | 3/2 |
| 36 | ARH-8/ARL-6 | 7/3 |
| 37 | ARH-9/ARL-8 | 1/1 |
| 38 | ARH-10/ARL-10 | 7/3 |
| 39 | ARH-ll/ARL-12 | 1/1 |
| 40 | ARH-12/ARL-14 | 3/2 |
| 41 | ARH-13/ARL-15 | 7/3 |
| 42 | ARH-14/ARL-9 | 1/1 |
| 43 | ARH-16/ARL-13 | 3/2 |

The evaluation on various characteristics with each of the materials was conducted in the same manner as in Example 6. Good results similar to those in Example 6 were obtained. Specifically, 60,000 prints of clear images free from background stains were provided and the shelf life stability was also good with each material.

EXAMPLES 44 TO 53

Each printing plate was prepared in the same manner as in Example 9 except for using each of the resin grains (ARL) and (ARH) shown in Table F below in place of 5 g of Resin Grain (ARL-6) and 5 g of Resin Grain (ARH-4) in Dispersion of Resin Grains (L-4) respectively.

TABLE F

| Example | Dispersion of Resin Grains | Resin Grain ARL/ARH | Amount ARL/ARH (g) |
|---|---|---|---|
| 44 | L-5 | ARL-2/ARH-1 | 5/5 |
| 45 | L-6 | ARL-4/ARH-2 | 5/5 |
| 46 | L-7 | ARL-5/ARH-3 | 6/4 |
| 47 | L-8 | ARL-8/ARH-6 | 7/3 |
| 48 | L-9 | ARL-9/ARH-1 | 4/6 |
| 49 | L-10 | ARL-10/ARH-9 | 5/5 |
| 50 | L-11 | ARL-11/ARH-15 | 8/2 |
| 51 | L-12 | ARL-12/ARH-19 | 5/5 |
| 52 | L-13 | ARL-14/ARH-21 | 4/6 |
| 53 | L-14 | ARL-15/ARH-22 | 4/6 |

Each printing plate obtained provided 2,000 prints of clear images free from background stains. Further, when printing was conducted using various color printing inks in the same manner as in Example 1, the ink-dependency was not observed and good results similar to those in Example 1 were obtained.

EXAMPLES 54 TO 60

The same procedure as in Example 7 was conducted except for using each of the resins shown in Table G below in place of Resin (A-1) and Resin (A-2) in the transfer layer formed by the heat-melt coating method. A softening point of each of the resins shown in Table G was 100° C. or less.

TABLE G
| Example | Ratio by Weight | Resin (A) Constituting Transfer Layer |
|---|---|---|
| 54 | (A-5) = 100 | (A-5) 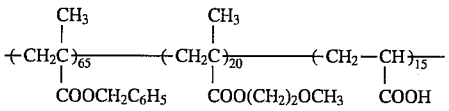 Mw $8\times10^3$, Tg 45° C. |
| 55 | (A-6)/(A-7) = 50/50 | (A-6) 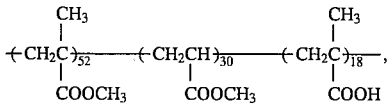 Mw $5\times10^3$, Tg 25° C. (A-7) 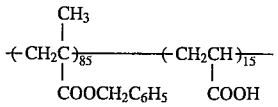 Mw $7\times10^3$, Tg 40° C. |
| 56 | (A-8)/(A-9) = 60/40 | (A-8) 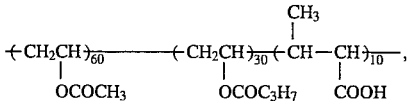 Mw $7\times10^4$, Tg 20° C. (A-9) 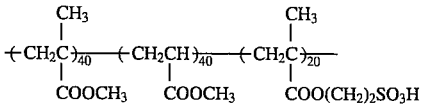 Mw $7\times10^3$, Tg 55° C. |
| 57 | (A-10)/(A-11) = 30/70 | (A-10) 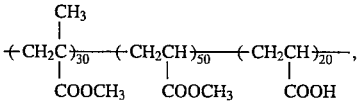 Mw $6\times10^3$, Tg 15° C. (A-11) 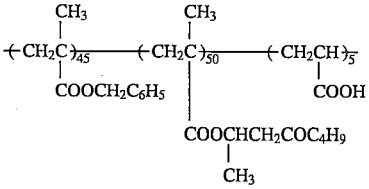 Mw $1.5\times10^4$, Tg 35° C. |
| 58 | (A-12)/(A-8) = 80/20 | (A-12) 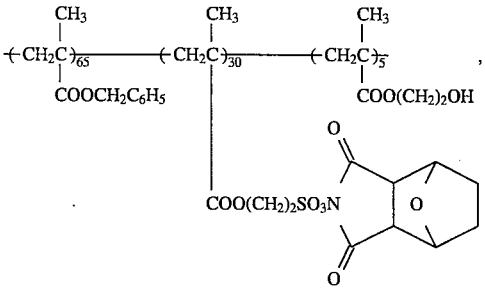 (A-8) Mw $1\times10^4$, Tg 55° C. |
| 59 | (A-13)/(A-14) = 50/50 | (A-13) 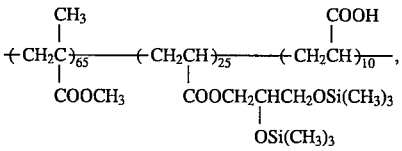 Mw $6\times10^3$, Tg 15° C. (A-14) 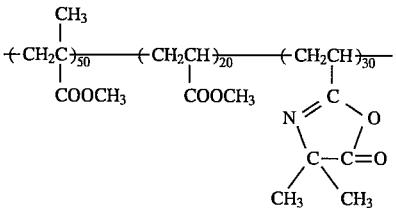 Mw $1\times10^4$, Tg 55° C. |

TABLE G-continued

| Example | Ratio by Weight | Resin (A) Constituting Transfer Layer |
|---|---|---|
| 60 | (A-15) = 100 | (A-15) 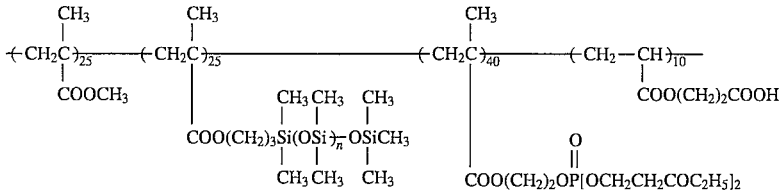 Mw $2.5 \times 10^4$ (Mw of dimethylsiloxane macromonomer portion $5 \times 10^3$), Tg 40° C. |

With each of the materials, various characteristics were evaluated in the same manner as in Example 1. Good results similar to those in Example 1 were obtained. Specifically, 60,000 prints of clear images free from background stains were provided.

EXAMPLES 61 TO 65

Each printing plate was prepared in the same manner as in Example 8 except for replacing the method for formation of transfer layer with the following method.

Formation of Transfer Layer

Paper having a transfer layer composed of each of the resins (A) shown in Table H below having a thickness of 4 μm provided on release paper (San Release manufactured by Sanyo Kokusaku Pulp Co., Ltd.) was installed on a heat transfer means 117 of an apparatus as shown in FIG. 4, and the transfer layer on release paper was transferred onto the surface of light-sensitive element under conditions comprising a pressure between rollers of 3 Kgf/cm$^2$, a surface temperature of 80° C. and a transportation speed of 10 mm/sec. A glass transition point of each of the resins shown in Table H was 80° C. or less.

TABLE H

| Example | Resin (A) Constituting Transfer Layer |
|---|---|
| 61 | (A-16) 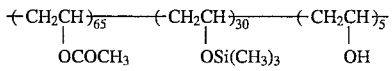 Mw $5 \times 10^4$, Tg 35° C. |
| 62 | A double-layered structure of first layer adjacent to light-sensitive element composed of Resin (A-17) and second layer composed of Resin (A-18) in thickness ratio of 1/1 (A-17) 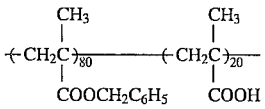 Mw $8 \times 10^3$, Tg 65° C. (A-18) 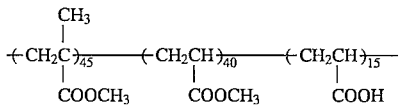 Mw $9 \times 10^3$, Tg 25° C. |
| 63 | A mixture of Resin (A-19) and Resin (A-20) in weight ratio of 1/1 (A-19) 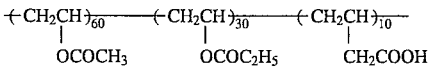 Mw $6 \times 10^4$, Tg 25° C. (A-20) 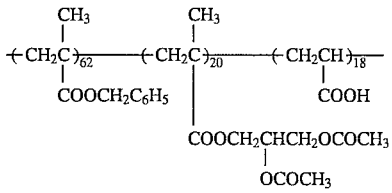 Mw $8 \times 10^3$, Tg 35° C. |

TABLE H-continued

| Example | Resin (A) Constituting Transfer Layer |
|---|---|
| 64 | A double-layered structure of first layer adjacent to light-sensitive element composed of Resin (A-21) and second layer composed of Resin (A-10) in thickness ratio of 2/1 (A-21) 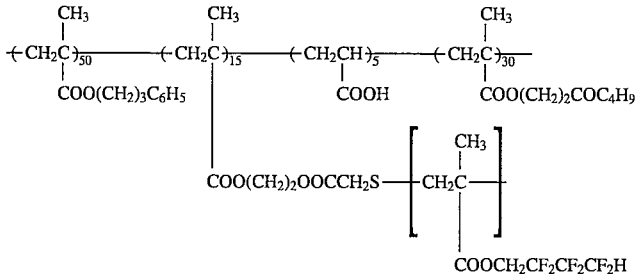 Mw $2\times10^4$ (Mw of macromonomer portion $8\times10^3$), Tg 60° C. |
| 65 | A double-layered structure of first layer adjacent to light-sensitive element composed of Resin (A-22) and second layer composed of Resin (A-18) in thickness ratio of 3/1 (A-22) 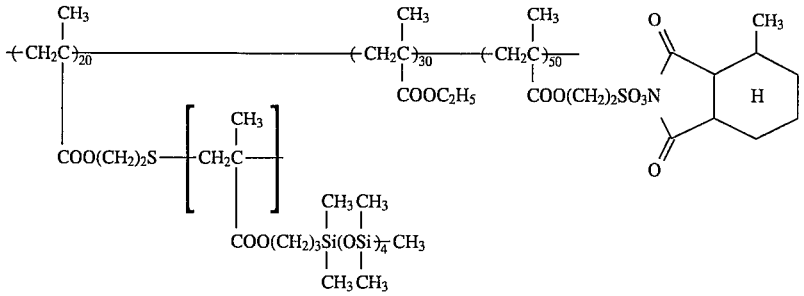 Mw $1\times10^4$ (Mw of marcomonomer portion $5\times10^3$), Tg 65° C. |

As a result of the evaluations on various characteristics with each of the materials in the same manner as in Example 1, good results similar to those in Example 1 were obtained. Specifically, each printing plate provided 60,000 prints of clear images free from background stain.

EXAMPLES 66 TO 77

Each offset printing plate was prepared by subjecting some of the image receiving materials bearing the transfer layers (i.e., printing plate precursors) used in Examples 1 to 65 to the following oil-desensitizing treatment. Specifically, to 0.2 mol of each of the nucleophilic compounds shown in Table I below, 100 g of each of the organic solvents shown in Table I below, and 2 g of Newcol B4SN (manufactured by Nippon Nyukazai K.K.) was added distilled water to make 1 l, and the solution was adjusted to a pH of 12.5. Each printing plate precursor was immersed in the resulting treating solution at a temperature of 35° C. for one minute with moderately rubbing to remove the transfer layer.

Printing was carried out using the resulting printing plate under the same conditions as in each of the basis examples. Each plate exhibited good characteristics similar to those in each of the basis examples.

(Next to Example 101)

TABLE I

| Example | Basis Example for Printing Plate Precursor | Nucleophilic Compound | Organic Solvent |
|---|---|---|---|
| 66 | Example 9 | Sodium sulfite | N,N-Dimethylformamide |
| 67 | Example 7 | Monoethanolamine | Sulfolane |
| 68 | Example 34 | Diethanolamine | Tetrahydrofuran |
| 69 | Example 35 | Thiomalic acid | Ethylene glycol dimethyl ether |
| 70 | Example 39 | Thiosalicylic acid | Benzyl alcohol |
| 71 | Example 49 | Taurine | Ethylene glycol monomethyl ether |
| 72 | Example 51 | 4-Sulfobenzenesulfinic acid | Benzyl alcohol |
| 73 | Example 52 | Thioglycolic acid | Tetramethylurea |
| 74 | Example 58 | 2-Mercaptoethylphosphonic acid | Dioxane |

TABLE I-continued

| Example | Basis Example for Printing Plate Precursor | Nucleophilic Compound | Organic Solvent |
|---|---|---|---|
| 75 | Example 60 | Cysteine | N-Methylacetamide |
| 76 | Example 65 | Sodium thiosulfate | Methyl ethyl ketone |
| 77 | Example 64 | Ammonium sulfite | N,N-Dimethylacetamide |

EXAMPLE 101

A mixture of 2 g of X-form metal-free phthalocyanine (manufactured by Dainippon Ink and Chemicals, Inc.), 10 g of Binder Resin (B-101) having the structure shown below, 0.15 g of Compound (A) described above, and 80 g of tetrahydrofuran was put into a 500 ml-volume glass container together with glass beads and dispersed in a paint shaker (manufactured by Toyo Seiki Seisakusho Co.) for 60 minutes. The glass beads were separated by filtration to prepare a dispersion for a light-sensitive layer.

Binder Resin (B-101)

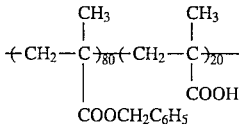

Mw $3.5\times10^4$

The resulting dispersion was coated on base paper for a paper master having a thickness of 0.2 mm, which had been subjected to electrically conductive treatment and solvent-resistant treatment, by a wire bar, set to touch, and heated in a circulating oven at 100° C. for 20 seconds to form a light-sensitive layer having a thickness of 8 μm. The adhesion strength of the surface of the resulting electrophotographic light-sensitive element was 400 gf.

Figure 6:
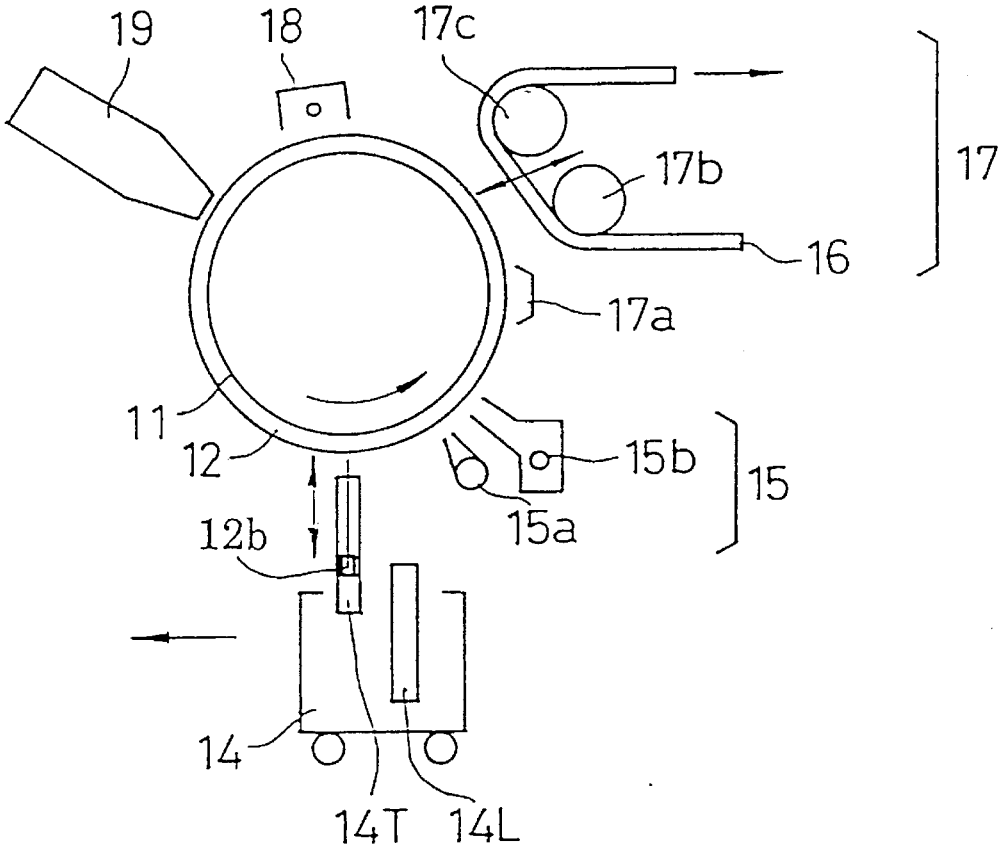
FIG. 6 is a schematic view of an electrophotographic plate-making apparatus using an electrodeposition coating method for the formation of transfer layer.
Figure 7:
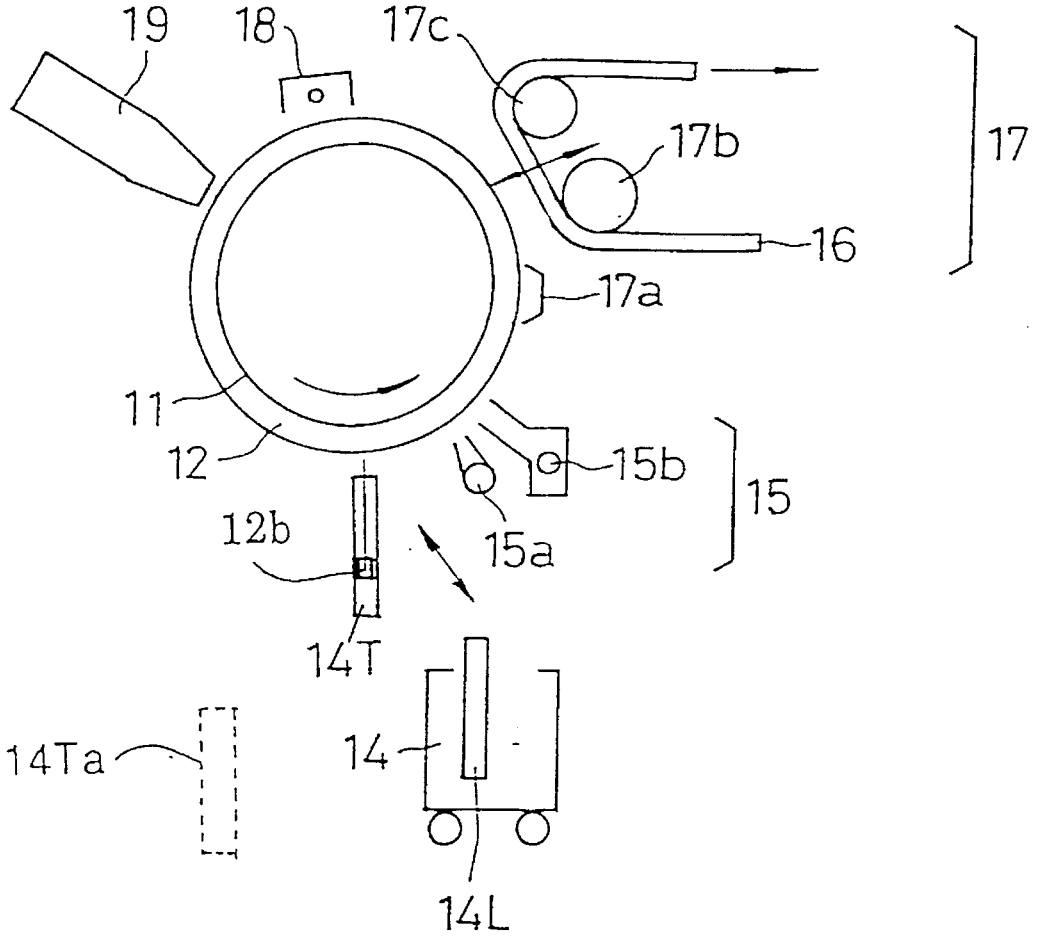
FIG. 7 is a schematic view of an electrophotographic plate-making apparatus using an electrodeposition coating method for the formation of transfer layer.

The electrophotographic light-sensitive element was installed in an apparatus as shown in FIG. 6. On the surface of light-sensitive element installed on a drum which was rotated at a circumferential speed of 10 mm/sec, Dispersion of Resin Grains (L-101) shown below was supplied using a slit electrodeposition device, while putting the light-sensitive element to earth and applying an electric voltage of −180 V to an electrode of the slit electrodeposition device, whereby the resin grains were electrodeposited. The dispersion medium was removed by air-squeezing, and the resin grains were fused by an infrared line heater to form a film, whereby a transfer layer composed of a thermoplastic resin was prepared on the light-sensitive element. A thickness of the transfer layer was 3 μm.

| Dispersion of Resin Grains (L-101) | |
|---|---|
| Resin Grain (ARL-1) | 6 g (solid basis) |
| Compound (S-1) | 0.5 g |
| Charge Control Agent (CD-1) | 0.02 g |
| Branched Tetradecyl Alcohol (FOC-1400 manufactured by Nissan Chemical Industries, Ltd.) | 10 g |
| Isopar H | 1 liter |

The adhesive strength of the transfer layer measured according to the method described above was 4 gf and the whole transfer layer was uniformly peeled from the surface of light-sensitive element.

The resulting light-sensitive material was evaluated for image forming performance and transferability as follows.

The light-sensitive material was charged to +450 V with a corona discharge in dark and exposed to light of a gallium-aluminum-arsenic semiconductor laser (out-put: 5 mW; oscillation wavelength: 780 nm) at an irradiation dose (on the surface of the light-sensitive material) of 30 erg/cm$^2$, a pitch of 25 μm, and a scanning speed of 300 cm/sec. The scanning exposure was in a negative mirror image mode based on the digital image data of an original read by a color scanner and memorized in a hard disc.

Thereafter, the light-sensitive material was subjected to reversal development using Liquid Developer (LD-101) prepared in the manner as described below in a developing machine having a pair of flat development electrodes, and a bias voltage of +400 V was applied to the electrode on the side of the light-sensitive material to thereby electrodeposit toner particles on the exposed areas. The light-sensitive material was then rinsed in a bath of Isopar H alone to remove any stains on the non-image areas.

Preparation of Liquid Developer (LD-101)

1) Synthesis of Toner Particles:

A mixed solution of 60 g of methyl methacrylate, 40 g of methyl acrylate, 20 g of a dispersion polymer having the structure shown below, and 680 g of Isopar H was heated to 65° C. under nitrogen gas stream with stirring. To the solution was added 1.2 g of 2,2'-azobis(isovaleronitrile) (AIVN), followed by allowing the mixture to react for 2 hours. To the reaction mixture was further added 0.5 g of AIVN, and the reaction was continued for 2 hours. To the reaction mixture was further added 0.5 g of AIVN, and the reaction was continued for 2 hours. The temperature was raised up to 90° C., and the mixture was stirred under a reduced pressure of 30 mm Hg for 1 hour to remove any unreacted monomers. After cooling to room temperature, the reaction mixture was filtered through a nylon cloth of 200 mesh to obtain a white dispersion. The reaction rate of the monomers was 95%, and the resulting dispersion had an average grain diameter of resin grain of 0.25 μm (grain diameter being measured by CAPA-500 manufactured by Horiba, Ltd.) and good monodispersity.

Chemical Structure of Dispersion Polymer

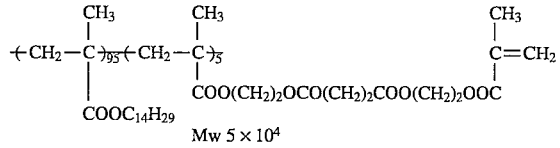

Mw $5\times10^4$

2) Preparation of Colored Particles:

Ten grams of a tetradecyl methacrylate/methacrylic acid copolymer (95/5 ratio by weight), 10 g of nigrosine, and 30 g of Isopar G were put in a paint shaker (manufactured by Toyo Seiki Seisakusho Co.) together with glass beads and dispersed for 4 hours to prepare a fine dispersion of nigrosine.

3) Preparation of Liquid Developer:

A mixture of 45 g of the above-prepared toner particle dispersion, 25 g of the above-prepared nigrosine dispersion, 0.6 g of a hexadecene/maleic acid monooctadecylamide copolymer (1/1 ratio by mole), and 15 g of branched octadecyl alcohol (FOC-1800 manufacture by Nissan Chemical Industries, Ltd.) was diluted with 1 l of Isopar G to prepare a liquid developer for electrophotography.

The light-sensitive material was then subjected to fixing by means of a heat roll whereby the toner image thus-formed was fixed.

An aluminum substrate used for the production of FPD and the thus-developed light-sensitive material were superposed each other, and they were passed through between a pair of rubber rollers having a nip pressure of 10 kgf/cm$^2$ at a speed of 6 mm/sec. The surface temperature of the rollers was controlled to maintain constantly at 120° C.

After cooling the both materials while being in contact with each other to room temperature, the aluminum substrate was stripped from the light-sensitive element. The image formed on the aluminum substrate was visually evaluated for fog and image quality. As a result it was found that the whole toner image on the light-sensitive material according to the present invention was heat-transferred together with the transfer layer onto the aluminum substrate to provide a clear image without background stain on the aluminum substrate which showed substantially no degradation in image quality as compared with the original.

The transfer layer formed by using the dispersion of resin grains containing the compound (S) according to the present invention provided good releasability on the surface of electrophotographic light-sensitive element to make possible easy transfer of the transfer layer onto a receiving material.

Then, the plate of aluminum substrate having thereon the transfer layer was subjected to an oil-desensitizing treatment (i.e., removal of the transfer layer) to prepare a printing plate and its printing performance was evaluated. Specifically, the plate was immersed in Oil-Desensitizing Solution (E-101) having the composition shown below at 25° C. for 30 seconds with moderate rubbing of the surface of plate to remove the transfer layer, thoroughly washed with water, and gummed to obtain a printing plate.

| Oil-Desensitizing Solution (E-101) | |
|---|---|
| Mercaptoethanesulfonic acid | 10 g |
| Neosoap (manufactured by Matsumoto Yushi K.K.) | 8 g |
| N,N-Dimethylacetamide | 20 g |
| Distilled water | to make 1.0 l |
| Sodium hydroxide | to adjust to pH 13.0 |

The printing plate thus prepared was observed visually using an optical microscope of 200 magnifications. It was found that the non-image areas had no residual transfer layer, and the image areas suffered no defects in high definition regions (i.e., cutting of fine lines and fine letters).

The printing plate was subjected to printing on neutral paper with various offset printing color inks using an offset printing machine (Oliver 94 Model manufactured by Sakurai Seisakusho K.K.), and an aqueous solution (pH: 7.0) prepared by diluting dampening water for PS plate (SG-23 manufactured by Tokyo Ink K.K.) 130-fold with distilled water, as dampening water. As a result, more than 60,000 prints with clear images free from background stains were obtained irrespective of the kind of color inks.

Moreover, when the printing plate according to the present invention was exchanged for a conventional PS plate and printing was continued under ordinary conditions, no trouble arose. It was thus confirmed that the printing plate according to the present invention can share a printing machine with other offset printing plates such as PS plates.

As described above, the offset printing plate according to the present invention exhibits excellent performance in that an image formed by a scanning exposure system using semiconductor laser beam has excellent image reproducibility and the image of the plate can be reproduced on prints with satisfactory quality, in that the plate exhibits sufficient color ink receptivity without substantial ink-dependency to enable to perform full color printing with high printing durability, and in that it can share a printing machine in printing with other offset printing plates without any trouble.

COMPARATIVE EXAMPLE 101

In the same manner as in Example 101, a transfer layer was formed on the electrophotographic light-sensitive element except for using a dispersion of resin grains prepared d by eliminating 0.5 g of Compound (S-1) from Dispersion of Resin Grains (L-101). The resulting light-sensitive material was subjected to the measurement of adhesive strength. As a result, a pressure-sensitive adhesive tape was peeled from the transfer layer and the transfer layer was not released from the light-sensitive element. This fact means that transferability of the transfer layer is not effected.

EXAMPLE 102

An amorphous silicon electrophotographic light-sensitive element was installed in an apparatus as shown in FIG. 6. The adhesive strength of the surface thereof was 265 gf.

On the surface of light-sensitive element installed on a drum, whose surface temperature was adjusted to 60° C. and which was rotated at a circumferential speed of 10 mm/sec, Dispersion of Resin Grains (L-102) shown below was supplied using a slit electrodeposition device, while putting the light-sensitive element to earth and applying an electric voltage of −200 V to an electrode of the slit electrodeposition device, whereby the resin grains were electrodeposited. The resin grains deposited were then fixed.

| Dispersion of Resin Grains (L-102) | |
|---|---|
| Resin Grain (ARL-2) | 6 g (solid basis) |
| Compound (S-2) | 0.3 g |
| Positive-Charge Control Agent (CD-3) (zirconium naphthenate) | 0.05 g |
| Silicone Oil (KF-96 manufactured by Shin-Etsu Silicone Co., Ltd.) | 10 g |
| Isopar G | 1 liter |

The adhesive strength of the resulting transfer layer was 3 gf and the whole transfer layer was uniformly and easily peeled from the surface of light-sensitive element.

On the light-sensitive material, toner images were then formed. Specifically, the light-sensitive material was charged to +700 V with a corona discharge in dark and exposed to light of a gallium-aluminumarsenic semiconductor laser (output: 5 mW; oscillation wavelength: 780 nm) at an irradiation dose (on the surface of the light-sensitive material) of 25 erg/cm$^2$, a pitch of 25 μm, and a scanning speed of 300 cm/sec. The scanning exposure was in a negative mirror image mode based on the digital image data of an original read by a color scanner and memorized in a hard disc.

Thereafter, the light-sensitive material was subjected to reversal development using Liquid Developer (LD-101) in a developing machine having a pair of flat development electrodes, and a bias voltage of +300 V was applied to the electrode on the side of the light-sensitive material to thereby electrodeposit toner particles on the exposed areas. The light-sensitive material was then rinsed in a bath of Isopar H alone to remove any stains on the non-image areas.

The light-sensitive material was then subjected to fixing by means of a heat roll whereby the toner image thus-formed was fixed.

An aluminum substrate used for FPD and the thus-developed light-sensitive material were superposed each other, and they were passed through between a pair of rubber rollers having a nip pressure of 8 Kgf/cm$^2$ at a transportation speed of 8 mm/sec. The surface temperature of the rollers was controlled to maintain constantly at 120° C.

After cooling the both materials while being in contact with each other to room temperature, the aluminum substrate was stripped from the light-sensitive element. The image formed on the aluminum substrate was visually evaluated for fog and image quality. As a result it was found that the whole toner image on the light-sensitive material according to the present invention was heat-transferred together with the transfer layer onto the aluminum substrate to provide a clear image without background stain on the aluminum substrate which showed substantially no degradation in image quality as compared with the original.

It is believed that the excellent transferability is resulted from the adsorption or adherence of the compound (S) used in the formation of transfer layer onto the surface of light-sensitive element. Thus, a definite interface having a good release property was formed between the light-sensitive element and the transfer layer.

Then, the plate of aluminum substrate having thereon the transfer layer was subjected to an oil-desensitizing treatment (i.e., removal of the transfer layer) to prepare a printing plate and its printing performance was evaluated. Specifically, the plate was immersed in Oil-Desensitizing Solution (E-102) having the composition shown below at 25° C. for 60 seconds with moderate rubbing of the surface of plate to remove the transfer layer, thoroughly washed with water, and gummed to obtain a printing plate.

| Oil-Desensitizing Solution (E-102) | |
|---|---|
| PS plate processing solution (DP-4 manufactured by Fuji Photo Film Co., Ltd.) | 100 g |
| N-Methylethanolamine | 9 g |
| Distilled water | to make 1 l (pH: 12.5) |

The printing plate thus prepared was observed visually using an optical microscope of 200 magnifications. It was found that the non-image areas had no residual transfer layer, and the image areas suffered no defects in high definition regions (i.e., cutting of fine lines and fine letters).

The printing plate was subjected to printing on neutral paper with various offset printing color inks using an offset printing machine (Oliver 94 Model manufactured by Sakurai Seisakusho K.K.), and an aqueous solution (pH: 7.0) prepared by diluting dampening water for PS plate (SG-23 manufactured by Tokyo Ink K.K.) 130-fold with distilled water, as dampening water. As a result, more than 60,000 prints with clear images free from background stains were obtained irrespective of the kind of color inks.

EXAMPLE 103

A mixture of 100 g of photoconductive zinc oxide, 18 g of Binder Resin (B-102) having the structure shown below, 2 g of Binder Resin (B-103) having the structure shown below, 0.01 g of uranine, 0.02 g of Rose Bengal, 0.01 g of bromophenol blue, 0.15 g of maleic anhydride and 150 g of toluene was dispersed by a homogenizer (manufactured by Nippon Seiki K.K.) at a rotation of $1\times10^4$ r.p.m. for 10 minutes. To the dispersion were added 0.02 g of phthalic anhydride and 0.001 g of o-chlorophenol, and the mixture was dispersed by a homogenizer at a rotation of $1\times10^3$ r.p.m. for 1 minute.

The resulting dispersion was coated on base paper for a paper master having a thickness of 0.2 mm, which had been subjected to electrically conductive treatment and solvent-resistant treatment, by a wire bar at a coverage of 25 g/m$^2$, set to touch and heated in a circulating oven at 120° C. for one hour.

Binder Resin (B-102)

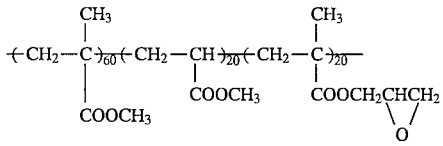

Mw $5\times10^4$

Binder Resin (B-103)

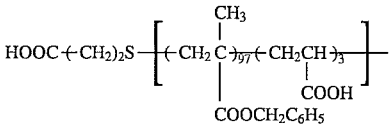

Mw $8\times10^3$

The adhesive strength of the surface of the thus-obtained electrophotographic light-sensitive element was more than 400 gf and did not exhibit releasability.

On the surface of light-sensitive element were electrodeposited resin grains using Dispersion of Resin Grains (L-103) shown below while applying an electric voltage of −200 V an the resin grains deposited were heated at a temperature of 100° C. for 3 minutes to form a transfer layer having a thickness of 5 μm.

| Dispersion of Resin Grains (L-103) | |
|---|---|
| Resin Grain (ARH-1) | 6 g (solid basis) |
| Resin Grain (ARL-3) | 4 g (solid basis) |
| Compound (S-27) | 0.1 g |

Carboxy-modified silicone oil

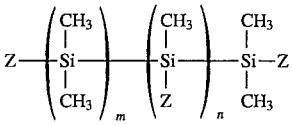

(presumptive structure)

Z: $-CH_3$ or $-R'COOH$

-continued

| Dispersion of Resin Grains (L-103) | |
|---|---|
| Positive-Charge Control Agent (CD-4) | 0.018 g |
| 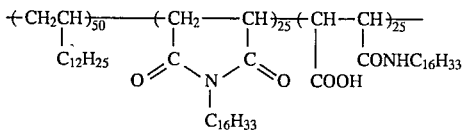 | |
| Branched Hexadecyl Alcohol (FOC-1600 manufactured by Nissan Chemical Industries, Ltd.) | 15 g |
| Isopar G | 1 liter |

The adhesive strength of the resulting transfer layer was 8 gf and the whole transfer layer was uniformly and easily peeled from the surface of light-sensitive element.

The electrophotographic light-sensitive element having the transfer layer thereon thus-obtained was allowed to stand overnight under the condition of 25° C. and 60% RH. Then, the light-sensitive element was subjected to image formation by a plate-making machine (ELP-404V manufactured by Fuji Photo Film Co., Ltd.) with a bias voltage of 100 V in a development part using a liquid developer (ELP-TX manufactured by Fuji Photo Film Co., Ltd.). The duplicated images formed on the transfer layer were good and clear even in highly accurate image portions such as letters, fine lines and continuous tone areas composed of dots. Also, background stain in the non-image areas was not observed.

The light-sensitive material having the toner images was brought into contact with a sheet of Straight Master (manufactured by Mitsubishi Paper Mills, Ltd.) as a receiving material and they were passed between a pair of hollow metal rollers covered with silicone rubber each having an infrared lamp heater integrated therein. A surface temperature of each of the rollers was 90° C., a nip pressure between the rollers was 4 kgf/cm$^2$, and a transportation speed was 8 mm/sec.

After cooling the both sheets while being in contact with each other to room temperature, the Straight Master was separated from the light-sensitive element whereby the toner images were transferred together with the transfer layer to the Straight Master.

As a result of visual evaluation of the images transferred on the Straight Master, it was found that the transferred images were almost same as the duplicated images on the light-sensitive material before transfer and degradation of image was not observed. Also, on the surface of the light-sensitive element after transfer, the residue of the transfer layer was not observed at all. These results indicated that the transfer had been completely performed.

Then, the sheet of Straight Master having thereon the transfer layer was subjected to an oil-desensitizing treatment to prepare a printing plate and its printing performance was evaluated. Specifically, the sheet was immersed in an oil-desensitizing solution having a pH of 13.1 prepared by diluting a commercially available PS plate processing solution (DP-4 manufactured by Fuji Photo Film Co., Ltd.) 7-fold with distilled water at a temperature of 25° C. for 1 minute with moderate rubbing of the surface of the sheet to remove the transfer layer, thoroughly washed with water, and gummed to obtain a printing plate.

The printing plate thus prepared was observed visually using an optical microscope of 200 magnifications. It was found that the non-image areas had no residual transfer layer, and the image areas suffered no defects in high definition regions (i.e., cutting of fine lines and fine letters).

The printing plate was subjected to printing on neutral paper with various offset printing color inks using an offset printing machine (Ryobi 3200 MCD Model manufactured by Ryobi Ltd.), and an aqueous solution (pH: 7.0) prepared by diluting dampening water for PS plate (SG-23 manufactured by Tokyo Ink K.K.) 130-fold with distilled water, as dampening water. As a result, more than 3,000 prints with clear images free from background stains were obtained irrespective of the kind of color inks.

In a conventional system wherein an electrophotographic light-sensitive element utilizing zinc oxide is oil-desensitized with an oil-desensitizing solution containing a chelating agent as the main component under an acidic condition to prepare a lithographic printing plate, printing durability of the plate is in a range of several hundred prints without the occurrence of background stain in the non-image areas when neutral paper is used for printing or when offset printing color inks other than black ink are employed. Contrary to the conventional system, the method for preparation of electrophotographic lithographic printing plate according to the present invention can provide a lithographic printing plate having excellent printing performance in spite of using zinc oxide-containing light-sensitive element.

EXAMPLE 104

An electrophotographic light-sensitive material was formed in the same manner as in Example 101 except for forming a transfer layer of a double layered structure by applying a first transfer layer having a thickness of 2 μm to the surface of X-form metal-free phthalocyanine light-sensitive element using Dispersion of Resin Grains (L-104) described below and then applying a second transfer layer having a thickness of 2 μm on the first transfer layer using Dispersion of Resin Grains (L-105) dscribed below in place of the transfer layer using Dispersion of Resin Grains (L-101) in Example 101.

| Dispersion of Resin Grains (L-104) | |
|---|---|
| Resin Grain (ARH-2) | 6 g (solid basis) |
| Compound (S-1) | 0.5 g |
| Positive Charge Control Agent (CD-1) | 0.02 g |
| Branched Octadecyl Alcohol (FOC-1800) | 10 g |
| Isopar G | 1 liter |

| Dispersion of Resin Grains (L-105) | |
|---|---|
| Resin Grain (ARL-4) | 6 g (solid basis) |
| Positive-Charge Control Agent (CD-1) | 0.025 g |
| Branched Octadecyl Alcohol (FOC-1800) | 10 g |
| Isopar G | 1 liter |

The resulting light-sensitive material was subjected to the formation of toner image thereon and the heat-transfer in the same manner as in Example 101 except for using heat-transfer conditions comprising a pressure of 5 Kgf/cm$^2$, a surface temperature of 90° C. and a transportation speed of 10 mm/sec to prepare a printing plate precursor comprising an aluminum substrate for FPD having thereon the toner image together with the transfer layer.

The image transferred onto the aluminum substrate was clear without background fog, and any degradation in image quality due to unevenness of transfer was not observed.

From these results it can be seen that the transfer layer of double-layered structure composed of a layer containing the resin having a relatively high glass transition point and a layer containing the resin having a relatively low glass transition point makes heat-transfer under more moderate conditions of pressure and temperature and at increased speed possible in comparison with those in Example 101. Such improved transferability is believed to be due to increase in adhesion of the transfer layer composed of resin having a relatively low glass transition point to the surface of aluminum substrate as a receiving material and also increase in releasability of the transfer layer composed of resin having a relatively high glass transition point from the surface of light-sensitive element.

Then, the plate of aluminum substrate having thereon the transfer layer was treated to prepare a printing plate and using the printing plate printing was conducted in the same manner as in Example 101. As a result, the transfer layer was completely removed upon the oil-desensitizing treatment and background stain was not observed. Further, the resistivity of image areas was good and cutting of toner image was not recognized in highly accurate image portions such as fine letters, fine lines and dots for half-tone areas of continuous gradation. The printing plate was subjected to printing using various color inks and more than 60,000 good prints were obtained.

Further, the aluminum substrates bearing the images transferred together with the transfer layer thereon (i.e., printing plate precursors) were put one upon another, a pressure of 5 Kgf/cm$^2$ was applied thereto and allowed to stand for one week. After separation of these aluminium substrates, the transfer layer of the lower aluminum substrate was visually observed. As a result, peeling of the transfer layer and cutting of toner image were not recognized. This result illustrates a good shelf life stability of the printing plate precursor and advantage of operations.

EXAMPLE 105

A transfer layer having a thickness of 5 μm was formed on an amorphous silicon electrophotographic light-sensitive element in the same manner as in Example 102 except for using Dispersion of Resin Grains (L-106) shown below in place of Dispersion of Resin Grains (L-102).

| Dispersion of Resin Grains (L-106) | |
|---|---|
| Resin Grain (ARH-5) | 6 g (solid basis) |
| Resin Grain (ARL-7) | 6 g (solid basis) |
| Compound (S-28) | 1.0 g |

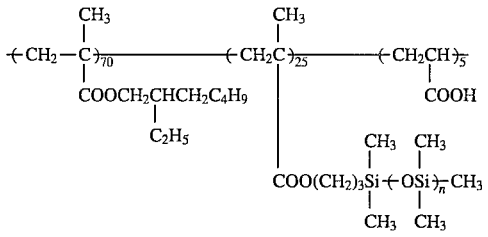

Mw $8 \times 10^3$ (Mw of graft portion $5 \times 10^3$)

| | |
|---|---|
| Positive-Charge Control Agent (CD-1) | 0.02 g |
| Branched Tetradecyl Alcohol (FOC-1400) | 15 g |
| Isopar G | 1 liter |

Using the resulting light-sensitive material, the same procedure as in Example 102 was conducted to prepare a printing plate excepting for using heat-transfer conditions comprising a pressure of 4 Kgf/cm$^2$, a surface temperature of 100° C. and a transportation speed of 10 mm/sec.

As a result, it was found that the light-sensitive material having the transfer layer according to the present invention exhibited good image forming performance. The transferability of the transfer layer was also good and the transfer layer was entirely transferred together with tone images. With respect to the characteristics on a printing plate, the transfer layer was completely removed upon the oil-desensitizing treatment and background stain was not observed. Further, the resistivity of image areas was good and cutting of toner image was not recognized in highly accurate image portions such as fine letters, fine lines and dots for half-tone areas of continuous gradation. The printing plate was subjected to printing using various color inks and more than 60,000 good prints were obtained.

It is apparent that when the transfer layer composed of a mixture of the resin having a relatively high glass transition point and the resin having a relatively low glass transition point was employed, the heat-transfer can be performed under moderate conditions as compared with a case of using a transfer layer composed of only one resin as in Example 102.

EXAMPLES 106 TO 126

Each printing plate was prepared in the same manner as in Example 105 except for using each of the compounds (S) shown in Table J below in place of 1.0 g of Compound (S-28) in Dispersion of Resin Grains (L-106).

TABLE J

| Example | Compound (S) Containing Fluorine and/or Silicon Atom | Amount (g/l) |
|---|---|---|
| 106 | (S-6) | 0.5 |
| 107 | (S-7) | 0.8 |
| 108 | (S-8) | 0.5 |
| 109 | (S-9) | 1.0 |
| 110 | (S-10) | 1.2 |
| 111 | (S-11) | 0.3 |
| 112 | (S-12) | 1.5 |
| 113 | (S-13) | 2. |
| 114 | (S-14) | 0.1 |
| 115 | (S-15) | 0.5 |
| 116 | (S-16) | 0.3 |
| 117 | (S-17) | 1.0 |
| 118 | (S-18) | 0.5 |
| 119 | (S-19) | 0.4 |
| 120 | (S-20) | 0.5 |
| 121 | (S-21) | 1.0 |
| 122 | (S-22) | 2 |
| 123 | (S-23) | 2.5 |
| 124 | (S-24) | 5 |
| 125 | (S-25) | 10 |
| 126 | (S-26) | 8 |

Each of the resulting printing plate provided 60,000 prints of clear image free from cutting without the formation of background stain in the non-image area. These results indicated that the transfer layer was rapidly and completely removed upon the oil-desensitizing treatment and cutting of the toner image did not occur. Further, a good shelf life stability was recognized as a result of the evaluation under the stressed condition as described in Example 104.

EXAMPLES 127 TO 136

Each printing plate was prepared in the same manner as in Example 102 except for using each of the Dispersion of Resin Grains (L) shown below in place of Dispersion of Resin Grains (L-102).

| Dispersion of Resin Grains (L) | |
|---|---|
| Resin Grain shown in Table K below | 6 g (solid basis) |
| Compound (S-29) | 0.5 g |

Silicone surface active agent (SILWet FZ-2166 manufactured by Nippon Unicar Co., Ltd.)

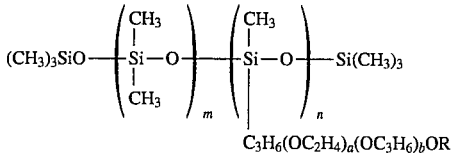

| | |
|---|---|
| Positive Charge Control Agent (CD-1) | 0.03 g |
| Polymeric Charge Imparting Aid | 1 g |

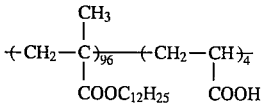

Mw $3\times10^4$

| | |
|---|---|
| Isopar G | 1 liter |

TABLE K

| Example | Dispersion of Resin Grains (L) | Resin Grain | Weight Ratio |
|---|---|---|---|
| 127 | L-107 | ARL-10 | |
| 128 | L-108 | ARH-3/ARL-5 | 1/1 |
| 129 | L-109 | ARH-6/ARL-6 | 3/2 |
| 130 | L-110 | ARH-8/ARL-8 | 7/3 |
| 131 | L-111 | ARH-11/ARL-9 | 2/3 |
| 132 | L-112 | ARH-9/ARL-10 | 1/1 |
| 133 | L-113 | ARH-10/ARL-11 | 4/1 |
| 134 | L-114 | ARH-14/ARL-12 | 1/1 |
| 135 | L-115 | ARH-13/ARL-13 | 2/3 |
| 136 | L-116 | ARH-18/ARL-14 | 2/3 |

Each of the resulting printing plates provided 60,000 prints of good characteristics similar to those in Example 102.

EXAMPLES 137 TO 146

Each printing plate was prepared in the same manner as in Example 104 except for using each of the resin grains for the first transfer layer and second transfer layer shown in Table L below in place of Resin Grain (ARH-2) in Dispersion of Resin Grains (L-104) and Resin Grain (ARL-4) in Dispersion of Resin Grains (L-105) respectively. The total thickness of the first and second transfer layers was 4 μm.

TABLE L

| Example | Resin Grain First Layer/ Second Layer | Thickness Ratio First Layer/ Second Layer |
|---|---|---|
| 137 | ARH-11/ARL-1 | 3/2 |
| 138 | ARH-12/ARL-5 | 3/2 |

TABLE L-continued

| Example | Resin Grain First Layer/ Second Layer | Thickness Ratio First Layer/ Second Layer |
|---|---|---|
| 139 | ARH-13/ARL-6 | 7/3 |
| 140 | ARH-16/ARL-8 | 1/1 |
| 141 | ARH-17/ARL-9 | 7/3 |
| 142 | ARH-19/ARL-15 | 1/1 |
| 143 | ARH-20/ARL-16 | 3/2 |
| 144 | ARH-21/ARL-7 | 7/3 |
| 145 | ARH-22/ARL-10 | 1/1 |
| 146 | ARH-18/ARL-11 | 3/2 |

Each of the resulting printing plates provided more than 60,000 prints of good characteristics similar to those in Example 104.

EXAMPLE 147

A mixture of 100 g of photoconductive zinc oxide, 18 g of Binder Resin (B-104) having the structure shown below, 2 g of Binder Resin (B-105) having the structure shown below, 0.02 g of Dye (D-3) having the structure shown below, 0.1 g of thiosalicylic acid and 300 g of toluene was dispersed in a homogenizer at a rotation of $9\times10^3$ r.p.m. for 15 minutes.

Binder Resin (B-104)

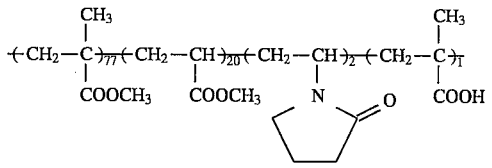

Mw $7\times10^4$

Binder Resin (B-105)

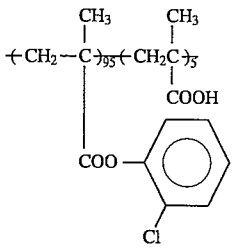

Mw $8\times10^3$

Dye (D-3)

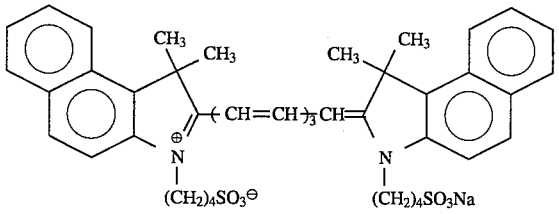

The resulting dispersion was coated on base paper for a paper master having a thickness of 0.2 mm, which had been subjected to electrically conductive treatment and solvent-resistant treatment, at a coverage of 25 g/m$^2$ by a wire bar and dried at 110° C. for 20 seconds. The adhesive strength of the surface of the resulting light-sensitive element was more than 400 gf.

On the surface of light-sensitive element was prepared a transfer layer of double-layered structure in the same manner as described in Example 104.

The resulting light-sensitive material was charged with a corona discharge of −6 kV in dark and exposed to light of a gallium-aluminum-arsenic semiconductor laser (output: 5 mW; oscillation wavelength: 780 nm) at an irradiation dose on the surface of the light-sensitive material of 30 erg/cm$^2$, a pitch of 25 μm, and a scanning speed of 300 cm/sec. The scanning exposure was in a positive mirror image mode based on the digital image data of an original read by a color scanner and memorized in a hard disc.

Then, the exposed light-sensitive material was developed using Liquid Developer (LD-101) while applying a bias voltage of 150 V and rinsed in a bath of Isopar H alone to remove stains on the non-image areas. The toner images were fixed by heating.

Using as a receiving material a printing plate precursor comprising a paper support laminated with an aluminum metal foil and subjected to electrically conductive treatment and solvent-resistant treatment having provided thereon an image receiving layer having the same composition as the image receptive layer of Straight Master, the transfer layer was transferred together with the toner images onto the image receiving layer under the transfer conditions as follows:

| | |
|---|---|
| Nip pressure between rollers: | 8 Kgf/cm$^2$ |
| Surface temperature of rollers: | 90° C. |
| Transportation speed: | 8 mm/sec |

The images formed on the printing plate precursor were clear without cutting of letters and fine lines. Also, on the surface of light-sensitive element no residual transfer layer was observed.

The printing plate precursor was subjected to the oil-desensitizing treatment and printing in the same manner as in Example 104. The duplicated images obtained exhibited good reproduction of letters and lines which was sufficient for practical use. The transferability and oil-desensitizing property were good and neither residual transfer layer in the non-image areas nor cutting of toner image was observed. Further, a printing durability was more than 10,000 prints.

EXAMPLE 148

A mixture of 5 g of a bisazo pigment having the structure shown below, 95 g of tetrahydrofuran and 5 g of a polyester resin (Vylon 200 manufactured by Toyoho Co., Ltd.) was thoroughly pulverized in a ball mill. The mixture was added to 520 g of tetrahydrofuran with stirring. The resulting dispersion was coated on a conductive transparent substrate composed of a 100 μm-thick polyethylene terephthalate film having a deposited layer of indium oxide thereon (surface resistivity: $10^3$ Ω) by a wire round rod to prepare a charge generating layer having a thickness of about 0.7 μm.

Bisazo Pigment

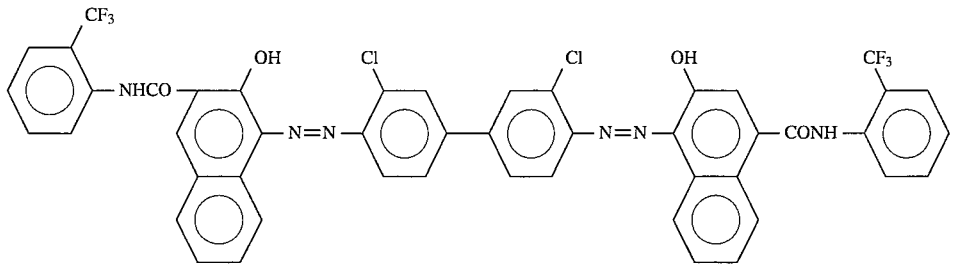

A mixed solution of 20 g of a hydrazone compound having the structure shown below, 20 g of a polycarbonate resin (Lexan 121 manufactured by General Electric Co., Ltd.) and 160 g of tetrahydrofuran was coated on the above-described charge generating layer by a wire round rod, dried at 60° C. for 30 seconds and then heated at 100° C. for 20 seconds to form a charge transporting layer having a thickness of about 18 μm whereby an electrophotographic light-sensitive layer of a double-layered structure was prepared.

Hydrazone Compound

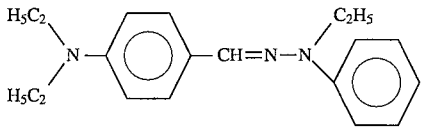

On the resulting electrophotographic light-sensitive element, a transfer layer was formed in the same manner as in Example 101. Using the light-sensitive material thus obtained, a printing plate was prepared in the same manner as in Example 101 except for using a helium-neon laser beam (oscillation wavelength: 630 nm) in place of the semiconductor laser beam (oscillation wavelength: 780 μm) employed in Example 101. As a result of the evaluation on various characteristics, good results similar to those in Example 101 were obtained.

EXAMPLES 149 TO 160

A printing plate was prepared by subjecting some of the image receiving materials bearing the transfer layers (i.e., printing plate precursors) used in Examples 101 to 148 to the following oil-desensitizing treatment. Specifically, to 0.2 mol of each of the nucleophilic compound shown in Table M below, 50 g of each of the organic solvents shown in Table M below, and 2 g of Newcol B4SN (manufactured by Nippon Nyukazai K.K.) was added distilled water to make 1 l, and a pH of the solution was adjusted to 13.0. Each printing plate precursor was immersed in the resulting solution at a temperature of 35° C. for one minute with moderate rubbing of the surface of plate to remove the transfer layer.

Printing was carried out using the resulting printing plate under the same conditions as in each of the basis examples. Each plate exhibited good characteristics similar to those in each of the basis examples.

TABLE M

| Example | Basis Example for Printing Plate Precursor | Nucleophilic Compound | Organic Solvent |
|---|---|---|---|
| 149 | Example 128 | Sodium sulfite | N,N-Dimethylacetamide |
| 150 | Example 129 | Monoethanolamine | Benzyl alcohol |
| 151 | Example 131 | Diethanolamine | Methyl ethyl ketone |
| 152 | Example 133 | Thiomalic acid | Propylene glycol monomethyl ether |
| 153 | Example 135 | Thiosalicylic acid | N-Methylpyrrolidone |
| 154 | Example 136 | Taurine | Tetrahydropyran |
| 155 | Example 137 | 4-Sulfobenzenesulfinic acid | Benzyl alcohol |
| 156 | Example 139 | Thioglycolic acid | 1,3-Dimethyl-2-imidazolidone |
| 157 | Example 141 | 2-Mercaptoethylphosphonic acid | Ethylene glycol monomethyl ether |
| 158 | Example 143 | Cysteine | N-Methylacetamide |
| 159 | Example 144 | Sodium thiosulfate | Sulfolane |
| 160 | Example 145 | Ammonium sulfite | Benzyl alcohol |

EXAMPLE 161

A mixture of 2 g of X-form metal-free phthalocyanine (manufactured by Dainippon Ink and Chemicals, Inc.), 10 g of Binder Resin (B-106) having the structure shown below, 0.15 g of Compound (C) having the structure shown below, and 80 g of tetrahydrofuran was put into a 500 ml-volume glass container together with glass beads and dispersed in a paint shaker (manufactured by Toyo Seiki Seisakusho Co.) for 60 minutes. To the dispersion was added 0.001 g of phthalic acid, followed by further dispersing for 2 minutes. The glass beads were separated by filtration to prepare a dispersion for a light-sensitive layer.

Binder Resin (B-106)

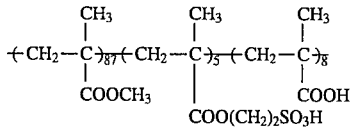

Mw $5\times10^4$

Compound (C)

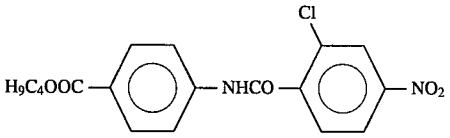

The resulting dispersion was applied by dip coating onto a cylindrical aluminum substrate having a thickness of 0.25 mm, a surface of which had been grained, set to touch, and heated in a circulating oven at 110° C. for 20 seconds, and then further heated at 140° C. for one hour to form a light-sensitive layer having a thickness of 8 μm. The adhesion strength of the surface of the resulting electrophotographic light-sensitive element was more than 400 gf.

On the surface of light-sensitive element was formed a transfer layer of a double-layered structure. Specifically, on the surface of light-sensitive element, a dispersion of positively charged resin grains prepared by adding 7 g (solid basis) of Resin Grain (ARH-15), 0.5 g of Compound (S-29) and 0.03 g of Charge Control Agent (CD-3) to one liter of Isopar H was applied in the same manner as in Example 101 to form a first transfer layer having a thickness of 2.5 μm. Then, on the surface of first transfer layer, a dispersion of positively charged resin grains prepared by adding 6 g of Resin Grain (ARL-11) and 0.02 g of Charge Control Agent (CD-1) to one liter of Isopar H was applied in the same manner as above to prepare a second transfer layer having a thickness of 2.5 μm.

On the resulting light-sensitive material, duplicated images were formed in the same manner as in Example 101 except for using Liquid Developer (LD-102) shown below in place of Liquid Developer (LD-101).

Preparation of Liquid Developer (LD-102)

A copolymer of octadecyl methacrylate and methyl methacrylate (9:1 ratio by mole) as a binder resin and carbon black (#40 manufactured by Mitsubishi Kasei Corp.) were thoroughly mixed in a weight ratio of 2:1 and kneaded by a three-roller mill heated at 140° C. A mixture of 12 g of the resulting kneading product, 4 g of a copolymer of styrene and butadiene (Sorprene 1205 manufactured by Asahi Kasei Kogyo K.K.) and 76 g of Isopar G was dispersed in a Dyno-mill. The toner concentrate obtained was diluted with Isopar G so that the concentration of solid material was 1 g per liter, and $1\times10^4$ mol per liter of sodium dioctylsulfosuccinate was added thereto to prepare Liquid Developer (LD-102).

The light sensitive material having the toner images was brought into contact with an aluminum substrate for FUJI SP-Plate FPD and they were passed between a pair of rubber rollers which were in contact with each other under a pressure of 5 Kgf/cm$^2$ and whose surface temperature was constantly maintained at 100° C. at a transportation speed of 8 mm/sec.

After cooling the both materials while being in contact with each other to room temperature, the aluminum substrate was stripped from the light-sensitive element whereby the toner images were transferred together with the transfer layer to the aluminum substrate. It was found that the whole toner image on the light-sensitive material according to the present invention was heat-transferred together with the transfer layer onto the aluminum substrate to provide a clear image without background stain on the aluminum substrate which showed substantially no degradation in image quality as compared with the original.

Further, for the purpose of improving adhesion of the toner image to the aluminum substrate, improving the oil-desensitizing property and preventing falling of toner image at the time of printing, the plate was heated at 140° C. for 2 minutes.

Then, the plate of aluminum substrate having thereon the transfer layer was subjected to an oil-desensitizing treatment (i.e., removal of the transfer layer) to prepare a printing plate and its printing performance was evaluated. Specifically, the plate was immersed in Oil-Desensitizing Solution (E-102) at 30° C. for 60 seconds with moderate rubbing of the surface of plate to remove the transfer layer and thoroughly washed with water to obtain a printing plate.

The printing plate thus prepared was observed visually using an optical microscope of 200 magnifications. It was found that the non-image areas had no residual transfer layer, and the image areas suffered no defects in high definition regions (i.e., cutting of fine lines and fine letters).

The printing plate was subjected to printing in the same manner as in Example 101. As a result, more than 50,000 prints with clear images free from background stains were obtained irrespective of the kind of color inks.

As described above, a means for effecting sufficient adhesion of toner image to a receiving material can be performed after the heat-transfer of toner image together with the transfer layer depending on the kind of liquid developer used for the formation of toner image.

Also, a flash fixing method or a heat roll fixing method can be employed as a means for improving adhesion of toner image.

While the invention has been described in detail and with reference to specific embodiments thereof, it will be apparent to one skilled in the art that various changes and modifications can be made therein without departing from the spirit and scope thereof.

What is claimed is:

1. A method for preparation of a printing plate by an electrophotographic process comprising the steps of forming a peelable transfer layer comprising a resin (A) capable of being removed upon a chemical reaction treatment on a surface of an electrophotographic light-sensitive element, forming a toner image on the transfer layer by an electrophotographic process, heat-transferring the toner image together with the transfer layer onto a receiving material a surface of which is capable of providing a hydrophilic surface suitable for lithographic printing at the time of printing, and removing the transfer layer on the receiving material upon the chemical reaction treatment, wherein prior to or simultaneously with the formation of said peelable transfer layer a compound (S) which contains a fluorine atom and/or a silicon atom is applied to the surface of electrophotographic light-sensitive element to improve releasability of the surface of electrophotographic light-sensitive element.

2. A method for preparation of a printing plate by an electrophotographic process as claimed in claim 1, wherein after the application of Compound (S), the surface of the electrophotographic light-sensitive element being in contact with the transfer layer has an adhesive strength of not more than 100 gram.force.

3. A method for preparation of a printing plate by an electrophotographic process as claimed in claim 1, wherein the compound (S) is soluble at least 0.01 g in one liter of an electrically insulating organic solvent having an electric resistance of not less than $10^8$ Ω.cm and a dielectric constant of not more than 3.5.

4. A method for preparation of a printing plate by an electrophotographic process as claimed in claim 1, wherein the resin (A) contains at least one polymer component selected from the group consisting of: polymer component (a) containing at least one polar group selected from the group consisting of a —$CO_2H$ group, a —CHO group, a —$SO_3H$ group, a —$SO_2H$ group, a —P(=O)(OH)$R^1$ group (wherein $R^1$ represents a —OH group, a hydrocarbon group or a —$OR^2$ group (wherein $R^2$ represents a hydrocarbon group)), a phenolic hydroxy group, a cyclic acid anhydride-containing group, a —CONHCO$R^3$ group (wherein $R^3$ represents a hydrocarbon group) and a —CONH$SO_2R^3$ group (wherein $R^3$ represents a hydrocarbon group); and polymer component (b) containing at least one functional group capable of forming at least one hydrophilic group selected from the group consisting of a —$CO_2H$ group, a —CHO group, a —$SO_3H$ group, a —$SO_2H$ group, a —$PO_3H_2$ group and a —OH group upon a chemical reaction.

5. A method for preparation of a printing plate by an electrophotographic process as claimed in claim 4, wherein the resin (A) contains at least one of the polymer components (a) and at least one of the polymer components (b).

6. A method for preparation of a printing plate by an electrophotographic process as claimed in claim 4, wherein the resin (A) contains a polymer component (c) containing a moiety having at least one of a fluorine atom and a silicon atom.

7. A method for preparation of a printing plate by an electrophotographic process as claimed in claim 6, wherein the polymer component (c) is present as a block in the resin (A).

8. A method for preparation of a printing plate by an electrophotographic process as claimed in claim 1, wherein the transfer layer comprises a resin (AH) having a glass transition point of from 10° C. to 140° C. or a softening point of from 35° C. to 180° C. and a resin (AL) having a glass transition point of from −50° C. to 45° C. or a softening point of from 0° C. to 60° C. in which a difference in the glass transition point or softening point between the resin (AH) and the resin (AL) is at least 2° C.

9. A method for preparation of a printing plate by an electrophotographic process as claimed in claim 1, wherein the transfer layer is composed of a lower layer which is in contact with the surface of the electrophotographic light-sensitive element and which contains a resin (AH) having a glass transition point of from 10° C. to 140° C. or a softening point of from 35° C. to 180° C. and an upper layer provided thereon containing a resin (AL) having a glass transition point of from −50° C. to 45° C. or a softening point of from 0° C. to 60° C. in which a difference in the glass transition point or softening point between the resin (AH) and the resin (AL) is at least 2° C.

10. A method for preparation of a printing plate by an electrophotographic process as claimed in claim 1, wherein the transfer layer is formed by a hot-melt coating method.

11. A method for preparation of a printing plate by an electrophotographic process as claimed in claim 1, wherein the transfer layer is formed by an electrodeposition coating method.

12. A method for preparation of a printing plate by an electrophotographic process as claimed in claim 1, wherein the transfer layer is formed by a transfer method.

13. A method for preparation of a printing plate by an electrophotographic process as claimed in claim 11, wherein the electrodeposition coating method is carried out using grains comprising the resin (A) supplied as a dispersion thereof in an electrically insulating solvent having an electric resistance of not less than $10^8$ Ω.cm and a dielectric constant of not more than 3.5.

14. A method for preparation of a printing plate by an electrophotographic process as claimed in claim 11, wherein the electrodeposition coating method is carried out using grains comprising the resin (A) which are supplied between the electrophotographic light-sensitive element and an electrode placed in face of the light-sensitive element, and migrate due to electrophoresis according to potential gradient applied from an external power source to adhere to or electrodeposit on the electrophotographic light-sensitive element, to thereby form a film.

15. A method for preparation of a printing plate by an electrophotographic process as claimed in claim 13, wherein the dispersion further contains the compound (S) which is soluble at least 0.01 g in one liter of the electrically insulating solvent.

16. A method for preparation of a printing plate by an electrophotographic process comprising applying a compound (S) which contains a fluorine atom and/or silicon atom to the surface of an electrophotographic light-sensitive element, forming a peelable transfer layer comprising a resin (A) capable of being removed upon a chemical reaction treatment on the surface of electrophotographic light-sensitive element, forming a toner image on the transfer layer by an electrophotographic process, heat-transferring the toner image together with the transfer layer onto a receiving material a surface of which is capable of providing a hydrophilic surface suitable for lithographic printing at the time of printing, and removing the transfer layer on the receiving material upon the chemical reaction treatment.

17. A method for preparation of a printing plate by an electrophotographic process comprising forming a peelable transfer layer by applying a composition comprising a resin (A) capable of being removed upon a chemical reaction treatment and a compound (S) which contains a fluorine atom and/or silicon atom to the surface of an electrophotographic light-sensitive element, forming a toner image on the transfer layer by an electrophotographic process, heat-transferring the toner image together with the transfer layer onto a receiving material a surface of which is capable of providing a hydrophilic surface suitable for lithographic printing at the time of printing, and removing the transfer layer on the receiving material upon the chemical reaction treatment.

* * * * *